US010918146B1

(12) United States Patent
Dickerson et al.

(10) Patent No.: US 10,918,146 B1
(45) Date of Patent: Feb. 16, 2021

(54) TOUCH PROTECTOR

(71) Applicant: NO-KNOB, LLC, West Bloomfield, MI (US)

(72) Inventors: Anne Govan Dickerson, Sag Harbor, NY (US); Sorcha Anne Sayers Bartlett, Grand Rapids, MI (US)

(73) Assignee: NO-KNOB, LLC, West Bloomfield, MI (US)

( * ) Notice: Subject to any disclaimer, the term of this patent is extended or adjusted under 35 U.S.C. 154(b) by 0 days.

(21) Appl. No.: 15/930,242

(22) Filed: May 12, 2020

Related U.S. Application Data

(60) Provisional application No. 62/988,523, filed on Mar. 12, 2020.

(51) Int. Cl.
*A41D 13/08* (2006.01)
*A41D 19/01* (2006.01)

(52) U.S. Cl.
CPC ..... *A41D 19/01* (2013.01); *A41D 13/087* (2013.01)

(58) Field of Classification Search
CPC ..... A41D 19/01; A41D 13/087
USPC ..... 2/21
See application file for complete search history.

(56) References Cited

U.S. PATENT DOCUMENTS 342,341 A * 5/1886 Edwards ..... A61F 13/105 294/25
645,550 A * 3/1900 Clark ..... A47J 17/02 30/123.5
1,235,199 A * 7/1917 Gavin ..... A41D 13/087 2/21
1,990,553 A * 2/1935 Hirsch ..... A41D 13/087 2/20
2,041,262 A * 5/1936 Ness ..... A46B 5/04 15/188
2,840,950 A * 7/1958 Cotler ..... A63H 3/14 446/329
3,407,927 A * 10/1968 Jones ..... A47J 43/283 206/372
4,127,222 A * 11/1978 Adams ..... D05B 91/04 2/21
4,751,747 A * 6/1988 Banks ..... A41D 19/01529 2/161.8
5,234,142 A * 8/1993 Loewen ..... A41D 13/087 2/21
5,280,661 A * 1/1994 Brown ..... A47L 13/18 15/214

(Continued)

OTHER PUBLICATIONS

Hippo Frog Shape Silicone Insulated Gloves Oven Mitt Heat Resistant; Light in the box; pp. 1-4; Retrieved May 12, 2020.

(Continued)

*Primary Examiner* — Khaled Annis
(74) *Attorney, Agent, or Firm* — Hauptman Ham, LLP

(57) ABSTRACT

An apparatus includes a first base portion having a first surface and a second surface opposite the first surface. The apparatus also includes a second base portion having a third surface and a fourth surface opposite the third surface. The apparatus further includes a bridge portion coupling the first base portion and the second base portion. The apparatus additionally includes a tether one or more of extending from or coupled with at least one of the first base portion, the second base portion, or the bridge portion.

20 Claims, 44 Drawing Sheets

(56) References Cited

U.S. PATENT DOCUMENTS 5,282,276 A * 2/1994 Preiose ..... A45D 29/00 132/73
5,359,840 A * 11/1994 Costar ..... A01D 7/00 172/378
D368,330 S * 3/1996 Robinson ..... D29/119
5,688,181 A * 11/1997 Albert ..... A63B 21/4019 2/21
5,749,097 A * 5/1998 Garrett-Roe ..... A41D 13/087 2/21
5,848,928 A * 12/1998 Wong ..... A47G 21/10 446/329
6,012,165 A * 1/2000 Cain ..... A41D 13/087 15/236.01
D425,261 S * 5/2000 Basile ..... D29/118
6,145,128 A * 11/2000 Suzuki ..... A41D 13/087 2/21
D634,898 S * 3/2011 Lion ..... D29/119
8,943,612 B2 * 2/2015 Jeong ..... A41D 19/0055 2/161.8
9,033,383 B2 * 5/2015 Rampersad ..... A47G 21/10 294/25
D831,896 S * 10/2018 Krahe ..... D29/114
10,133,350 B1 * 11/2018 Graham ..... A41D 13/087
10,517,440 B2 * 12/2019 Leibovitch ..... A47J 43/25
2003/0131393 A1 * 7/2003 Votolato ..... A41D 13/081 2/16
2005/0108802 A1 * 5/2005 Burnett ..... A41D 13/087 2/16
2005/0160512 A1 * 7/2005 DeYoung ..... A41D 13/087 2/21
2007/0210596 A1 * 9/2007 Stewart ..... A47G 21/10 294/99.2
2008/0018123 A1 * 1/2008 Cox ..... B42D 9/04 294/25
2009/0100562 A1 * 4/2009 Liang ..... A41D 19/01547 2/20
2012/0278964 A1 * 11/2012 Bormann-Early ... A41D 13/087 2/21
2013/0007987 A1 * 1/2013 Kleindorfer ..... B25G 1/102 16/421
2013/0061364 A1 * 3/2013 Robb ..... A41D 13/087 2/21
2014/0068828 A1 * 3/2014 Holmes ..... A41D 13/087 2/21
2014/0078118 A1 * 3/2014 Robb ..... A41D 19/0024 345/179
2014/0245517 A1 * 9/2014 Henry ..... A41D 19/01 2/16
2014/0331377 A1 * 11/2014 Taylor-Lopez ..... A41D 13/087 2/21
2015/0272239 A1 * 10/2015 Bazley ..... A41D 13/087 30/295
2017/0215494 A1 * 8/2017 Savides ..... A47J 17/10
2018/0008071 A1 * 1/2018 Jeong ..... A47G 21/001
2018/0168248 A1 * 6/2018 Cicco ..... A41D 13/087
2018/0199643 A1 * 7/2018 Walker ..... A41D 19/0062
2019/0142192 A1 * 5/2019 Rampersd ..... A47J 43/283 294/99.2

OTHER PUBLICATIONS

Silicone Oven Mitt—Made by Design™; Target / Kitchen & Dining / Kitchen & Table Linens / Oven Mitts & Potholders; pp. 1-14; Retrieved May 12, 2020, from https://www.target.com/p/silicone-oven-mitt-made-by-design-8482/-/A-53226486.

Ninja Silicone Mitts, AMC108; Target / Kitchen & Dining / Kitchen & Table Linens / Oven Mitts & Potholders; pp. 1-8; Retrieved May 12, 2020.

BergHOFF Silicone 2Pc Pot Holder Set; Target / Kitchen & Dining / Kitchen & Table Linens / Oven Mitts & Potholders; pp. 1-8; Retrieved May 12, 2020, from https://www.target.com/p/berghoff-silicone-2pc-pot-holder-set/-/A-79430538.

2 Pack Silicone Oven Gloves Heat Resistant Mini Mitt Pot Holder Cooking BBQ; Walmart.com; pp. 1-6; Retrieved May 12, 2020.

Dexas Silicone Micromitt™ 2-Pack; Kitch'n; Home / Tableware; Retrieved May 12, 2020, from https://www.kitchn.shop/products/dexas-silicone-micromitt-2-pack.html?gclid=CjwKCAjwv4_1BRAhEiwAtMDLskY_64dLk1sqzocOF-mKHN0oCWgemiC9ft551 uqW90pccbSrTVku8xoCC90QAvD_BwE.

Urban Trend® Finger Armor Cutting Guard; Kitch'n; Home / Knives; Retrieved May 12, 2020, from https://www.kitchn.shop/products/urban-trend-finger-armor-cutting-guard.html?gclid=CjwKCAjwv4_1BRAhEiwAtMDLsu1wiFOcTd5u4LWfkYY_rRz7ki_-INPnwtAidInYpxXu3GLIRPO78BoCP-sQAvD_BwE.

* cited by examiner

TOUCH PROTECTOR

PRIORITY

The present application claims priority to U.S. Provisional Patent Application No. 62/988,523, filed Mar. 12, 2020, which is incorporated by reference herein in its entirety.

BACKGROUND

People often grab, or at least touch, doorknobs, door handles, doors, windows, or surfaces when opening or closing doors. People also grab or at least touch objects or one or more surfaces of an object when picking up or otherwise moving an object. Touching unsanitary doorknobs, door handles, doors, windows, objects, surfaces, and the like can lead to the spread of disease, illness and/or infection.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
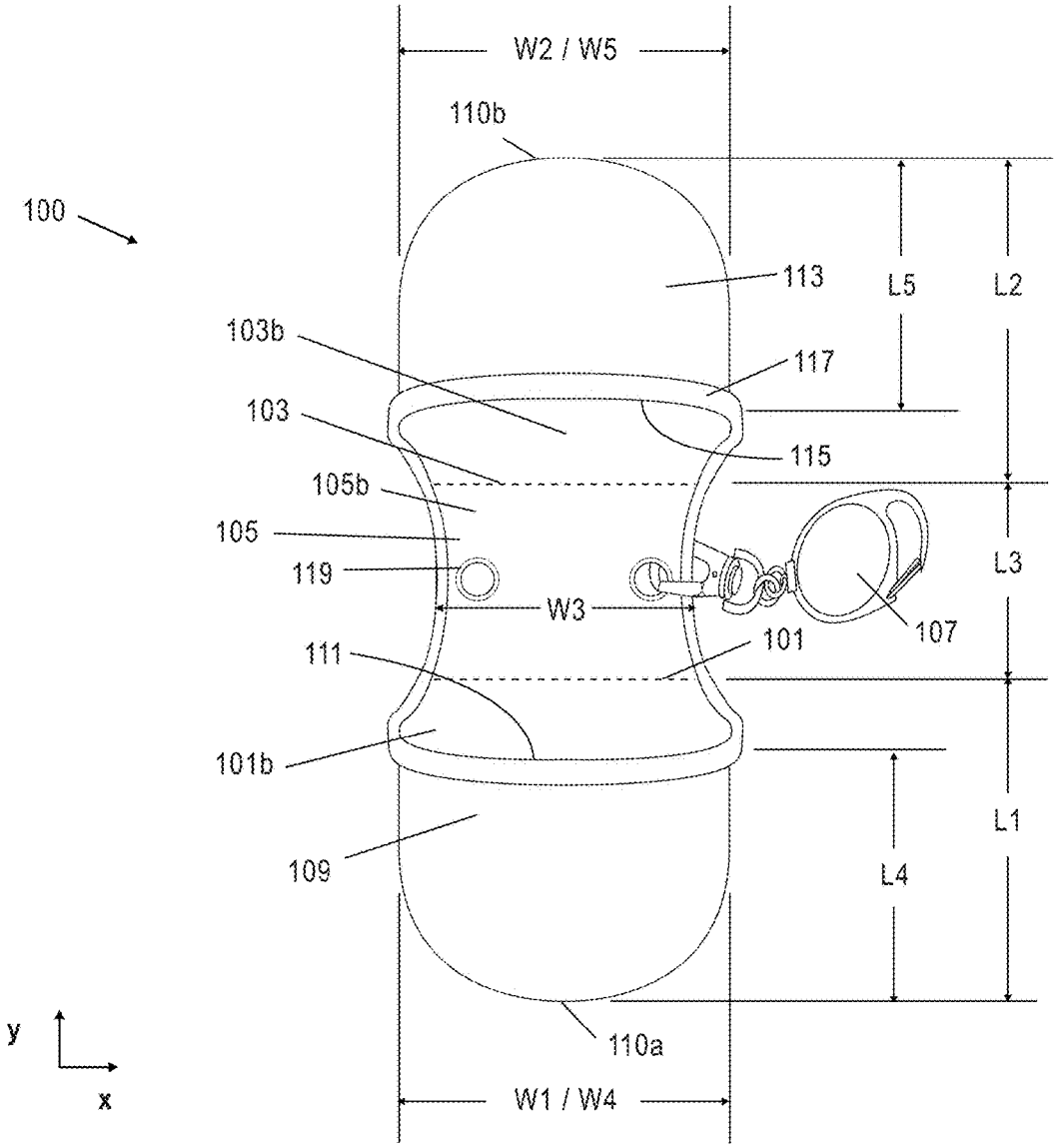
FIG. 1 is a top-side view of a touch protector in an open position, in accordance with one or more embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

People often grab, or at least touch, doorknobs, door handles, doors, windows, or surfaces when opening or closing doors. People also grab or at least touch objects or one or more surfaces of an object when picking up or otherwise moving an object. Touching unsanitary doorknobs, door handles, doors, windows, objects, surfaces, and the like can lead to the spread of disease, illness and/or infection.

People sometimes attempt to avoid touching doorknobs, door handles, doors, windows, objects, surfaces, and the like with one's hands or fingers by using an elbow, knee, foot, shoulder, back, glove, etc. But, practices such as these may put a person in an uncomfortable or unsafe position and may also lead to unintended touching of a contaminated body part, clothing or glove by a person's hand or fingers without first sanitizing the contaminated body part, clothing or glove, for example.

The discussed embodiments are directed to a touch protector that provides a sanitary way to one or more of open doors, hold open doors, push or pull door handles, push or pull doorknobs, twist doorknobs, push elevator buttons, open windows, pick up or move objects, actuate touchpads, interact with touchscreens, etc. while avoiding direct contact with one's hands and fingers. By avoiding direct contact between one's hands and fingers and a potentially contaminated surface, the opportunity for a person to inadvertently cause skin to skin contact between a hand or finger that has contacted a potentially contaminated surface and one's face, eyes, nose, mouth, open wound, or other body part, and/or the face, eyes, nose, mouth, open wound, or other body part of another person can be minimized.

Minimizing skin to skin contact between a hand or finger that has contacted a potentially contaminated surface and one's face, eyes, nose, mouth, open wound, or other body part, and/or the face, eyes, nose, mouth, open wound, or other body part of another person helps to prevent the spread of disease, illness or infection caused by germs, bacteria, fungi, viruses, protozoa, other microbes or microorganisms, parasites, insects, etc.

Minimizing skin to skin contact between a hand or finger that has contacted a potentially contaminated surface and one's face, eyes, nose, mouth, open wound, or other body part, and/or the face, eyes, nose, mouth, open wound, or other body part of another person also helps to reduce a person's fear or anxiety that may be associated with the opportunity to contract a disease, illness or infection caused by germs, bacteria, fungi, viruses, protozoa, other microbes or microorganisms, parasites, insects, etc. by touching potentially contaminated items.

Furthermore, by avoiding direct contact between one's hands and fingers and a potentially contaminated surface, a person can avoid directly touching a dirty, greasy, or debris covered surface or object to help prevent dirt, grease, dust, debris, etc. from being transferred to other body parts or clothing of the person or others.

FIG. 1 is a top-side view of a touch protector 100 in an open position, in accordance with one or more embodiments. Touch protector 100 comprises a first base portion 101 having a first surface 101*a* (FIG. 3) and a second surface 101*b* opposite the first surface 101*a*, a second base portion 103 having a third surface 103*a* (FIG. 3) and a fourth surface 103*b* opposite the third surface 103*a*, a bridge portion 105 coupling the first base portion 101 and the second base portion 103. Bridge portion 105 has a fifth surface 105*a* (FIG. 3) and a sixth surface 105*b* opposite the fifth surface 105*a*.

In some embodiments, the fifth surface 105*a* of the bridge portion 105 adjoins one or more of the first surface 101*a* of the first base portion 101 or the third surface 103*a* of the second base portion 103, and the sixth surface 105*b* of the bridge portion 105 adjoins one or more of the second surface 101*b* of the first base portion 101 or the fourth surface 103*b* of the second base portion 103.

Touch protector 100 includes an optional tether 107 one or more of extending from or coupled with at least one of the first base portion 101, the second base portion 103, or the bridge portion 105. In some embodiments, touch protector 100 is free from having tether 107.

In some embodiments, one or more of the first surface 101*a*, the second surface 101*b*, the third surface 103*a*, the fourth surface 103*b*, the fifth surface 105*a* or the sixth surface 105*b* is textured. In some embodiments, the first surface 101*a*, the second surface 101*b*, the third surface 103*a*, the fourth surface 103*b*, the fifth surface 105*a* and the sixth surface 105*b* are smooth and free from texturing surface features.

Touch protector 100 comprises a first backing member 109 on a second surface 101*b* side of the first base portion 101. A structure formed by the first base portion 101 and the first backing member 109 has an end 110*a*. The first backing member 109 and the first base portion 101 are configured to have a first space 111 between the first backing member 109 and the first base portion 101. Touch protector 100 additionally comprises a second backing member 113 on a fourth surface 103*b* side of the second base portion 103. A structure formed by the second base portion 103 and the second backing member 113 has an end 110*b*. The second backing member 113 and the second base portion 103 are configured to have a second space 115 between the second backing member 113 and the second base portion 103.

In some embodiments, touch protector 100 is free from having one or more of the first backing member 109 or the second backing member 113. In some embodiments, the one or more of the first backing member 109 or the second backing member 113 comprises one or more of a loop, strap, projection, flap, or plurality of projections, or other suitable structure that extend(s) from the corresponding first base portion 101 or second base portion 103.

In some embodiments, at least one of the first space 111 formed by the first backing member 109 and the first base portion 101 or the second space 115 formed by the second backing member 113 and the second base portion 103 is a cavity having one opening. In some embodiments, at least one of the first space formed by the first backing member 109 and the first base portion 101 or the second space formed by the second backing member 113 and the second base portion 103 is a cavity having more than one opening.

The first base portion 101 has a first mass, the second base portion 103 has a second mass, and the bridge portion 105 is configured to flex based on at least one of the first mass or the second mass such that the first base portion 101, the second base portion 103 and the bridge portion 105 together form a substantially U-shaped structure in a side view if the first base portion 101 is over the second base portion 103, if the second base portion 103 is over the first base portion 101, and if the bridge portion 105 is over the first base portion 101 and the second base portion 103.

In some embodiments, first base portion 101, the second base portion 103 and the bridge portion 105 together form a substantially U-shaped structure in a side view if the first base portion 101 is over the second base portion 103, if the second base portion 103 is over the first base portion 101, and if the bridge portion 105 is over the first base portion 101 and the second base portion 103, wherein the a spacing between the first base portion 101, the second base portion 103 and the bridge portion is pie-shaped such that the first surface 101*a* of the first base portion 101 and the third surface 103*a* of the second base portion 103 are angled with respect to one another, and a gap between the bridge portion side of the first base portion 101 and the second base portion 103 is greater than a gap between the ends of the first base portion 101 and the second base portion 103 that are away from the bridge portion 105.

In some embodiments, the bridge portion 105 is configured to prevent the first base portion 101 from being in direct physical contact with the second base portion 103 if the first base portion 101 is over the second base portion 103, if the second base portion 103 is over the first base portion 101, and/or if the bridge portion 105 is over the first base portion 101 and the second base portion 103.

In some embodiments, the bridge portion 105 is one or more of flexible or hinged to allow the first base portion 101 to be in direct physical contact with the second base portion 103 if the first base portion 101 is over the second base portion 103, if the second base portion 103 is over the first base portion 101, and/or if the bridge portion 105 is over the first base portion 101 and the second base portion 103.

In some embodiments, touch protector 100 is a mitt-like structure, with foldable sides that are capable of being held between one or more of a user's fingers and/or a user's thumb to facilitate the user's touching or grabbing of surfaces, objects, doorknobs, door handles, buttons, keypads, touchscreens, etc. In some embodiments, touch protector 100 is a mitt-like structure, with foldable sides, one or more of which has a cavity, protrusion, or plurality of protrusions configured to accommodate or interact with one or more of a user's fingers and/or a user's thumb to facilitate the user's touching or grabbing of surfaces, objects, doorknobs, door handles, buttons, keypads, touchscreens, etc.

For example, if a user's thumb is inserted into the first space 111 and the user's forefinger, alone, or in combination with one or more of the user's other fingers, is inserted into the second space 115, when the user draws the thumb and one or more fingers together, the touch protector 100 is configured to contract with the user's movement such that the first surface 101*a* of the first base portion 101 is moved toward the third surface 103*a* of the second base portion 103. In some embodiments, touch protector 100 is capable of accommodating a user's thumb in one of the first space 111 or the second space 115 and one, two, three or four fingers in the other of the first space 111 or the second space 115. In some embodiments, touch protector 100 is configured to accommodate at least one finger in one of the first space 111 or the second space 115 and at least one other finger in the other of the first space 111 or the second space 115.

In some embodiments, a first structure comprising the first base portion 101 and the first backing member 109 is identical to a second structure comprising the second base portion 103 and the second backing member 113. In some embodiments, a first structure comprising the first base portion 101 and the first backing member 109 differs from a second structure comprising the second base portion 103 and the second backing member 113. For example, in some embodiments, a first structure comprising the first base portion 101 and the first backing member 109 is larger in at least one of a length direction or a width direction compared to a second structure comprising the second base portion 103 and the second backing member 113 such that the larger structure is configured to accommodate two or more fingers and the smaller structure is configured to accommodate a thumb or lesser quantity of fingers compared to the larger structure.

The first base portion 101 comprises a first material, the second base portion 103 comprises a second material, the bridge portion 105 comprises a third material, the first backing member 109 comprises a fourth material, and the second backing member 113 comprises a fifth material.

In some embodiments, one or more of the first material, the second material, the third material, the fourth material or the fifth material comprises silicone. In some embodiments, one or more of the first material, the second material, the third material, the fourth material or the fifth material comprises silicone, rubber, silicone rubber, elastane, spandex, lycra, urethane, polyester, some other suitable polymer, or some other suitable material. In some embodiments, one or more of the first material, the second material, the third material, the fourth material or the fifth material is capable of being readily sanitized, cleaned, and disinfected such that the touch protector is reusable.

In some embodiments, the first material, the second material, the third material, the fourth material and the fifth material are identical. In some embodiments, at least one of the first base portion 101, the second base portion 103, the bridge portion 105, the first backing member 109 or the second backing member 113 comprises a different material than at least one other of the first base portion 101, the second base portion 103, the bridge portion 105, the first backing member 109 or the second backing member 113.

In some embodiments, at least one of the second material, the third material, the fourth material or the fifth material is more flexible than the first material under a predetermined load at standard temperature and pressure. In some embodiments, at least one of the second material, the third material, the fourth material or the fifth material is less flexible than the first material under a predetermined load at standard temperature and pressure. In some embodiments, one or more of the first backing member 109 or the second backing member 113 comprises a different material than the first base portion 101 or the second base portion 103. In some embodiments, the first material and the second material are identical, and at least one of the fourth material or the fifth material is different from the first material and the second material. In some embodiments, the first material, the second material and the third material are identical, and at least one of the fourth material or the fifth material is different from the first material, the second material and the third material.

First base portion 101 has a length L1 in a first direction and a width W1 in a second direction orthogonal to the first direction. Second base portion 103 has a length L2 in the first direction and a width W2 in the second direction. Bridge portion 105 has a length L3 in the first direction and a width W3 in the second direction. First backing member 109 has a length L4 in the first direction extending from an end of the first backing member 109 to an upper edge of the first space 111 and a width W4 in the second direction. Second backing member 113 has a length L5 in the first direction extending from an end of the second backing member 113 to an upper edge of the second space 115 and a width W5 in the second direction.

In some embodiments, the length L1 and width W1 of the first base portion 101 are identical to the length L2 and width W2 of the second base portion 103. In some embodiments, one or more of the length L1 or width W1 of the first base portion 101 is different from the length L2 and width W2 of the second base portion 103.

In some embodiments, one or more of the length L3 and width W3 of the bridge portion 105 is different from at least one of the length L1 or the width W1 of the first base portion 101 or the length L2 or the width W2 of the second base portion 103. In some embodiments, a reduced length, width and/or thickness of the bridge portion 105 and/or one of the first base portion 101 or the second base portion 103 compared to the first base portion 101 and/or the second base portion 103 helps to enhance the flexibility/foldability of the touch protector 100, reduce material usage, weight and costs associated with manufacturing the touch protector 100.

In some embodiments, at least one of the length L4 and width W4 of the first backing member 109 or the length L5 and width W5 the second backing member 113 is identical to the length and width of the corresponding first base portion 101 or the second base portion 103. In some embodiments, at least one of the length L4 and width W4 of the first backing member 109 or the length L5 and width W5 the second backing member 113 is different from at least one of the length L1/L2 or the width W1/W2 of at least one of the first base portion 101 or the second base portion 103. In some embodiments, a reduced length, width and/or thickness of the first backing member 109 or the second backing member 113 compared to the first base portion 101 and/or the second base portion 103 helps to reduce material usage, weight and costs associated with manufacturing the touch protector 100.

In some embodiments, one or more of the length L4 of the first backing member 109 is less than the length L1 of the or the length L5 of the second backing member 113 to maximize an alignment between a user's knuckles and the edge of the first backing member 109 defining the first space 111 or the second backing member 113 defining the second space 115 and minimize a length of the first space 111 and/or the second space 115 in the first direction. In some embodiments, a user's tactile experience and ability to grasp a round object such a doorknob is improved if a user's knuckles are substantially aligned with the of the first backing member 109 defining the first space 111 or the second backing member 113 defining the second space 115, and an amount of space within the first space 111 and/or the second space 115 is minimized, because the first base portion 101, second base portion 103 and bridge portion 105 are caused to flex in a manner that corresponds with a flexing of the user's hand based on the contact points between the user's hand and the first backing member 109 and/or the second backing member 113.

In some embodiments, the sides of the bridge portion 105 are curved inward, or are concave, with respect to an interior of the bridge portion 105. In some embodiments, the sides of the bridge portion 105 are straight between the first base portion 101 and the second base portion 103. In some embodiments, one or more of the first base portion 101, the second base portion 103, the first backing member 109 or the second backing member 113 have an edge that makes a smooth transition into a side of the bridge member 105. In some embodiments, the smooth transition of one or more of the edges of the first base portion 101, the second base portion 103, the first backing member 109 or the second backing member 113 into a side of the bridge member 105 causes the first space 111 or the second space 115 to be at least partially open and improves a user's comfortable use of the touch protector 100, and makes the touch protector easier to clean.

In some embodiments, the structure formed by at least the first base portion 101, second base portion 103, and bridge portion 105 is substantially hour-glass shaped in a top view in which the touch protector 100 is in an open-state. In some embodiments, the structure formed by at least the first base portion 101, second base portion 103, and bridge portion 105 is oval-shaped in a top view in which the touch protector 100 is in an open-state. In some embodiments, the structure formed by at least the first base portion 101, second base portion 103, and bridge portion 105 is rectangular in a top view in which the touch protector 100 is in an open-state. In some embodiments, the structure formed by at least the first base portion 101, second base portion 103, and bridge portion 105 is square in a top view in which the touch protector 100 is in an open-state. In some embodiments, the structure formed by at least the first base portion 101, second base portion 103, and bridge portion 105 is oblong in a top view in which the touch protector 100 is in an open-state. In some embodiments, the structure formed by at least the first base portion 101, second base portion 103, and bridge portion 105 is circular in a top view in which the touch protector 100 is in an open-state. In some embodiments, the structure formed by at least the first base portion 101, second base portion 103, and bridge portion 105 is some other suitable shape in a top view in which the touch protector 100 is in an open-state. In some embodiments, the structure formed by at least the first base portion 101, second base portion 103, and bridge portion 105 is shaped to resemble an animal, a fictional character, or some other object to attract the attention of a user that might need to be induced to use the touch protector 100, such as a child. In some embodiments, the shape of the structure helps to make the touch protector 100 one or more of attractive, fashionable, fun and kid-friendly to help train and induce and adult or child user to use the touch protector 100.

In some embodiments, the structure formed by the first base portion 101 and the first backing member 109 has an end 110*a* that is curved in a top-side view with the touch protector 100 in an opened state. In some embodiments, the end 110*a* of the structure formed by the first base portion 101 and the first backing member 109 is squared off in a top-side view with the touch protector 100 in an opened state. In some embodiments, the structure formed by the second base portion 103 and the second backing member 113 has an end 110*b* that is curved in a top-side view with the touch protector 100 in an opened state. In some embodiments, the end 110*b* of the structure formed by the second base portion 103 and the second backing member 113 is squared off in a top-side view with the touch protector 100 in an opened state. In some embodiments, the shape of the end 110*a* of the structure formed by the first base portion 101 and the first backing member 109 is identical to the shape of the end 110*b* of the structure formed by the second base portion 103 and the second backing member 113. In some embodiments, the shape of the end 110*a* of the structure formed by the first base portion 101 and the first backing member 109 is different from the shape of the end 110*b* of the structure formed by the second base portion 103 and the second backing member 113. In some embodiments, one or more of the shape of the end 110*a* of the structure formed by the first base portion 101 and the first backing member 109 or the shape of the end 110*b* of the structure formed by the second base portion 103 and the second backing member 113 is pointed, hexagonal, octagonal, some other polygonal shape, multi-sectioned to facilitate separability between fingers, or some other suitable shape.

In some embodiments, the first base portion 101 has a first thickness in a third direction orthogonal to the first direction and the second direction, the second base portion 103 has a second thickness in the third direction, the bridge portion 105 has a third thickness in the third direction, the first backing member 109 has a fourth thickness in the third direction, and the second backing member 113 has a fifth thickness in the third direction.

At least one of the second base portion 103, the bridge portion 105, the first backing member 109 or the second backing member 113 is more flexible than the first base portion 101 under a predetermined load at standard temperature and pressure. In some embodiments, the second base portion 103, the bridge portion 105, the first backing member 109 or the second backing member 113 is less flexible than the first base portion 101 under a predetermined load at standard temperature and pressure.

In some embodiments, the first thickness, the second thickness, the third thickness, the fourth thickness and the fifth thickness are identical. In some embodiments, at least one of the second thickness, the third thickness, the fourth thickness or the fifth thickness is different from the first thickness.

In some embodiments, the first backing member 109 is connected with the first base portion 101, and the first backing member 109 and the first base portion 101 are configured to form a first collapsible pocket that expands to a maximum size of the first space 111 based on a size of an object within the first collapsible pocket and retracts to a minimum size of the first space 111 based the object being removed from the first collapsible pocket. In some embodiments, the second backing member 113 is connected with the second base portion 103, and the second backing member 113 and the second base portion 103 are configured to form a collapsible pocket that expands to a maximum size of the second space 115 based on a size of an object within the second collapsible pocket and retracts to a minimum size of the second space 115 based the object being removed from the second collapsible pocket.

For example, if a user inserts a thumb into the first space 111 and a forefinger into the second space 115, the first collapsible pocket expands to accommodate the thumb and the second collapsible pocket expands to accommodate the forefinger. But, when the thumb and forefinger are removed from the first collapsible pocket and the second collapsible pocket, then the first backing member 109 contracts or falls toward the first base portion 101 and the second backing member 113 contracts or falls toward the second base portion 103.

In some embodiments, the capability for the expansion and contraction of the first collapsible pocket and the second collapsible pocket, and/or for the bridge portion 105 being configured to flex such that the first base portion 101, the second base portion 103 and the bridge portion 105 together form a substantially U-shaped structure, or other suitable shape, in a side view if the first base portion 101 is over the second base portion 103, if the second base portion 103 is over the first base portion 101, and if the bridge portion 105 is over the first base portion 101 and the second base portion 103 is a function of one or more of the thicknesses or the materials of the first base portion 101, second base portion 103, bridge portion 105, first backing member 109 and second backing member 113. In some embodiments, at least the first base portion 101 and the second base portion 103 comprise a silicone material and the first backing member 109 and the second backing member 113 comprises one or more of silicone, elastane, spandex, lycra, urethane, polyester, or some other suitable polymer, fiber, cloth, or some other suitable material.

In some embodiments, one or more of the first space 111 or the second space 115 is always at least partially open when the touch protector 100 is hanging from a user's belt, bag, purse, briefcase, backpack, belt buckle, belt loop, pant leg, pocket, shirt, jacket, armband or other suitable location accessible to a user. In some embodiments, one or more of the first backing member 109 or the second backing member 113 forms a non-collapsible pocket with the first base portion 101 or the second base portion 103 such that the first space 111 and/or the second space 115 is substantially uniform in size and shape regardless of whether a user inserts a thumb or one or more fingers into the first space 111 or the second space 115. With one or more of the first space 111 or the second space 115 always at least partially open, the touch protector 100 allows for a user to easily slip a thumb and/or one or more fingers into the first space 111 or the second space 115 on demand.

Touch protector 100 includes a ridge 117 that extends along opposing sides of the bridge portion 105 and along the edges of the first backing member 109 and the second backing member 113 that define openings for the first space 111 and the second space 113. The ridge 117 has a thickness that is greater than the fourth thickness of the first backing member 109 and the fifth thickness of the second backing member 113. In some embodiments, a thickness of ridge 117 is uniform throughout an entirety of the ridge 117. In some embodiments, the thickness of the ridge 117 is varies among different locations of the ridge 117. In some embodiments, the thickness of ridge 117 is greater than the third thickness of the bridge portion 105.

In some embodiments, the touch protector 100 is free from including the ridge 117. In some embodiments, touch protector 100 is free from including the ridge 117 on the bridge portion. In some embodiments, touch protector 100 includes ridge 117 on one or more of the first backing member 109 or the bridge portion 105, and the second backing member 113 is free from having ridge 117. In some embodiments, ridge 117 adds structural support to one or more of the first backing member 109 or the second backing member 113 to cause one or more of the first space 111 or the second space 115 to always be at least partially open when the touch protector 100 is hanging from a user's belt, bag, purse, briefcase, backpack, belt buckle, belt loop, pant leg, pocket, shirt, jacket, armband or other suitable location accessible to a user.

In some embodiments, ridge 117 adds structural support to the bridge portion 105 to maintain a minimum curvature having a predetermined radius of the fifth surface 105*a* of the bridge portion 105 if the first base portion 101 is over the second base portion 103, the second base portion 103 is over the first base portion 101, or the bridge member 105 is over the first base portion 101 and the second base portion 103.

In some embodiments, the first base portion 101, second base portion 103, bridge portion 105, first backing member 109 and second backing member 113 are a monolithic structure forming the touch protector 100. In some embodiments, the first base portion 101, second base portion 103, bridge portion 105, first backing member 109 and second backing member 113 are a monolithic structure formed by a molding process such that the first base portion 101, second base portion 103, bridge portion 105, first backing member 109 and second backing member 113 are formed by a continuous material. In some embodiments, the first base portion 101, second base portion 103, bridge portion 105, first backing member 109 and second backing member 113 are a monolithic structure formed by a 3-D printing process such that the first base portion 101, second base portion 103, bridge portion 105, first backing member 109 and second backing member 113 are formed by a continuous material.

In some embodiments, the first base portion 101, second base portion 103, and bridge portion 105, are a monolithic structure and at least one of the first backing member 109 or the second backing member 113 is attached to the monolithic structure. In some embodiments, the first base portion 101, second base portion 103, and bridge portion 105 are a monolithic structure formed by a molding process such that the first base portion 101, second base portion 103, and bridge portion 105, are formed by a continuous material, and at least one of the first backing member 109 or the second backing member 113 is attached to the monolithic structure. In some embodiments, the first base portion 101, second base portion 103, and bridge portion 105 are a monolithic structure formed by a 3-D printing process such that the first base portion 101, second base portion 103, and bridge portion 105, are formed by a continuous material, and at least one of the first backing member 109 or the second backing member 113 is attached to the monolithic structure.

In some embodiments, the first base portion 101, second base portion 103, bridge portion 105, first backing member 109 and second backing member 113 are separate components that are attached to one another to form the touch protector 100. In some embodiments, at least two of the first base portion 101, second base portion 103, bridge portion 105, first backing member 109 and second backing member 113 a monolithic structure formed by a continuous material. In some embodiments, at least two of the first base portion 101, second base portion 103, bridge portion 105, first backing member 109 and second backing member 113 are joined together so as to be fixed to one another by way of an adhesive, fastener, stitching, one or more magnets, a hook and loop fastener, or other suitable joint.

In some embodiments, the first base portion 101, second base portion 103, bridge portion 105, first backing member 109 and second backing member 113 are separate components that are removably attached to one another to form the touch protector 100 and facilitate easy cleaning of each separate component. In some embodiments, first backing member 109 and second backing member 113 are removably attached to the first base portion 101 and the second base portion 103 to facilitate easy cleaning of each separable component.

Tether 107 is configured to be extendable such that an end of the tether 107 connected to or coupled with the first base portion 101, the second base portion 103 or the bridge portion 105 is movable between a minimum extension position and a maximum extension position. In some embodiments, tether 107 comprises one or more of a wind-up extendable and retractable cord, a reel and cord assembly, a coiled expandable and retractable cord, or an elastic material. In some embodiments, tether 107 comprises one or more of a cord, string, wire, rope, chain, or other suitable linkage. In some embodiments, touch protector 100 is free from including tether 107. In some embodiments, tether 107 is removably connected to or coupled with the first base portion 101, the second base portion 103, the bridge portion 105, first backing member 109 or second backing member 113 by way of a clip, loop, button, magnet, hook and loop fastener, or other suitable fastener. In some embodiments, one or more of bridge portion 105, first base portion 101, second base portion 103, backing member 109 or second backing member 113 includes one or more holes 119 that are configured to receive a clip, loop, button, magnet, hook and loop fastener, or other suitable fastener to affix the tether 107 or some other suitable attachable accessory to the touch protector 100. In some embodiments, tether 107 comprises a clip, loop, button or other suitable fastener on an end of tether 107 for fixing or attaching the tether 107 to an object such as a user's belt, bag, purse, briefcase, backpack, belt buckle, belt loop, pant leg, pocket, shirt, jacket, armband, or other suitable location accessible to a user.

In some embodiments, tether 107 is configured to apply a first force in a first direction with respect to a connection location or a coupling location with the first base portion 101, the second base portion 103, the bridge portion 105, the first backing member 109 or the second backing member 113 such that an extension of the tether 107 in a second direction opposite to the first direction caused by a second force exerted onto at least one of the first base portion 101, the second base portion 103, the bridge portion 105, the first backing member 109 or the second backing member 113 is prevented until a predetermined threshold is reached.

Tether 107 is configured to allow the end of the tether 107 connected to or coupled with the first base portion 101, the second base portion 103, the bridge portion 105, the first backing member 109 or the second backing member 113 to move away from the minimum extension position toward the maximum extension position if the second force is greater than the predetermined threshold. In some embodiments, the predetermined threshold is equal to or greater than an amount of force exerted on the first base portion 101, the second base portion 103, the bridge portion 105, the first backing member 109 or the second backing member 113 when an object such as a user's thumb or one or more fingers is inserted into at least one of the first space 111 or the second space 115, and the first base portion 101, the second base portion 103, the bridge portion 105, the first backing member 109 and the second backing member 113 are hung from the tether 107.

Hanging the touch protector 100 from a user's belt, bag, purse, briefcase, backpack, belt buckle, belt loop, pant leg, pocket, shirt, jacket, armband or other suitable location accessible to a user makes it possible to improve the readiness of the touch protector 100 for use while preventing inadvertent touching of the touch protector with an unprotected hand or item within a user's bag, for example, and avoiding fumbling to find the touch protector 100 when the user immediately needs to use the touch protector 100. In some embodiments, touch protector 100 has a magnet, clip, hook and loop fastener, or other suitable fastener, in addition to or in lieu of tether 107, configured to removably attach the touch protector 100 to a user's belt, bag, purse, briefcase, backpack, belt buckle, belt loop, pant leg, pocket, shirt, jacket, armband or other suitable location accessible to a user.

In a non-limiting example use case, in accordance with one or more embodiments, touch protector 100 is configured to be hung from a user's belt by way of tether 107. While hanging, and without the user having inserted any fingers or thumb into the first space 111 or the second space 115, the structure comprising the first body portion 101, second body portion 103, bridge portion 105, first backing member 109 and second backing member 113 is in a folded state in which the first surface 101*a* of the first body portion 101 is facing the third surface 103*a* of the second body portion 103, with the bridge portion 105 acting as a hinge such that the first body portion 101, second body portion 103, bridge portion 105 form a substantially U-shaped structure in a side view. In some embodiments, the first body portion 101, second body portion 103, bridge portion 105 are completely folded such that the U-shaped structure is more V-shaped or no space exists between the first body portion 101, second body portion 103, and/or bridge portion 105.

The first space 111 and the second space 115 are facing up and away from the ground such that the first collapsible pocket and the second collapsible pocket are ready to receive the user's finger(s) and/or thumb. In some embodiments, touch protector 100 is capable of receiving the user's finger(s) and/or thumb without requiring the user to use an unprotected hand to put on the touch protector 100. Then, after inserting the user's fingers(s) and/or thumb into the touch protector 100, the user is able to touch and/or grab a doorknob or object, for example, while avoiding direct skin contact with the doorknob or object. The user is then able to remove the finger(s) and/or thumb from the touch protector 100 and the allow the touch protector 100 to hang from the tether 107 so that the structure comprising the first body portion 101, second body portion 103, bridge portion 105, first backing member 109 and second backing member 113 returns to the folded state.

The structure comprising the first body portion 101, second body portion 103, bridge portion 105, first backing member 109 and second backing member 113 being in the folded state helps to reduce a profile and/or general bulkiness of the touch protector 100 so that the touch protector 100 is more convenient and easy to use and less noticeable or less awkward to have hanging from a user's belt, bag, purse, briefcase, backpack, belt buckle, belt loop, pant leg, pocket, shirt, jacket, armband or other suitable location accessible to a user. With or without the tether 107, touch protector 100 is a readily-accessible, easy to use, easy to clean and sanitize apparatus that is a regularly usable in a daily basis.

Figure 2:
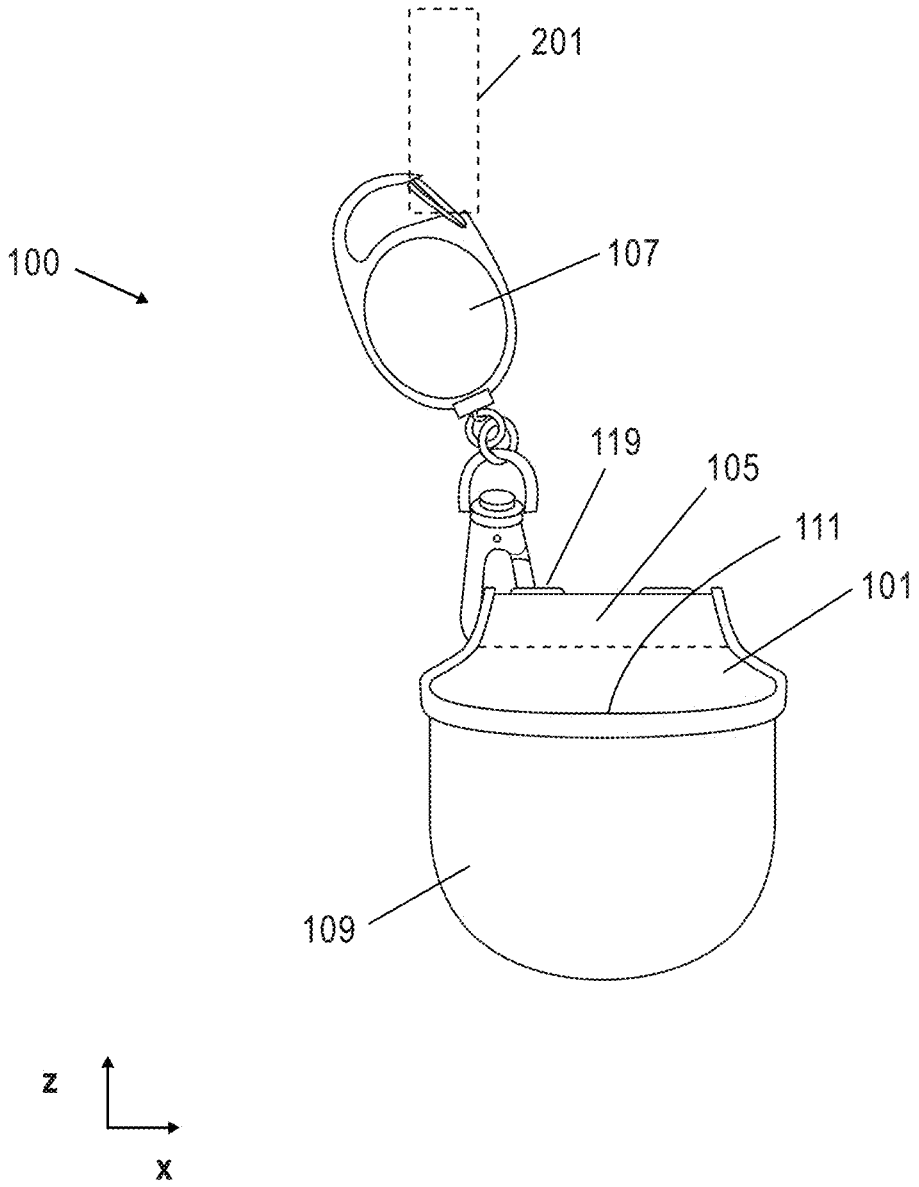
FIG. 2 is a side view of the touch protector in an at least partially closed position, in accordance with one or more embodiments.

FIG. 2 is a side view of touch protector 100 in an at least partially closed position, in accordance with one or more embodiments. Touch protector 100 is hanging from a fixed object 201, such as belt loop or other suitable object. The bridge portion 105 is over the first base portion 101 and the second base portion 103 such that the touch protector 100 is in the at least partially closed position with the first base portion 101 and the second base portion 103 (FIG. 1) hanging downward while the first space 111 and the second space 115 (FIG. 1) are in an at least partially open state. Tether 107 is attached to a different location on touch protector 100 as compared to FIG. 1. In the at least partially closed position, the first base portion 101 overlaps the second base portion 103. In some embodiments, an edge of the base portion 105 defining the hole 119 has ridge surrounding the hole 119. The ridge has a thickness greater than the base portion 105. In some embodiments, a hole 119 located elsewhere on the touch protector 100 is optionally defined by an edge of the first base portion 101, second base portion 103, first backing member 109 or second backing member 115 having a thickness greater than the corresponding first base portion 101, second base portion 103, first backing member 109 or second backing member 115.

Figure 3:
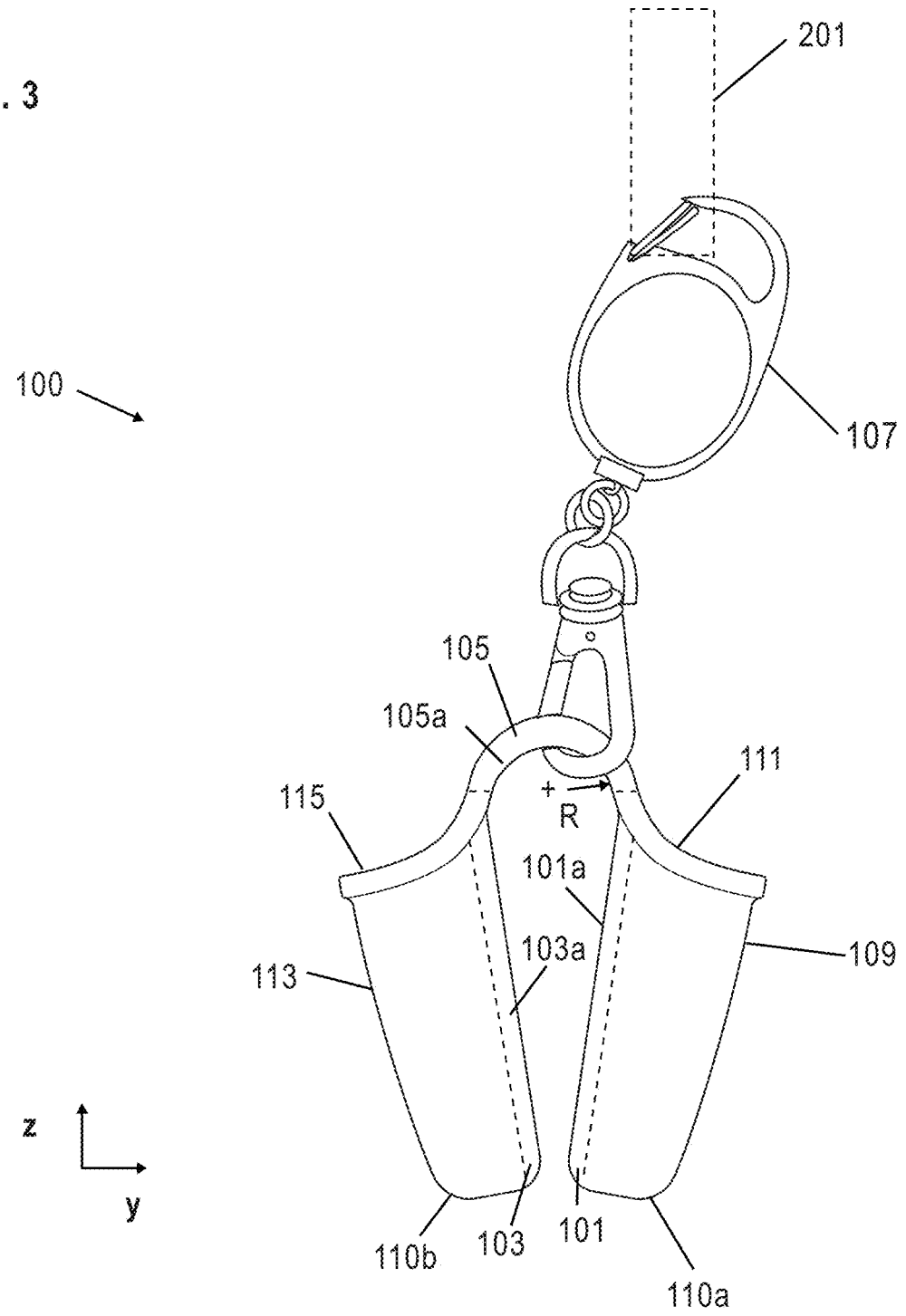
FIG. 3 is a side view of the touch protector in an at least partially closed position, in accordance with one or more embodiments.

FIG. 3 is a side view of touch protector 100 in an at least partially closed position, in accordance with one or more embodiments. Touch protector 100 is hanging from fixed object 201, such as belt loop or other suitable object. The bridge portion 105 is over the first base portion 101 and the second base portion 103 such that the touch protector 100 is in the at least partially closed position with the first base portion 101 and the second base portion 103 hanging downward while the first space 111 and the second space 115 are in an at least partially open state. Tether 107 is attached to a different location on touch protector 100 as compared to FIG. 1. In the at least partially closed position, the first base portion 101 overlaps the second base portion 103 such that the first base portion 101, the second base portion 103 and the bridge portion 105 form a substantially U-shaped structure.

Bridge portion 105 is curved such that the fifth surface 105*a* of the bridge portion 105 has a radius R about a center axis. In some embodiments, the thickness of the bridge portion 105 causes the fifth surface 105*a* of the bridge portion 105 to maintain the radius R in the at least partially closed position so that the first surface 101*a* of the first base portion 101 and the third surface 103*a* of the second base portion 103 adjoining the fifth surface 105*a* of base portion 105 face one another to form the substantial U-shape in the at least partially closed position. In some embodiments, the thickness of the bridge portion 105 causes the fifth surface 105*a* of the bridge portion 105 to maintain the radius R in the at least partially closed position and cause the first surface 101*a* of the first base portion 101 and the third surface 103*a* of the second base portion 103 adjoining the fifth surface 105*a* of base portion 105 to be angled with respect to one another. In some embodiments, the thickness of the bridge portion 105 causes the fifth surface 105*a* of the bridge portion 105 to maintain the radius R in the at least partially closed position so that the first base portion 101 is separated from the second base portion 103 so that the first base portion 101 is free from direct physical contact with the second base portion 103 while the touch protector 100 is hanging under its own weight.

In some embodiments, one or more of the material, thickness, and radius R of the bridge portion 105 causes the bridge portion 105 to have a spring-like effect that causes the first base portion 101, the second base portion 103 and the bridge portion 105 to maintain a separation between the first base portion 101 and the second base portion 103 unless the first base portion 101 and the second base portion are acted upon by an external force such as by a squeezing of the first base portion 101 and the second base portion 103 together.

The end 110*a* of the structure formed by the first base portion 101 and the first backing member 109 and the end 110*b* of the structure formed by the second base portion 103 and the second backing member 113 are squared off in a side view. In some embodiments, the squared off ends 110*a*, 110*b*, if the inside of the first space 111 and second space 113 have the same or a similar shape at the ends 110*a* and 110*b*, assist a user with inserting a thumb and/or one or more fingers into the first space 111 and the second space 113 while avoiding the first backing member 109 and/or the second backing member 112 from actively pushing a user's thumb and/or fingers out of the touch protector 100 despite the ends 110*a* and 110*b* being curved in a top-side view (e.g., FIG. 1) so as to better match a natural variation between a user's finger lengths. In some embodiments, the curvature in the top-side view, coupled with the squared off ends in the side view, allows for each inserted fingertip to contact an internal sidewall of the first space 111 or the second space 115 on at the end 110*a* or 110*b*.

Figure 4:
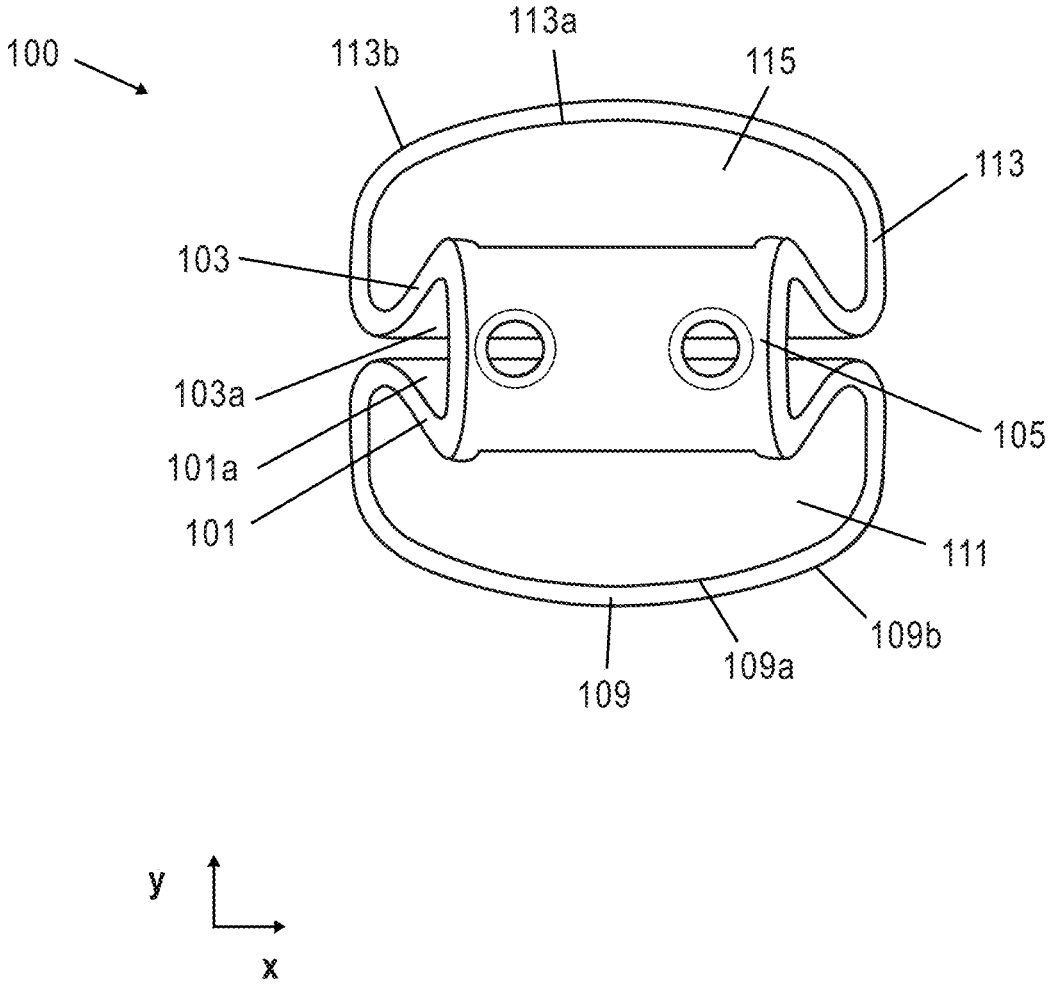
FIG. 4 is a top-side view of the touch protector in an at least partially closed position, in accordance with one or more embodiments.

FIG. 4 is a top-side view of the touch protector 100 in an at least partially closed position, in accordance with one or more embodiments. The bridge portion 105 is over the first base portion 101 and the second base portion 103 such that the touch protector 100 is in the at least partially closed position with the first surface 101*a* of the first base portion 101 facing the second surface 103*a* of the second base portion 103 while the first space 111 and the second space 115 are in an at least partially open state. Touch protector 100 in FIG. 4 is free from having optional tether 107 (FIG. 1) attached or coupled with the bridge portion 105. First backing member 109 has a seventh surface 109*a* on a first space 111 side of the first backing member 109 and an eighth surface 109*b* opposite the seventh surface 109*a*. Second backing member 113 has a ninth surface 113*a* on a second space 115 side of the second backing member 113 and tenth surface 113*b* opposite the ninth surface 113*a*. In some embodiments, the first backing member 109 and the second backing member 113 are crowned in the at least partially closed position such that the opening of each of the first space 111 and the second space 115 is maximized at a center of the width of each of the first base portion 101 and the second base portion 103 to facilitate easy finger or thumb insertion.

Figure 5:
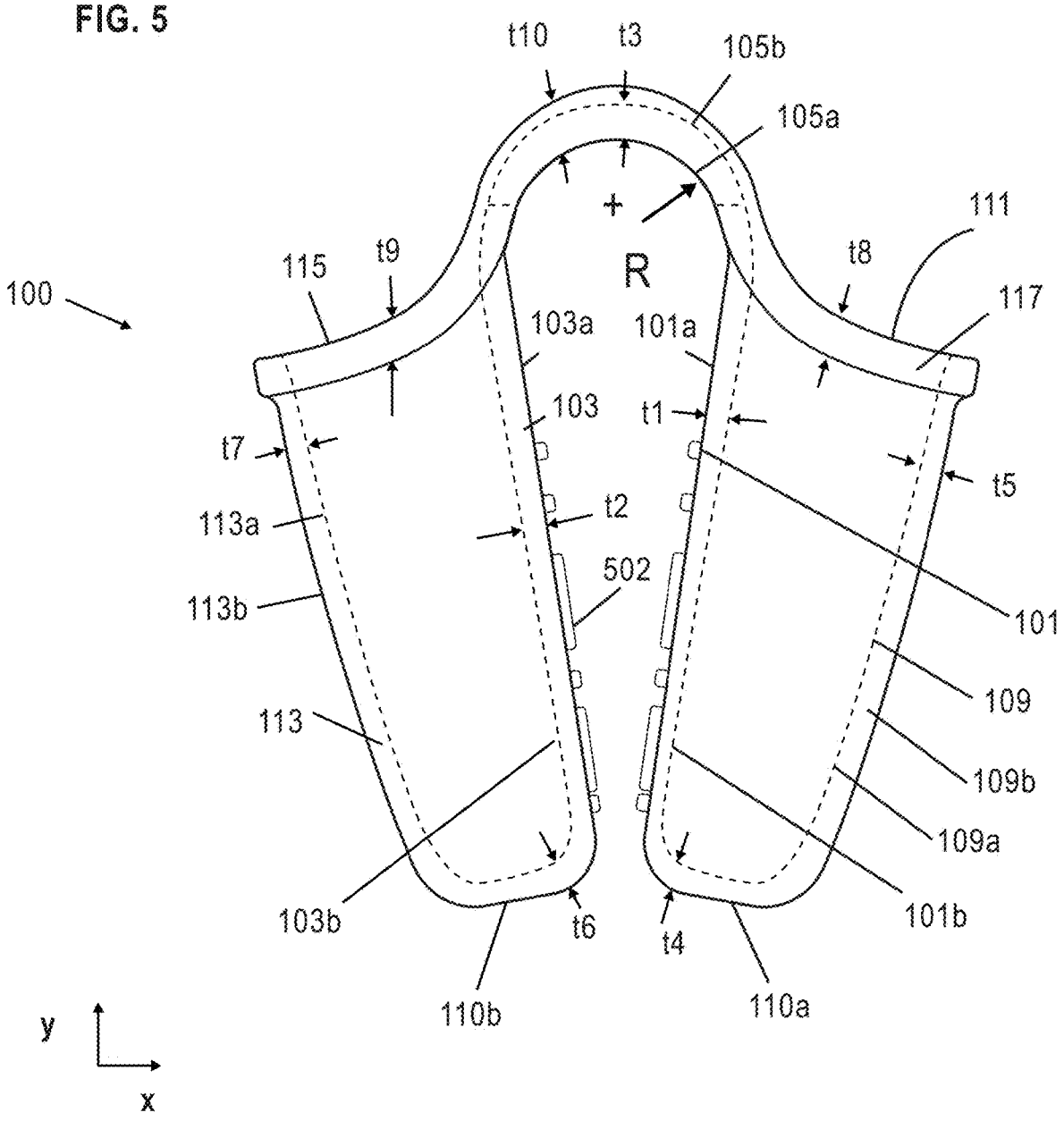
FIG. 5 is a side view of the touch protector in an at least partially closed position, in accordance with one or more embodiments.

FIG. 5 is a side view of the touch protector 100 in an at least partially closed position, in accordance with one or more embodiments. The bridge portion 105 is over the first base portion 101 and the second base portion 103 such that the touch protector 100 is in the at least partially closed position with the first base portion 101 and the second base portion 103 having surfaces facing each other while the first space 111 and the second space 115 are in an at least partially open state. In FIG. 5, touch protector 100 has texturing protrusions 502 extending from the first surface 101*a* of first base portion 101 and the third surface 103*a* of second base portion 103, and touch protector 100 is free from having optional tether 107 (FIG. 1) attached or coupled with the bridge portion 105.

First base portion 101 has a first thickness t1 between first surface 101*a* and second surface 101*b*. The second base portion 103 has a second thickness t2 between third surface 103*a* and fourth surface 103*b*. The bridge portion 105 has a third thickness t3 between fifth surface 105*a* and sixth surface 105*b*. The first backing member 109 has a fourth thickness t4 between seventh surface 109*a* and eight surface 109*b* in a region toward an end of the first base portion 101 opposite the bridge portion 105 where the first base portion 101 and the first backing member 109 meet. The first backing member 109 has a fifth thickness t5 between seventh surface 109*a* and eight surface 109*b* throughout a majority of the first backing member 109. The second backing member 113 has a sixth thickness t6 between the ninth surface 113*a* and the tenth surface 113*b* in a region toward an end of the second base portion 103 opposite the bridge portion 105 where the second base portion 103 and the second backing member 113 meet. The second backing member 113 has a seventh thickness t7 between the ninth surface 113*a* and the tenth surface 113*b* throughout a majority of the second backing member 113.

Ridge 117 has an eighth thickness t8 at an edge of the first backing member 101 defining an opening of the first space 111, ridge 117 has a ninth thickness t9 at an edge of the second backing member 113 defining an opening of the second space 115, and ridge 117 has a tenth thickness t10 along the sides of the bridge portion 105.

In some embodiments, thicknesses t1, t2, t3, t4, t5, t6, and t7 are equal to one another. In some embodiments, at least one of thicknesses t1, t2, t3, t4, t5, t6, and t7 is different from one or more other thicknesses t1, t2, t3, t4, t5, t6, and t7.

In some embodiments, the thicknesses t8, t9 and t10 of the ridge 117 are equal to one another. In some embodiments, at least one of the thicknesses t8, t9 or t10 is different from the other of the thicknesses t8, t9 or t10. In some embodiments, the thickness t10 of the ridge 117 is equal to thickness t3 of the bridge portion 105. In some embodiments, thickness t10 is greater than thickness t3 of the bridge portion 105.

In some embodiments, thicknesses t1, t3, t4 and t6 are equal, and thicknesses t5 and t7 are equal to one another and less than thicknesses t1, t2, t4 and t6, and one or more of thicknesses t3 or t10 is greater than at least thicknesses t1 and t2. In some embodiments, a touch protector that has one or more of thicknesses t3 or t10 that are greater than at least thicknesses t1 and t2, the thicker bridge portion 105 and/or ridge 117 on the sides of the bridge portion 105 causes the predetermined radius R of the fifth surface 105*a* of the bridge portion 105 to be maintained when the touch protector is in the at least partially closed position. In some embodiments, a touch protector that has one or more of thicknesses t1, t2, t4 and t6 are at least two times the thicknesses t5 and t7 has improved durability in the base portions and has a harder end or tip as compared to the areas of first and second backing members 109 and 113 in the t5 and t7 thickness regions.

In some embodiments, thicknesses t1, t2, t4 and t6 are at least two times the thicknesses t5 and t7 and at least one of thicknesses t3 or t10 is at least three times the thicknesses t5 and t7. For example, in some embodiments, if the thicknesses t5 and t7 are 1 mm, thicknesses t1, t2, t4 and t6 are at least 2 mm, and at least one of thicknesses t3 or t10 is at least 3 mm. In some embodiments, thicknesses t8 and t9 of the ridge 117 are greater than one or more of thicknesses t1, t2, t4, t5, t6 and t7, but less than at least one of t3 or t10. In some embodiments, thicknesses t8 and t9 of the ridge 117 are equal to one or more of thicknesses t1, t2, t4 and t6, and greater than thicknesses t5 and t7, but less than at least one of t3 or t10.

In some embodiments, thicknesses t1-t10 have other suitable values or proportional relationships that result in the first base portion 101 contacting the second base portion 103 when the touch protector is in the at least partially closed position, cause first space 111 and second space 115 to be in an open state when the touch protector is in the at least partially closed position, or for supporting some other suitable capability.

In some embodiments, the interior transitions between the first base portion 101 and the first backing member 109, and between the second base portion 103 and the second backing member 113, within the first space 111 and the second space 115 are curved. In some embodiments, the curved transitions between the first base portion 101 and the first backing member 109, and between the second base portion 103 and the second backing member 113 promote efficient and effective cleaning of the touch protector 100 and user comfort. In some embodiments, the curved interior transition at end 110*a* gradually thickens from the fifth thickness t5 to the fourth thickness t4 when the fourth thickness t4 is greater than the fifth thickness t5 as the first backing member 109 approaches the first base portion 101. In some embodiments, the curved interior transition at end 110*b* gradually thickens from the seventh thickness t7 to the sixth thickness t6 when the sixth thickness t6 is greater than the seventh thickness t7 as the second backing member 113 approaches the second base portion 103.

Figure 6:
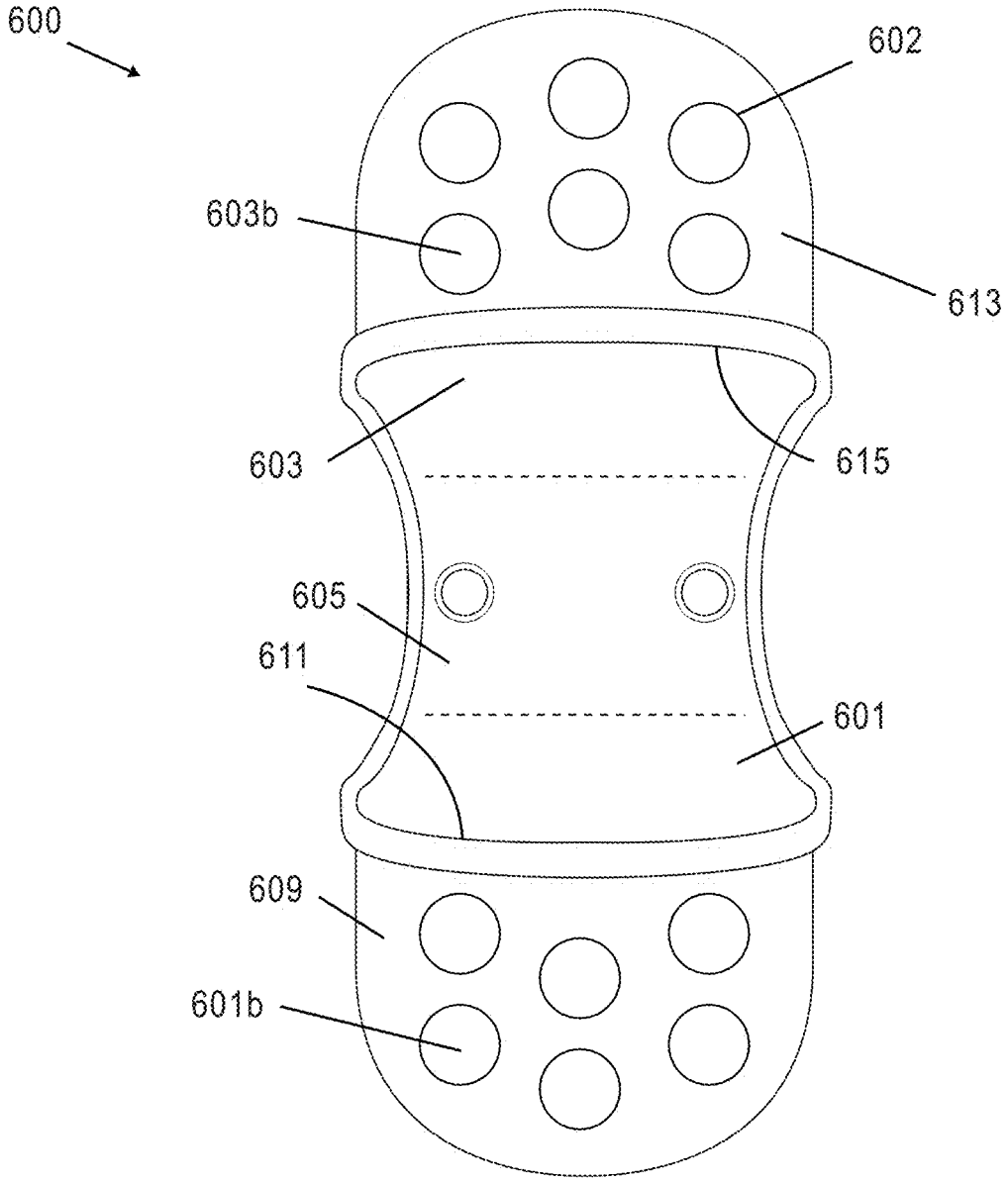
FIG. 6 is a top-side view of a touch protector in an open position, in accordance with one or more embodiments.

FIG. 6 is a top-side view of a touch protector 600 in an open position, in accordance with one or more embodiments. Touch protector 600 is similar to touch protector 100 (FIG. 1), with the reference numeral increased by 500. Touch protector 600 has a first backing member 609 and a second backing member 613 have a plurality of through holes 602 through which the second surface 601*b* of the first base portion 601 and the fourth surface 603*b* of the second base portion 603 are viewable. In some embodiments, through holes 602 enhance airflow into and out of the first space 611 and the second space 615.

In some embodiments, touch protector 600 includes one or more plugs or buttons, for example, that are configured to be placed in through holes 602. In some embodiments, plugs or buttons are used to close one or more of the through holes 602 with a selectively removable object. In some embodiments, the plugs or buttons are optionally removed to assist in cleaning the touch protector 600. In some embodiments, one or more plugs or buttons inserted in one or more through holes 602 comprise one or more fashion items, identifiers, sanitary/cleanliness status symbols or indicators, jewels, toy parts, or other suitable object that is capable of being attached to the first backing member 109 or the second backing member 113 by way of one or more through holes 602.

Figure 7:
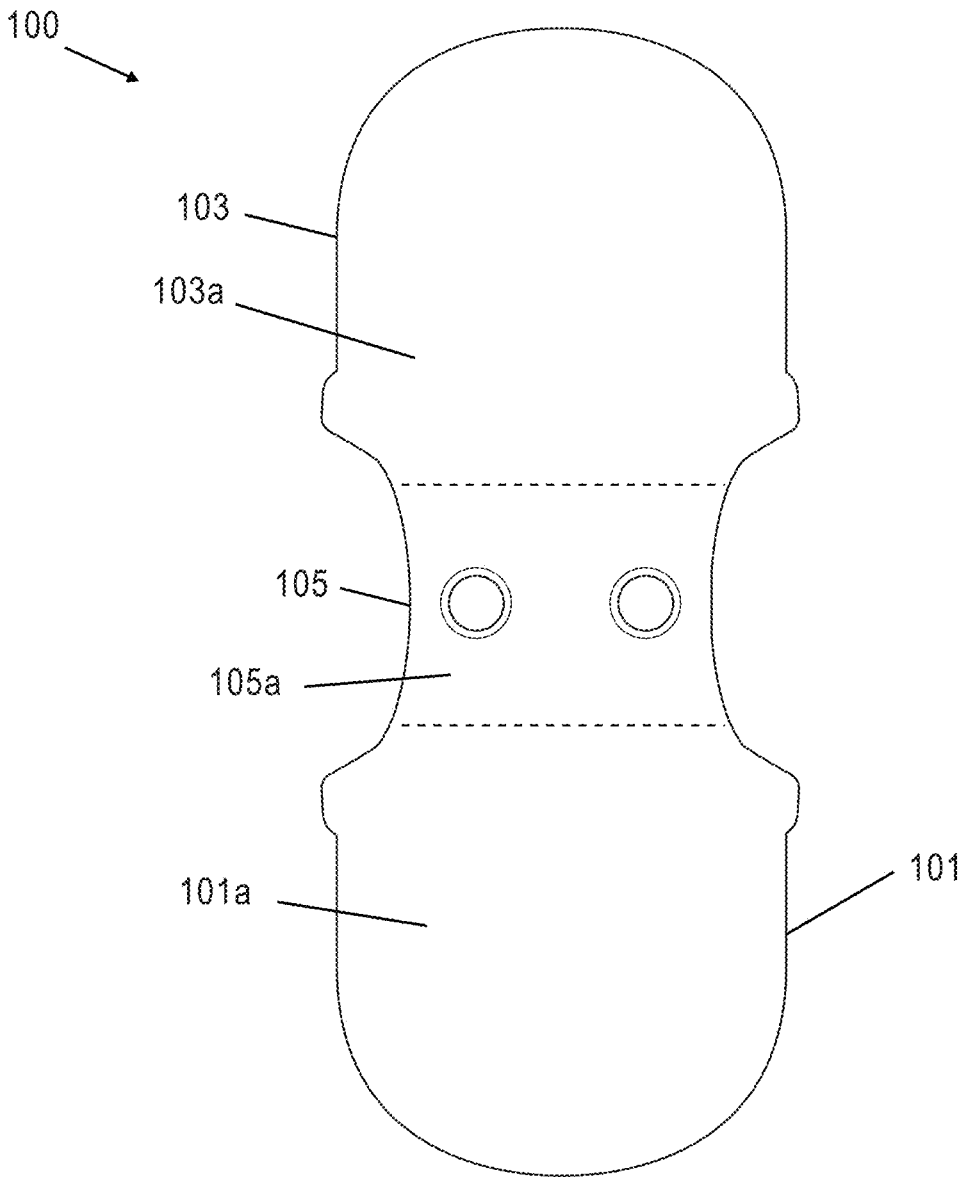
FIG. 7 is a bottom-side view of a touch protector in an open position, in accordance with one or more embodiments.

FIG. 7 is a bottom-side view of touch protector 100 in an open position, in accordance with one or more embodiments. The first surface 101*a* of the first base portion 101, the third surface 103*a* of the second base portion 103 and the fifth surface 105*a* of the bridge portion 105 are free from having textured features.

Figure 8:
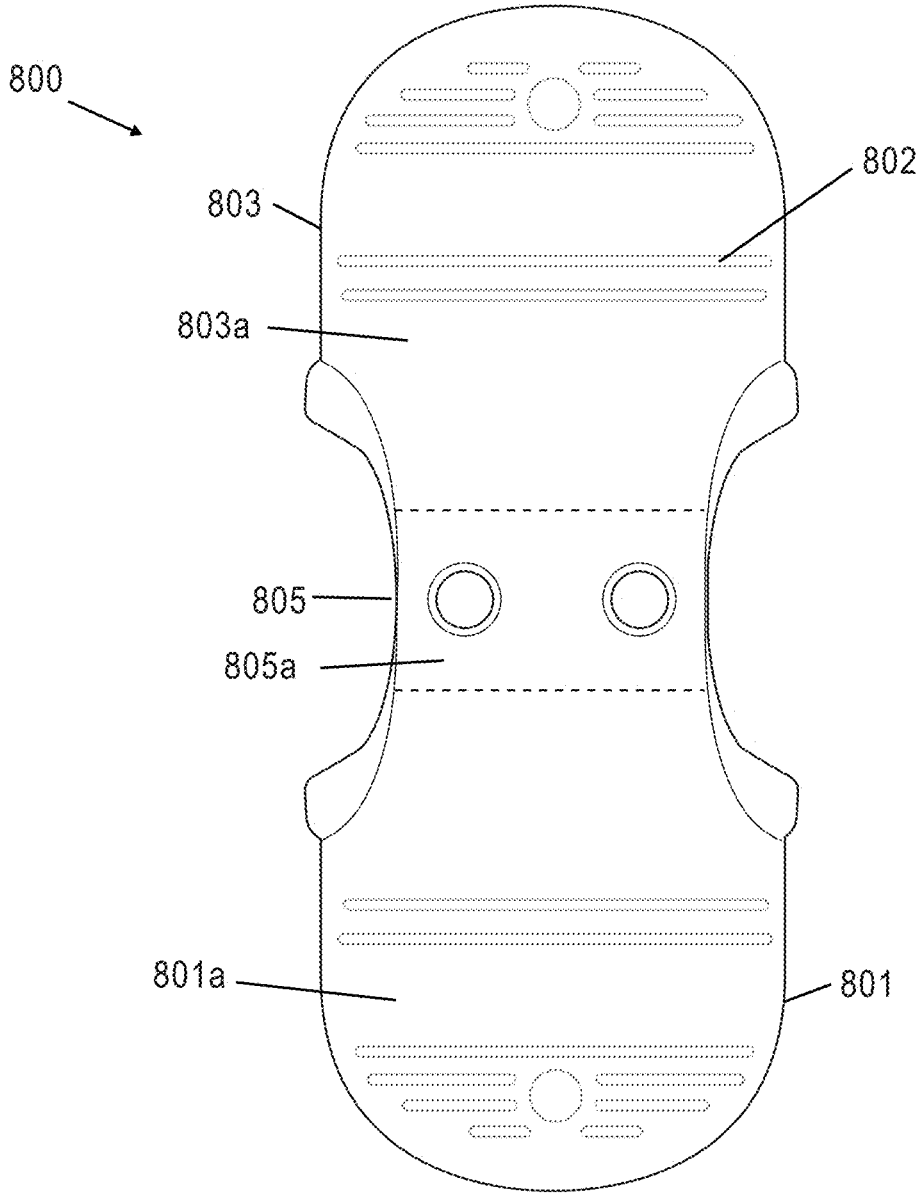
FIG. 8 is a bottom-side view of a touch protector in an open position, in accordance with one or more embodiments.

FIG. 8 is a bottom-side view of a touch protector 800 in an open position, in accordance with one or more embodiments. Touch protector 800 is similar to touch protector 100 (FIG. 1), with the reference numerals increased by 700. The first base portion 801 and the second base portion 803 have texturing projections 802 extending away from the first surface 801*a* of the first base portion 801 and the third surface 803*a* of the second base portion 803. The fifth surface 805*a* of bridge portion 805 is free from having texturing projections 802. In some embodiments, the fifth surface 805*a* of the bridge portion 805 has texturing projections. In some embodiments, one or more of the first surface 801*a* of the first base portion 801, the third surface 803*a* of the second base portion 803 or the fifth surface 805*a* of the bridge portion 805 is textured by having a series of indentations or trenches in addition to or in lieu of the texturing projections 802.

Texturing projections 802 are substantially linear. In some embodiments, texturing projections 802 are one or more of curved, circular, pyramidal, cubic, hemispherical, cylindrical, comprise lettering, or have some other suitable shape.

Figure 9:
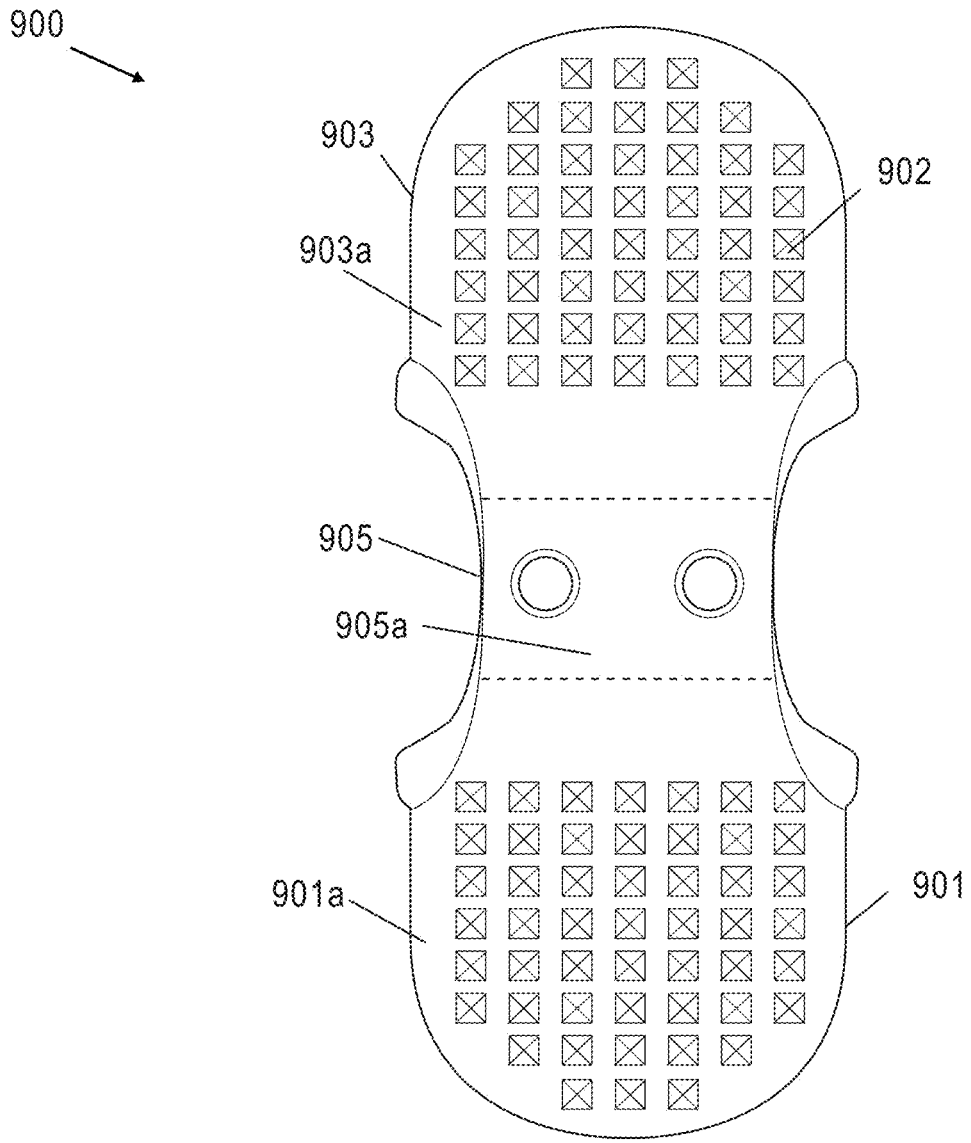
FIG. 9 is a bottom-side view of the touch protector in an open position, in accordance with one or more embodiments.

FIG. 9 is a bottom-side view of a touch protector 900 in an open position, in accordance with one or more embodiments. Touch protector 900 is similar to touch protector 800 (FIG. 8), with the reference numerals increased by 100. The first base portion 901 and the second base portion 903 have pyramidal texturing projections 902 extending away from the first surface 901*a* of the first base portion 901 and the third surface 903*a* of the second base portion 903. The fifth surface 905*a* of bridge portion 905 is free from having texturing projections 902.

Figure 10:
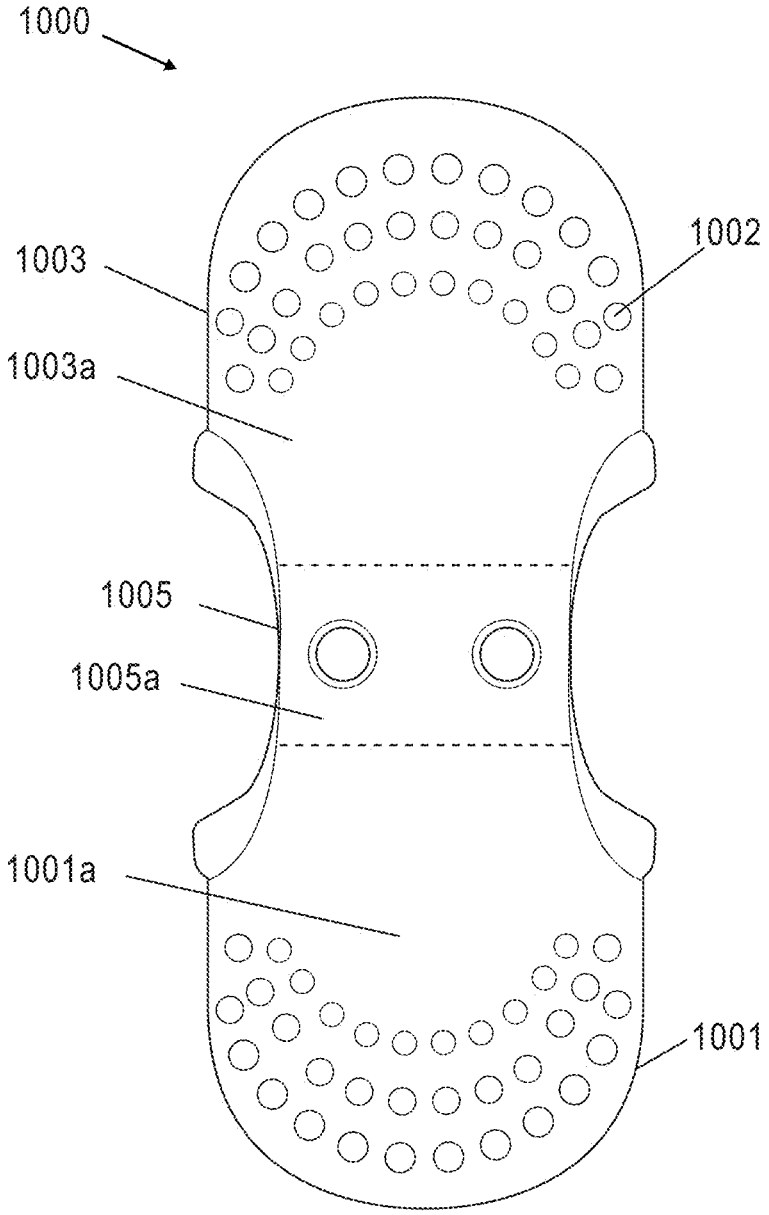
FIG. 10 is a bottom-side view of the touch protector in an open position, in accordance with one or more embodiments.

FIG. 10 is a bottom-side view of a touch protector 1000 in an open position, in accordance with one or more embodiments. Touch protector 1000 is similar to touch protector 800 (FIG. 8), with the reference numerals increased by 200. The first base portion 1001 and the second base portion 1003 have hemispherical texturing projections 1002 extending away from the first surface 1001*a* of the first base portion 1001 and the third surface 1003*a* of the second base portion 1003. The fifth surface 1005*a* of bridge portion 1005 is free from having texturing projections 1002. The hemispherical texturing projections 1002 are arranged in a series of arcs on each of the first base portion 1001 and the second base portion 1003, wherein each arc on a same base portion has hemispherical texturing projections 1002 that differ in diameter compared to the hemispherical texturing projections 1002 in a different arc.

Figure 11:
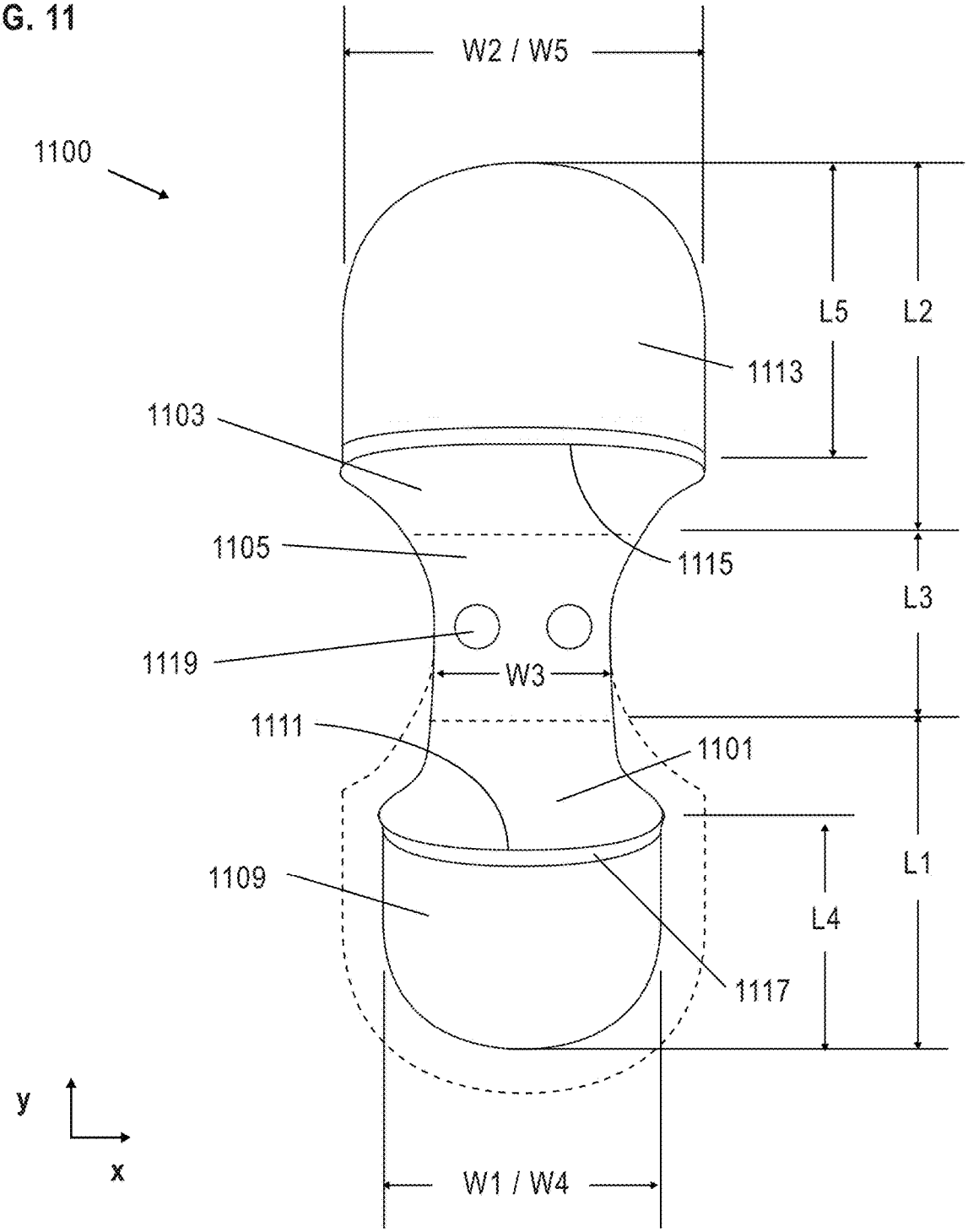
FIG. 11 is a top-side view of a touch protector in an open position, in accordance with one or more embodiments.

FIG. 11 is a top-side view of a touch protector 1100 in an open position, in accordance with one or more embodiments. Touch protector 1100 is similar to touch protector 100 (FIG. 1), with the reference numeral increased by 1000. Touch protector 1100 is configured to accommodate a user's thumb in the first space 1111 and two or more fingers in the second space 1115. In some embodiments, touch protector 1100 is configured to accommodate a user's index finger, middle finger or ring finger, or example, in the first space 1111 and a user's thumb in the second space 1113. Touch protector 1100 has a first base portion 1101 and a first backing member 1113 that have corresponding lengths L1/L4 and widths W1/W4 that are less than the lengths L2/L5 and widths W2/W5 of the second base portion 1103 and second backing member 1113. In some embodiments, touch protector 1100 has a first base portion 1101 and a first backing member 1113 that have corresponding lengths L1/L4 and widths W1/W4 that are less than the lengths L2/L5 and widths W2/W5 of the second base portion 1103 and second backing member 1113 such that the edge of the first backing member 1109 and/or ridge 1117 are configured to align with one of a user's thumb joints.

In some embodiments, touch protector 1100 has a first base portion 1101 and a first backing member 1113 that have external lengths and widths that are identical to the second base portion 1103 and the second backing member 1113, and internally has a first space 1111 defined by the second surface 1101*b* and the eighth surface 1109*a* having corresponding lengths L1/L4 and widths W1/W4 that are less than the lengths L2/L5 and widths W2/W5 of the second base portion 1103 and second backing member 1113.

In some embodiments, touch protector 1100 has a first base portion 1101 and a first backing member 1113 that have external lengths and widths that are identical to the second base portion 1103 and the second backing member 1113, and internally has a first space 1111 defined by the second surface 1101*b* and the eighth surface 1109*a* having corresponding lengths L1/L4 and widths W1/W4 that are less than the lengths L2/L5 and widths W2/W5 of the second base portion 1103 and second backing member 1113 such that the interior of the first space 1111 is configured to snuggly accommodate a user's thumb, while the exterior lengths and widths of the first base portion 1101 and the first backing member 1109 are less than or equal to the lengths L2/L5 and widths W2/W5 of the second base portion 1103 and second backing member 1113.

In some embodiments, if the interior of the first space 1111 is configured to snuggly accommodate a user's thumb, while the exterior lengths and widths of the first base portion 1101 and the first backing member 1109 are less than or equal to the lengths L2/L5 and widths W2/W5 of the second base portion 1103 and second backing member 1113, an interior sidewall of the first base portion 1101 and/or the first backing member 1109 is separated from an exterior of the first base portion 1101 and/or first backing member 1109 by a distance greater than a thickness of a majority of the first backing member 1103. In some embodiments, the separation is filled with extra material, a solid filler of extra material, one or more ribs, one or more additional sidewalls internal to the first backing member 1109, or some other suitable structure to fill a void within the structure formed by first base portion 1101 and first backing member 1109 to facilitate a snug fitting of a user's thumb within first space 1111.

Figure 12:
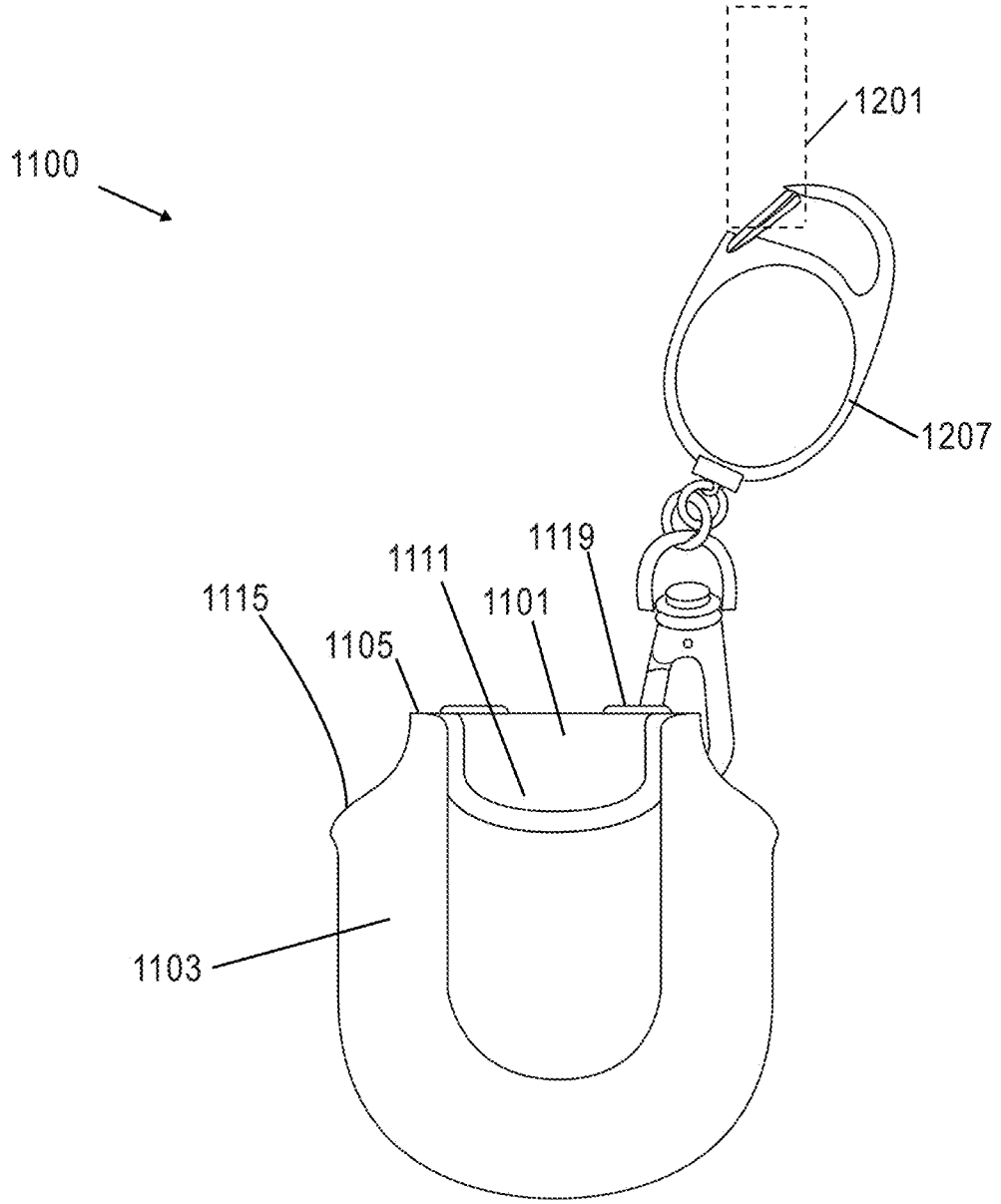
FIG. 12 is a side view of the touch protector in an at least partially closed position, in accordance with one or more embodiments.

FIG. 12 is a side view of touch protector 1100 in an at least partially close position, in accordance with one or more embodiments. Touch protector 1100 is hanging from an object 1201 by way of a tether 1207 such that the bridge portion 1105 is over the first base portion 1101 and the second base portion 1103. The first base portion 1101 is overlapping the second base portion 1103, and the first space 1111 and the second space 1115 are in an open state.

Figure 13:
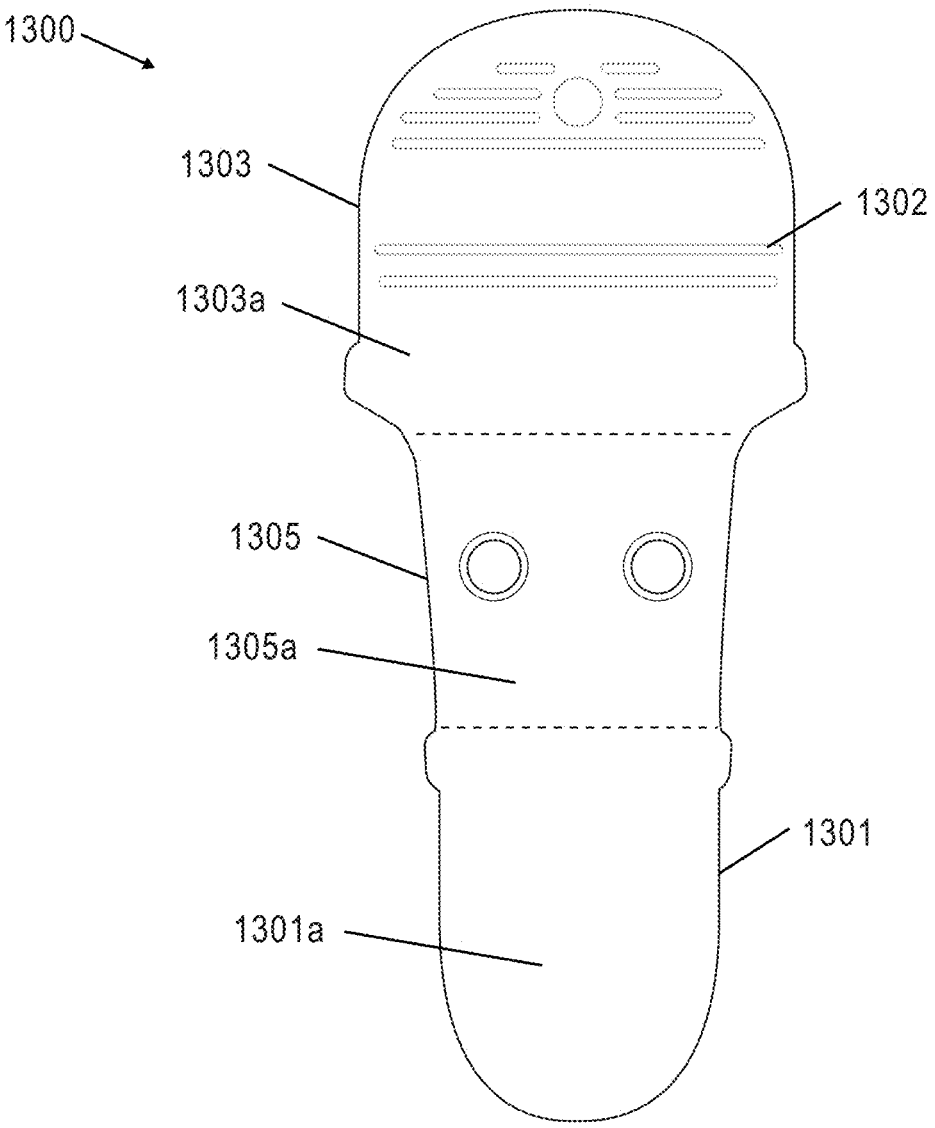
FIG. 13 is a bottom-side view of a touch protector in an open position, in accordance with one or more embodiments.

FIG. 13 is a bottom-side view of a touch protector 1300 in an open position, in accordance with one or more embodiments. Touch protector 1300 is similar to touch protector 1100 (FIG. 11), with the reference numerals increased by 200. The first surface 1301*a* of the first base portion 1301 and the fifth surface 1305*a* of the bridge portion 1305 are free from having textured features. The second base portion 1303 has texturing projections 1302 extending away from the third surface 1303*a* of the second base portion 1303.

In some embodiments, one or more of the first surface 1301*a* of the first base portion 1301 or the fifth surface 1305*a* of the bridge portion 1305 has texturing projections. In some embodiments, one or more of the first surface 1301*a* of the first base portion 1301, the third surface 1303*a* of the second base portion 1303 or the fifth surface 1305*a* of the bridge portion 1305 is textured by having a series of indentations or trenches in addition to or in lieu of the texturing projections 1302. In some embodiments, all of the first surface 1301*a*, third surface 1303*a* and fifth surface 1303*a* is free from having texturing projections 1302.

Texturing projections 1302 are similar to texturing projections 802 (FIG. 8) with the reference numerals increased by 500. For example, texturing projections are substantially linear. In some embodiments, texturing projections 1302 are one or more of curved, circular, pyramidal, cubic, hemispherical, cylindrical, lettered text, or have some other suitable shape.

Figure 14:
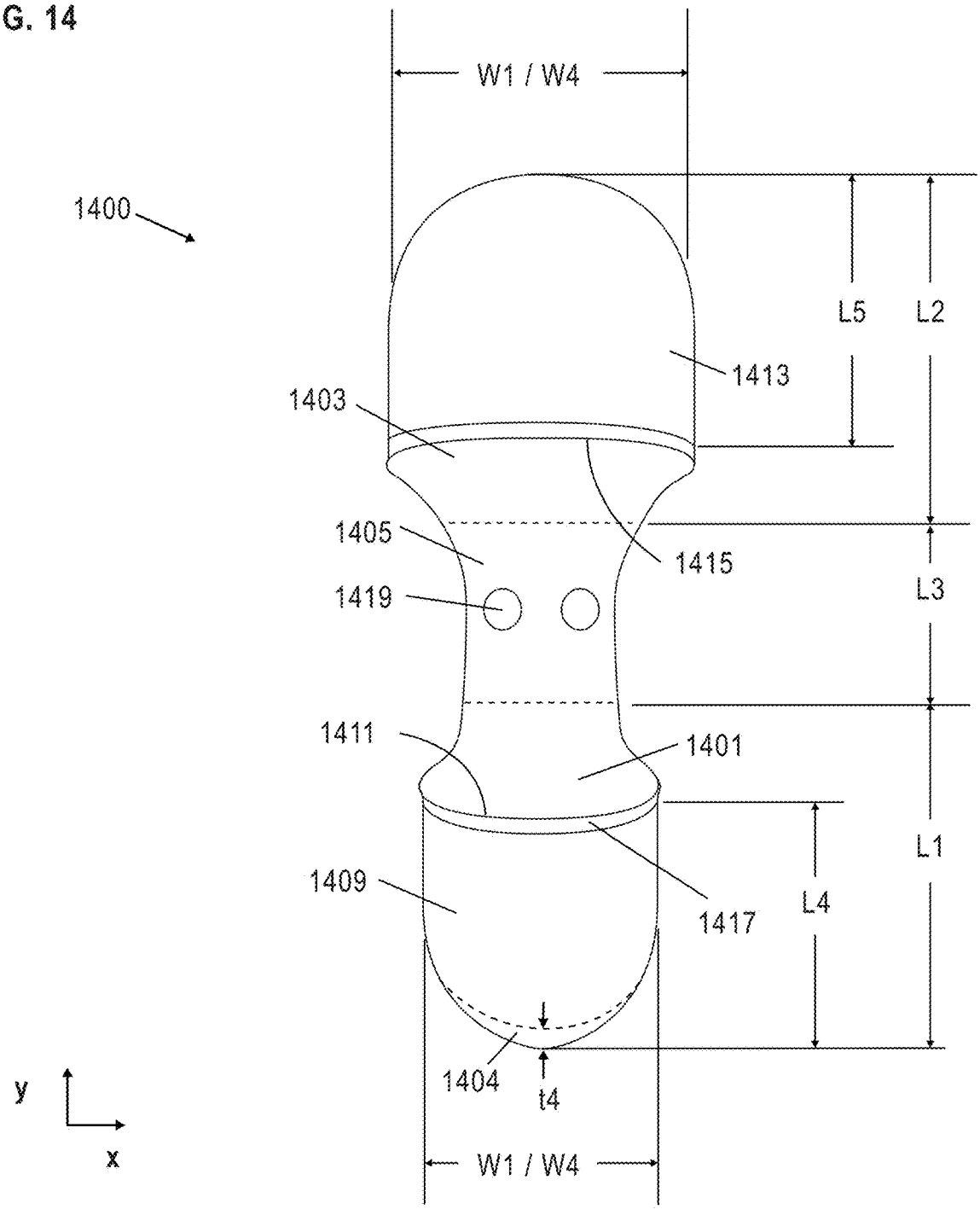
FIG. 14 is a top-side view of a touch protector in an open position, in accordance with one or more embodiments.

FIG. 14 is a top-side view of a touch protector 1400 in an open position, in accordance with one or more embodiments. Touch protector 1400 is similar to touch protector 1100 (FIG. 11), with the reference numeral increased by 300. Touch protector 1400 has a first base portion 1401 and a first backing member 1413 that have corresponding lengths L1/L4 and widths W1/W4 that are less than the lengths L2/L5 and widths W2/W5 of the second base portion 1403 and second backing member 1413.

A structure formed by the first base portion 1401 and the first backing member 1409 has a pointed end 1410*a* as compared to a structure formed by the first base portion 1101 (FIG. 11) and first backing member 1109 (FIG. 11). In some embodiments, an interior of the structure formed by the first base portion 1401 and the first backing member 1409 has a curved surface like that of a backing member that has a uniform thickness and a curved exterior surface in the end region and a distance between the curved interior surface and the pointed end 1410*a* is filled with extra material to cause the first backing member 1409 to be thicker in the pointed end 1410*a* as compared to one or more other areas of the first backing member. For example, the first backing member 1401 optionally has a thickness t14 in pointed end 1410*a* that is greater than the thickness t5 (FIG. 5) of the majority of the first backing member 1401. In some embodiments, the thicker pointed end 1410*a* increases a rigidity of the structure formed by the first base portion 1401 and the first backing member 1413 and preciseness with which a user is able to press against a button, for example, with the user's thumb or finger within the first space 1411.

Figure 15:
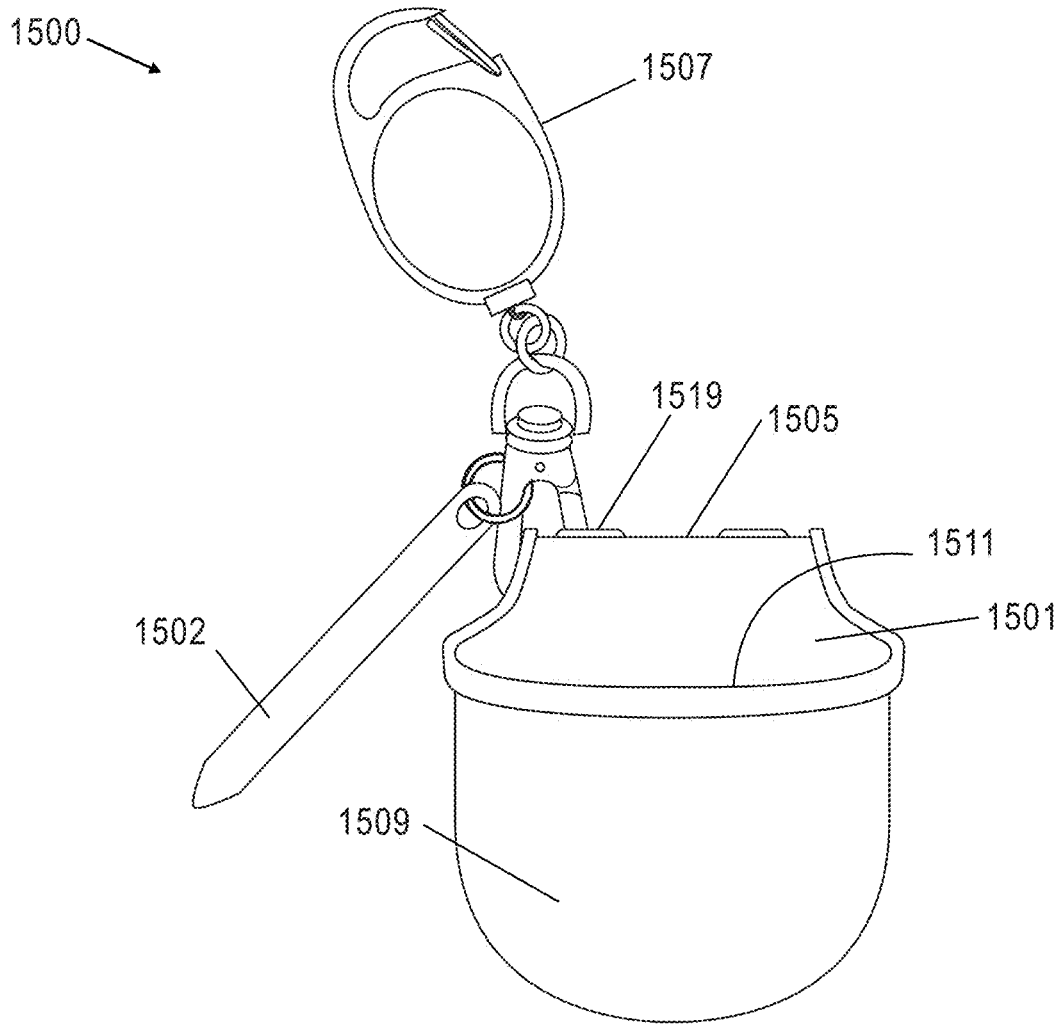
FIG. 15 is a side view of a touch protector in an at least partially closed position, in accordance with one or more embodiments.

FIG. 15 is a side view of touch protector 1500, in accordance with one or more embodiments. Touch protector 1500 is similar to touch protector 100 (FIG. 1) with the reference numerals increased by 1400. Touch protector 1500 includes tether 1507 and a stylus 1502 coupled with tether 1507. Tether 1507 is coupled with bridge portion 1505 by way of hole 1519. Stylus 1502 is a utensil that is able to be grabbed by a user, while wearing the touch protector 1500 to enable a user to interact with a touch pad, touch screen, or button, for example, without physically touching the touch pad, touch screen or button with the user's own skin. In some embodiments, stylus 1502 is coupled with the first base portion 1501, the second base portion 1503 (e.g, first base portion 101, FIG. 1), the bridge portion 1505, the first backing member 1509 or the second backing member 1513 (e.g., second backing member 113, FIG. 1). In some embodiments, stylus 1502 comprises one or more of a polymer, a metal material, wood, glass, ceramic, some other suitable material, or combination thereof. In some embodiments, stylus 1502 comprises a shaft and a tip that each comprise at least one different material.

In some embodiments, the stylus 1502 is removably attached to tether 1507 so that a longer or shorter stylus 1502 can be included in touch protector 1500. In some embodiments, stylus 1502 is a telescoping stylus. In some embodiments, stylus 1502 is configured to be made longer or shorter by way of a sliding mechanism that causes the stylus 1502 to expand or contract. In some embodiments, stylus 1502 is configured to be made longer or shorter by way of a clicking/spring/detent mechanism that causes the stylus 1502 to expand or contract. In some embodiments, stylus 1502 is modular such that additional portions of the stylus 1502 may be added to the stylus 1502 to make stylus 1502 longer and portions of the stylus 1502 may be removed from the stylus 1502 to make the stylus 1502 shorter. In some embodiments, stylus 1502 is configured to be made longer or shorter by way of some other suitable manner that causes the stylus 1502 to expand or contract.

Figure 16:
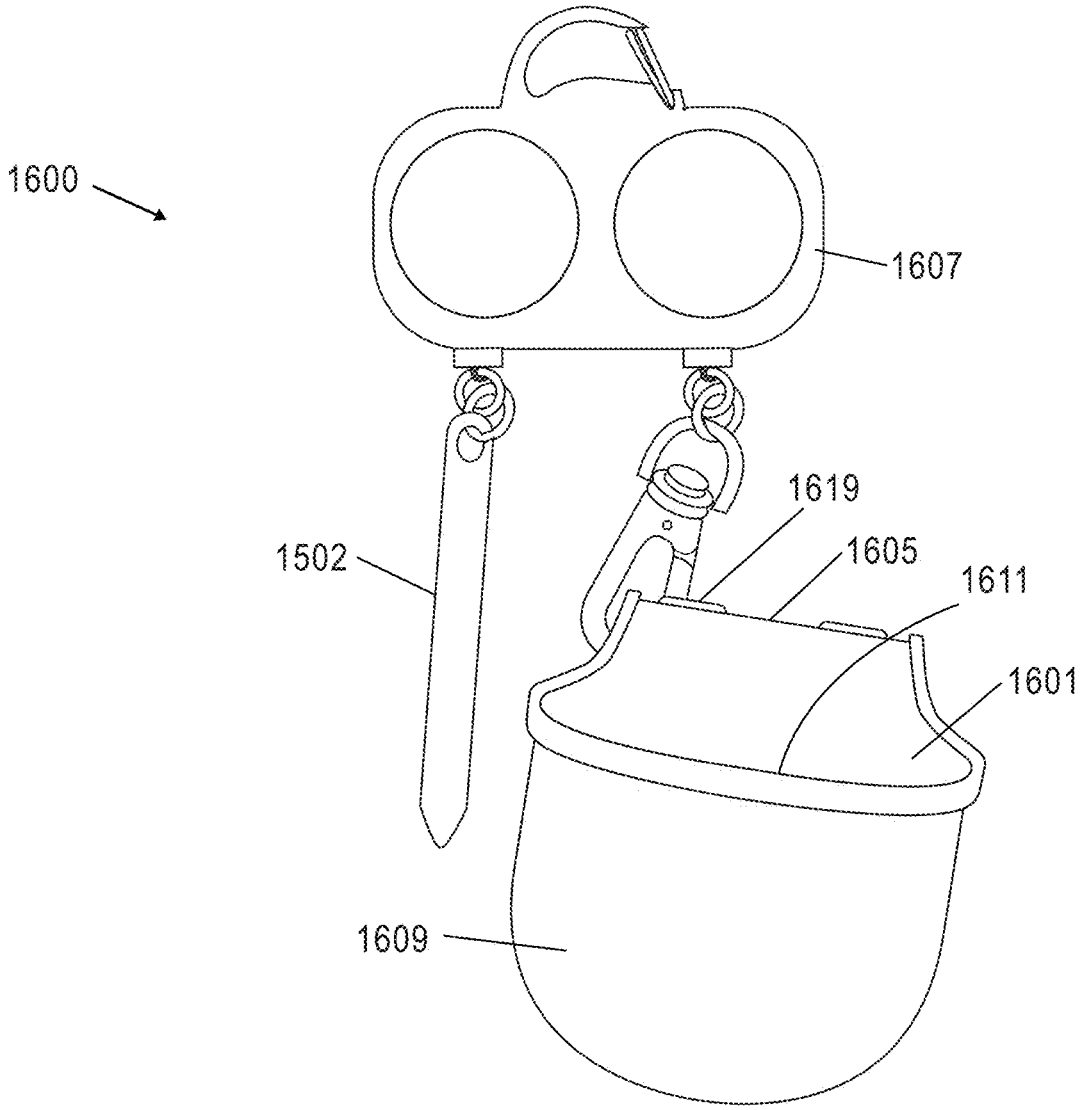
FIG. 16 is a side view of a touch protector in an at least partially closed position, in accordance with one or more embodiments.

FIG. 16 is a side view of touch protector 1600, in accordance with one or more embodiments. Touch protector 1600 is similar to touch protector 100 (FIG. 1) with the reference numerals increased by 1500. Touch protector 1600 includes tether 1607 and a stylus 1502 coupled with tether 1607. Tether 1607 is similar to tether 107 (FIG. 1), but comprises a dual retractor that makes it possible to extend and retract both of the mitt-like portion of the touch protector 1600 and the stylus 1502 individually so that the stylus 1502 is readily accessible and easily grasped by a user wearing touch protector 1600. Tether 1607 is coupled with bridge portion 1605 by way of hole 1619. The dual retractors of tether 1607 include reels that are arranged side-by-side. In some embodiments, the dual retractors of tether 1607 include reels that are overlapping such that an axis of rotation about which each of the reels included in the dual retractor are linearly aligned. In some embodiments, the dual retractors of tether 1607 include reels that are overlapping such that an axis of rotation about which each of the reels included in the dual retractor tether 1607 are offset. In some embodiments, each reel included in the dual retractor tether 1607 winds in a clockwise direction. In some embodiments, each reel included in the dual retractor tether 1607 winds in a counter-clockwise direction. In some embodiments, one reel included in the dual retractor 1607 winds in a clockwise direction and the other reel included in the dual retractor 1607 winds in a counter-clockwise direction.

In some embodiments, dual retractor tether 1607 is configured to cause stylus 1502 to hang at a position with respect to the structure formed by at least first base portion 1601, second base portion 1603 and bridge portion 1605 such that the stylus 1502 can be easily grabbed by a user manipulating the structure formed by at least first base portion 1601, second base portion 1603 and bridge portion 1605. In some embodiments, dual retractor tether 1607 is configured to cause stylus 1502 to hang at a position with respect to the structure formed by at least first base portion 1601, second base portion 1603 and bridge portion 1605 such that the stylus 1502 is prevented from entering the first space 1611 and/or the second space 1615. For example, if a user expects the first space 1611 and/or the second space 1615 to be untainted from any touching of a potentially contaminated surface, and the tip of the stylus 1502 is used to contact a potentially contaminated touch screen, the tip of the stylus 1502 is prevented from entering the first space 1611 and/or the second space 1615 so that any contaminants that could have been transferred to the stylus during use prevented from being inadvertently transferred to the interior surfaces that define first space 1611 and/or 1615.

In some embodiments, the reel of the dual retractor tether 1607 is configured to wind a cord to which the stylus 1502 is attached such that a portion of the cord to which the stylus 1502 is attached exposed from the retractor reel housing is greater than a portion of a cord to which the structure formed by at least first base portion 1601, second base portion 1603 and bridge portion 1605 is attached. In some embodiments, the reel of the dual retractor tether 1607 is configured to wind a cord to which the stylus 1502 is attached such that a portion of the cord to which the stylus 1502 is attached exposed from the retractor reel housing is equal to a portion of a cord to which the structure formed by at least first base portion 1601, second base portion 1603 and bridge portion 1605 is attached.

In some embodiments, a linkage by which the stylus 1502 is attached to the dual retractor tether 1607 has a length that is greater than a linkage by which the structure formed by at least first base portion 1601, second base portion 1603 and bridge portion 1605 is attached to the dual retractor tether 1607 to cause the stylus 1502 to hang at a position stylus with respect to the structure formed by at least first base portion 1601, second base portion 1603 and bridge portion 1605 such that the stylus 1502 can be easily grabbed by a user manipulating the structure formed by at least first base portion 1601, second base portion 1603 and bridge portion 1605, and/or to prevent the stylus 1502 from entering the first space 1611 and/or the second space 1615.

In some embodiments, stylus 1502 has a length that is less than the structure formed by at least first base portion 1601, second base portion 1603 and bridge portion 1605 in the at least partially closed position. In some embodiments, stylus 1502 has a length that is equal to the structure formed by at least first base portion 1601, second base portion 1603 and bridge portion 1605 in the at least partially closed position. In some embodiments, stylus 1502 has a length that is greater than the structure formed by at least first base portion 1601, second base portion 1603 and bridge portion 1605 in the at least partially closed position.

In some embodiments, the length of the stylus 1502 in combination with one or more of the length of cord exposed by the reel of the dual retractor tether 1607 or the length of the linkage by which the stylus is attached cause the stylus 1502 to hang at a position stylus with respect to the structure formed by at least first base portion 1601, second base portion 1603 and bridge portion 1605 such that the stylus 1502 can be easily grabbed by a user manipulating the structure formed by at least first base portion 1601, second base portion 1603 and bridge portion 1605, and/or to prevent the stylus 1502 from entering the first space 1611 and/or the second space 1615.

In some embodiments, one or more of the length of the stylus 1502, the length of cord exposed by the reel of the dual retractor tether 1607, or the length of the linkage by which the stylus is attached is customizable to cause the stylus 1502 to hang at a position stylus with respect to the structure formed by at least first base portion 1601, second base portion 1603 and bridge portion 1605 such that the stylus 1502 can be easily grabbed by a user manipulating the structure formed by at least first base portion 1601, second base portion 1603 and bridge portion 1605, and/or to prevent the stylus 1502 from entering the first space 1611 and/or the second space 1615. For example, in some embodiments, the stylus 1502 is removably attached to dual retractor tether 1607 so that a longer or shorter stylus 1502 can be included in touch protector 1600. In some embodiments, stylus 1502 is a telescoping stylus. In some embodiments, stylus 1502 is configured to be made longer or shorter by way of a sliding mechanism that causes the stylus 1502 to expand or contract. In some embodiments, stylus 1502 is configured to be made longer or shorter by way of a clicking/spring/detent mechanism that causes the stylus 1502 to expand or contract. In some embodiments, stylus 1502 is modular such that additional portions of the stylus 1502 may be added to the stylus 1502 to make stylus 1502 longer and portions of the stylus 1502 may be removed from the stylus 1502 to make the stylus 1502 shorter. In some embodiments, stylus 1502 is configured to be made longer or shorter by way of some other suitable manner that causes the stylus 1502 to expand or contract.

One or more embodiments are discussed that involve stylus 1502 or some variation thereof. Although the length and positioning of the stylus 1502 is discussed with respect to touch protector 1600 including dual retractor 1607, the length and positioning of the stylus 1502 or any other embodiments thereof, with respect to any embodiments of a touch protector, with or without a dual retractor tether, in accordance with this description (e.g., a touch protector having a single retractor tether, triple retractor tether, other suitable tether, etc.), are set such that the stylus can be easily grabbed by a user manipulating the structure formed by at least the first base portion, the second base portion and the bridge portion, and/or to prevent the stylus from entering the first space and/or the second space or from contacting a surface of the touch protector that is anticipated as being an uncontaminated surface.

Figure 17:
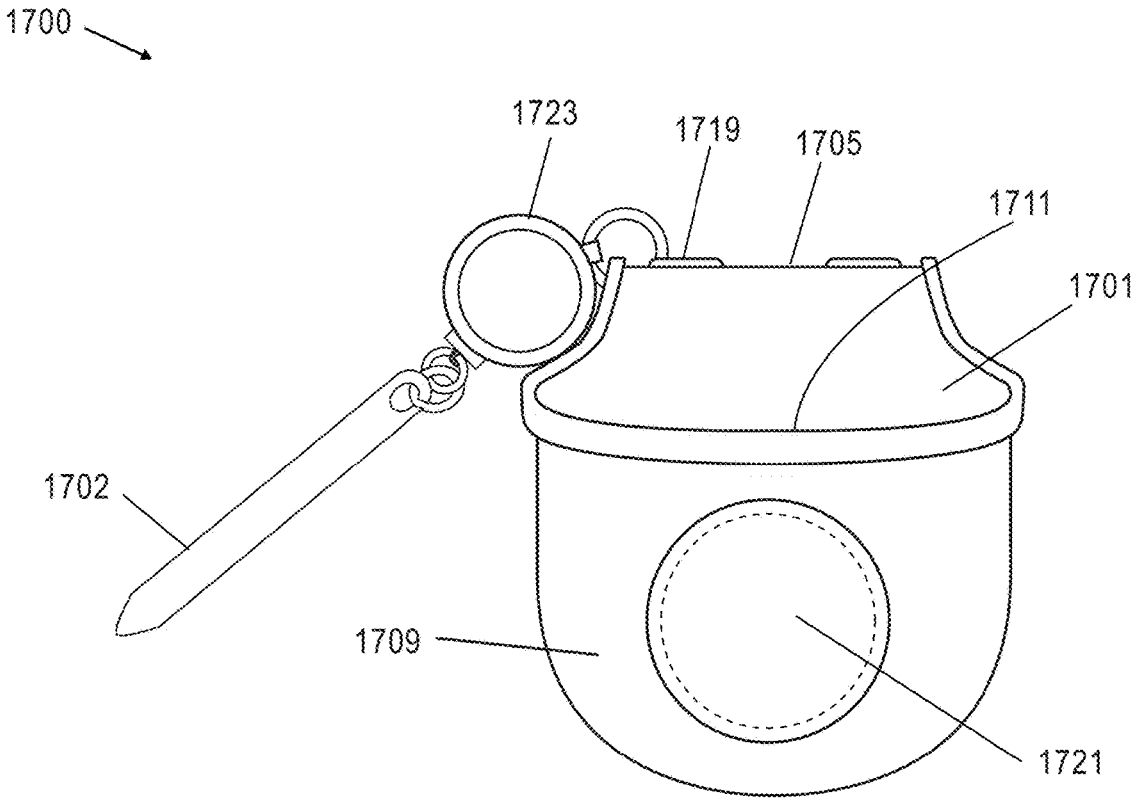
FIG. 17 is a side view of a touch protector in an at least partially closed position, in accordance with one or more embodiments.

FIG. 17 is a side view of a touch protector 1700, in accordance with one or more embodiments. Touch protector 1700 is similar to touch protector 100 (FIG. 1) with the reference numerals increased by 1600. Touch protector 1700 comprises a hook and loop fastener region 1721 configured to mate with a corresponding hook and loop fastener receiver external to the touch protector 1700 or a fabric. Touch protector 1700 is free from including tether 107 (FIG. 1). In some embodiments, touch protector 107 optionally includes tether 107 in addition to the hook and look fastener region 1721. Touch protector 1700 also includes a stylus 1502 coupled with a stylus tether 1723. Stylus tether 1723 is coupled with bridge portion 1705 by way of hole 1719. In some embodiments, stylus tether 1723 is coupled with one or more of first base portion 1701, second base portion 1703, bridge portion 1705, first backing member 1709, or second backing member 1713. Stylus tether 1723 comprises a retractor that makes it possible to extend and retract the stylus 1502 so that the stylus 1502 is readily accessible and easily grasped by a user wearing touch protector 1700. In some embodiments, stylus tether 1723 is similar to tether 107.

Figure 18:
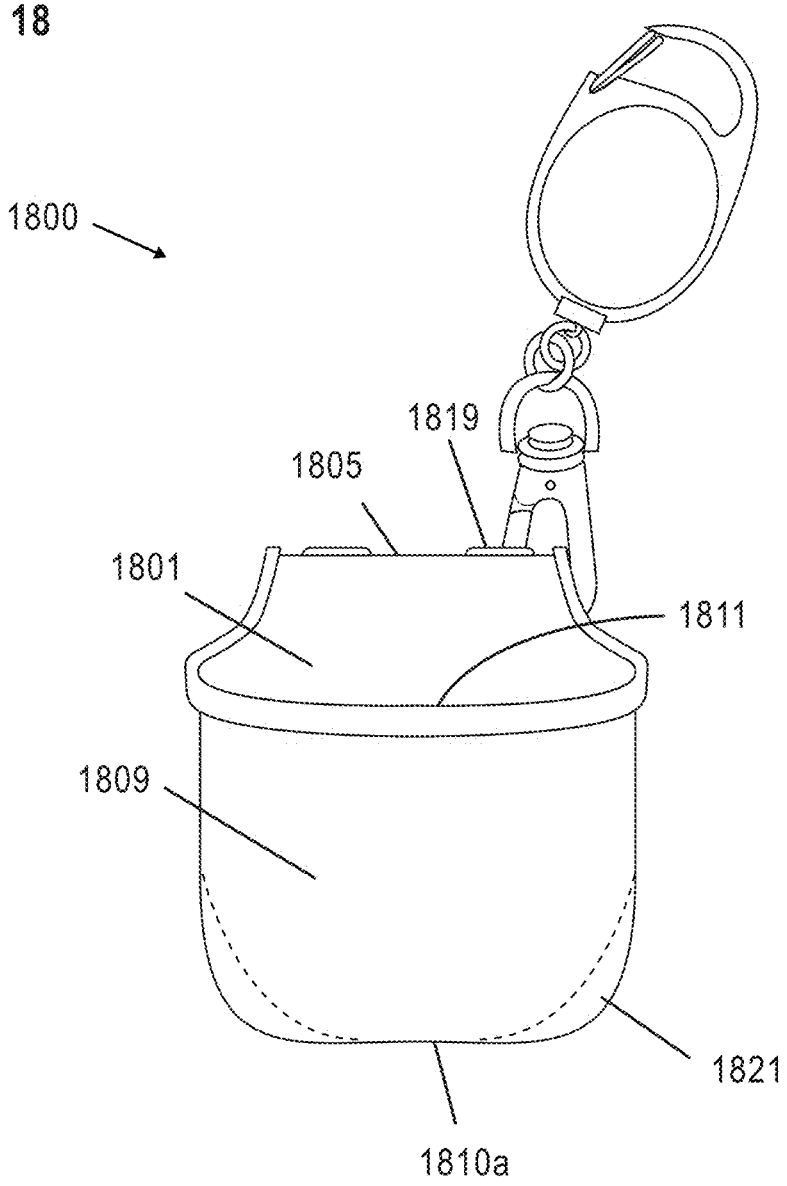
FIG. 18 is a side view of a touch protector in an at least partially closed position, in accordance with one or more embodiments.

FIG. 18 is a side view of a touch protector 1700, in accordance with one or more embodiments. Touch protector 1800 is similar to touch protector 100 (FIG. 1) with the reference numerals increased by 1700. The structure formed by the first base portion 1801 and the first backing member 1809 has a flattened end 1810*a* as compared to touch protector 100. The interior of the first space 1811 is optionally curved. The structure optionally has thickened material between the internal curvature and the squared off end 1810*a* such that corner regions 1825 have increased rigidity compared to a first backing member 1809 that has a uniform thickness without the internal curvature. In some embodiments, the corner regions 1825 that have the increased rigidity improve a user's ability to interact with a touchscreen or button, for example, while wearing the touch protector 1800. In some embodiments, the structure formed by the second base portion 1803 and the second backing member 1813 is identical to the structure formed by the first base portion 1801 and the first backing member 1809. In some embodiments, the structure formed by the second base portion 1803 and the second backing member 1813 is different compared to the structure formed by the first base portion 1801 and the first backing member 1809.

Figure 19:
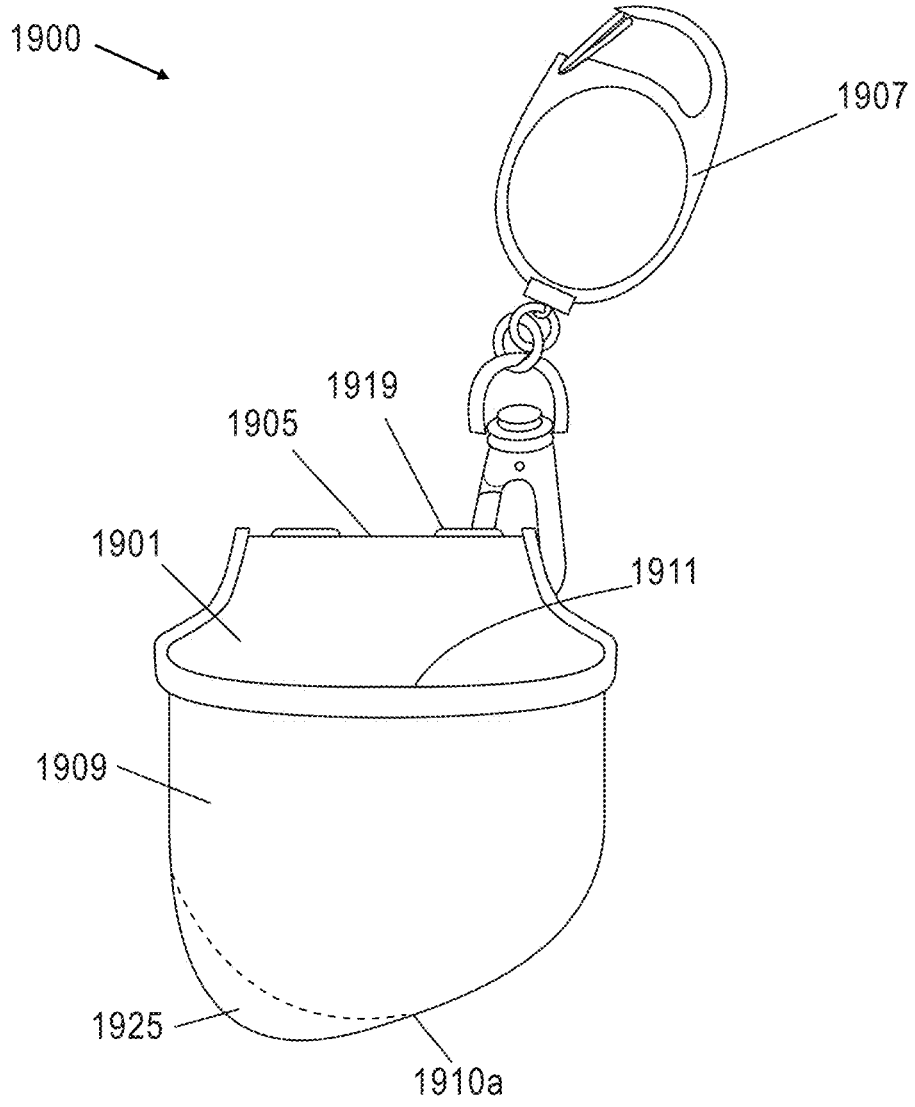
FIG. 19 is a side view of a touch protector in an at least partially closed position, in accordance with one or more embodiments.

FIG. 19 is a side view of a touch protector 1900, in accordance with one or more embodiments. Touch protector 1900 is similar to touch protector 100 (FIG. 1) with the reference numerals increased by 1800. The structure formed by the first base portion 1901 and the first backing member 1909 has and end 1910*a* that is partially curved on one side and substantially pointed on the other as compared to touch protector 100. The interior of the first space 1911 is optionally curved. The structure optionally has thickened material between the internal curvature and the substantially pointed end 1910*a* portion such that a corner region 1925 has increased rigidity compared to a first backing member 1909 that has a uniform thickness without the internal curvature. In some embodiments, the corner region 1925 that has the increased rigidity improves a user's ability to interact with a touchscreen or button, for example, while wearing the touch protector 1900. In some embodiments, the structure formed by the second base portion 1903 and the second backing member 1913 is identical to the structure formed by the first base portion 1901 and the first backing member 1909. In some embodiments, the structure formed by the second base portion 1903 and the second backing member 1913 is different compared to the structure formed by the first base portion 1901 and the first backing member 1909.

Figure 20:
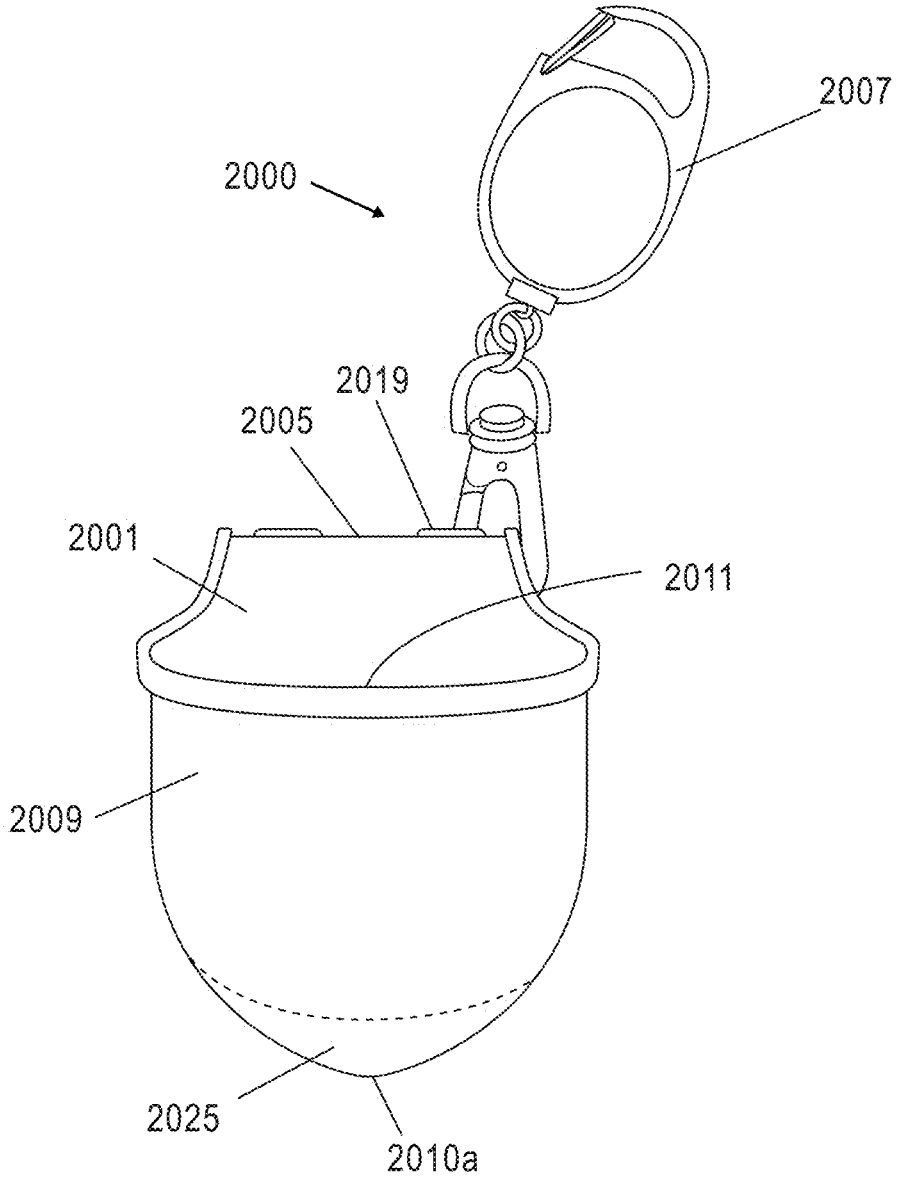
FIG. 20 is a side view of a touch protector in an at least partially closed position, in accordance with one or more embodiments.

FIG. 20 is a side view of a touch protector 2000, in accordance with one or more embodiments. Touch protector 2000 is similar to touch protector 100 (FIG. 1) with the reference numerals increased by 1900. The structure formed by the first base portion 2001 and the first backing member 2009 has and end 2010*a* that is substantially pointed as compared to touch protector 100. The interior of the first space 2011 is optionally curved. The structure optionally has thickened material between the internal curvature and the substantially pointed end 2010*a* portion such that a pointed region 2025 has increased rigidity compared to a first backing member 2009 that has a uniform thickness without the internal curvature. In some embodiments, the corner region 2025 that has the increased rigidity improves a user's ability to interact with a touchscreen or button, for example, while wearing the touch protector 2000. In some embodiments, the structure formed by the second base portion 2003 and the second backing member 2013 is identical to the structure formed by the first base portion 2001 and the first backing member 2009. In some embodiments, the structure formed by the second base portion 2003 and the second backing member 2013 is different compared to the structure formed by the first base portion 2001 and the first backing member 2009.

Figure 21:
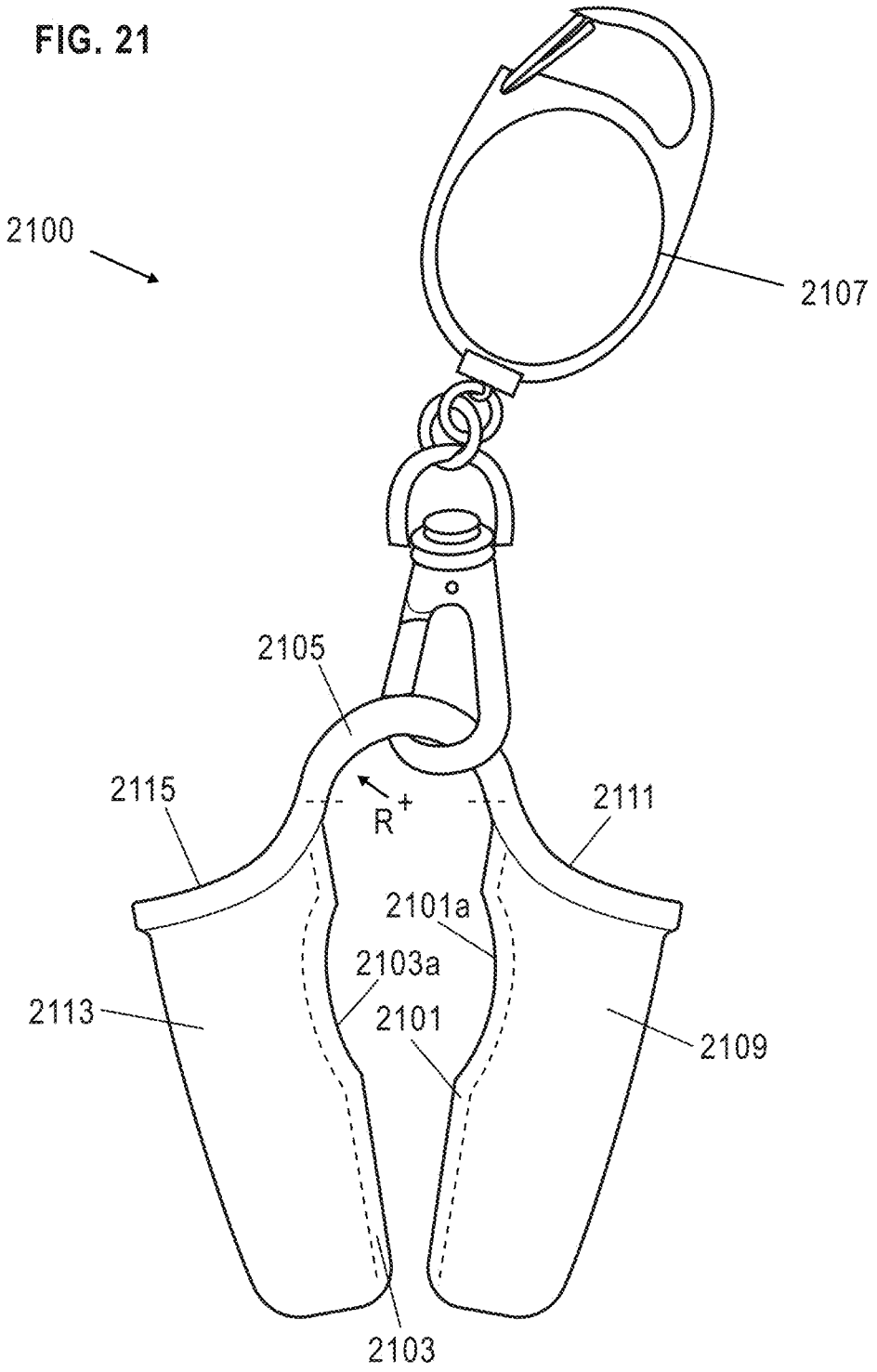
FIG. 21 is a side view of a touch protector in an at least partially closed position, in accordance with one or more embodiments.

FIG. 21 is a side view of a touch protector 2100, in accordance with one or more embodiments. Touch protector 2100 is similar to touch protector 100 (FIG. 1), with the reference numerals increased by 2000. Touch protector 2100 includes a first base portion 2101 and a second base portion 2103 that have curved indentations in the first surface 2101*a* and the third surface 2103*a* so that the first surface 2101*a* of the first base portion 2101 and the third surface 2103*a* of the second base portion 2103 are planar outside the curved region and curved toward the first space 2111 and the second space 2115. In some embodiments, the curved indentations in the first surface 2101*a* and the third surface 2103*a* enhance a user's ability to flex the first base portion 2101 or the second base portion 2103 in a manner that corresponds with a user's finger(s) or thumb when grasping an object.

Figure 22:
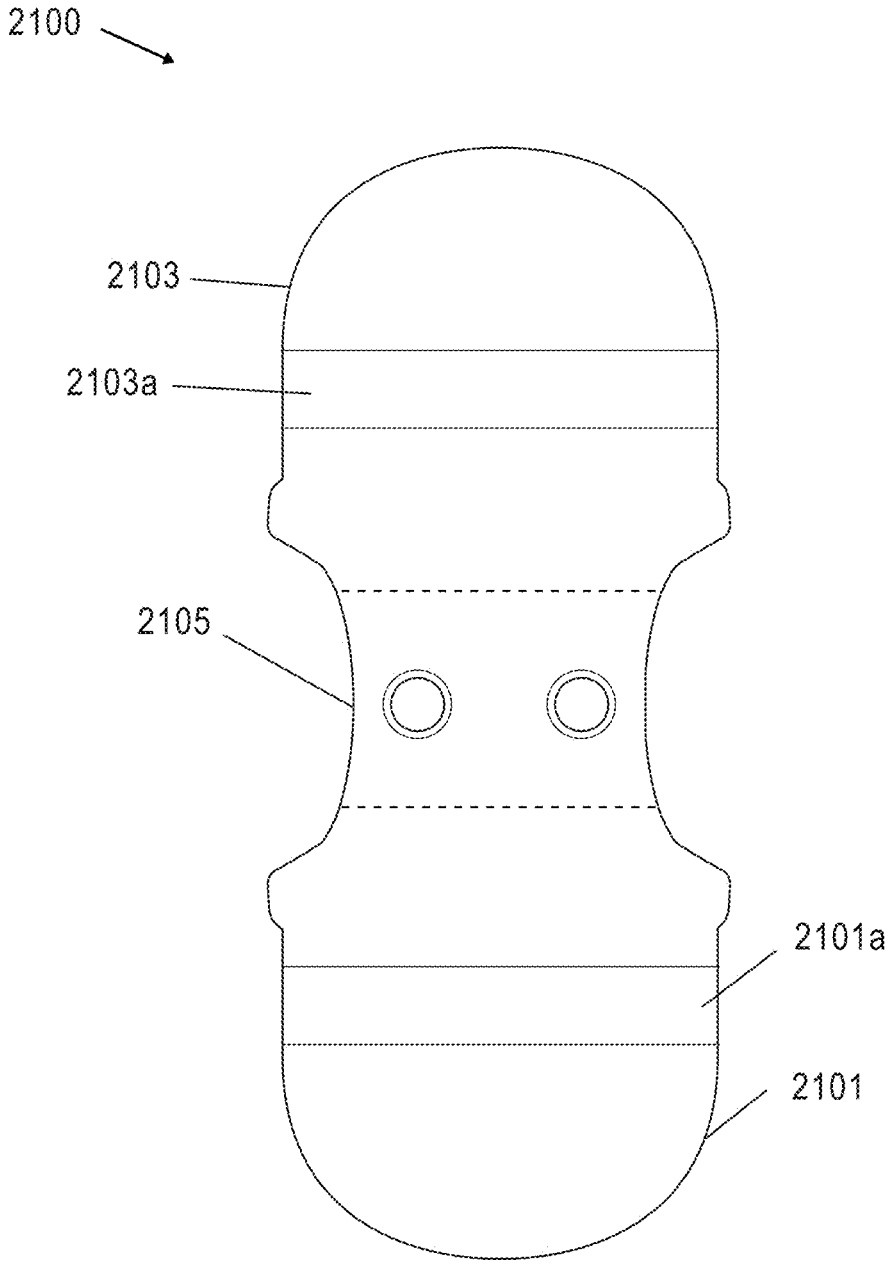
FIG. 22 is a bottom-side view of a touch protector in an open position, in accordance with one or more embodiments.

FIG. 22 is a bottom-side view of touch protector 2100, in accordance with one or more embodiments. The indentation regions in the first surface 2101*a* and the third surface 2103*a* extend across an entire width of the first surface 2101*a* of the first base portion 2101 and the third surface 2103*a* of the second base portion 2103. In some embodiments, the indentation regions in the first surface 2101*a* and the third surface 2103*a* extend across less than an entire width of the first surface 2101*a* of the first base portion 2101 and the third surface 2103*a* of the second base portion 2103.

Figure 23:
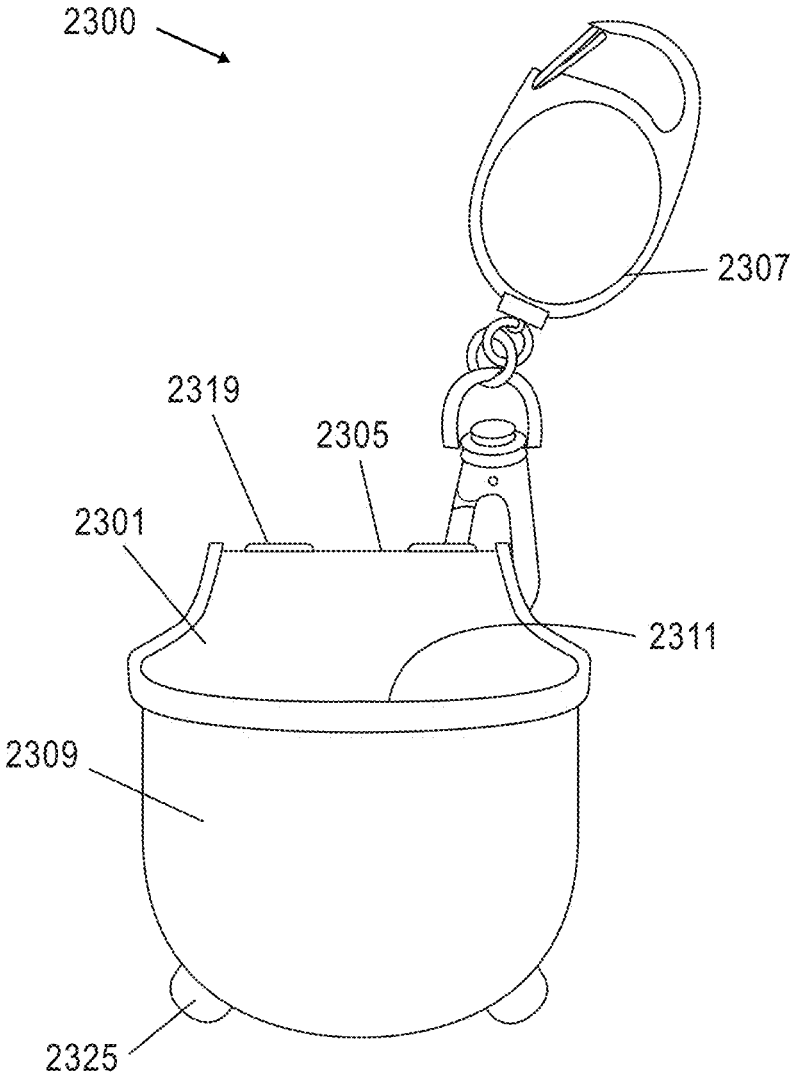
FIG. 23 is a side view of a touch protector in an at least partially closed position, in accordance with one or more embodiments.

FIG. 23 is a side view of a touch protector 2300, in accordance with one or more embodiments. Touch protector 2300 is similar to touch protector 100 (FIG. 1) with the reference numerals increased by 2200. Touch protector 2300 has one or more nubs 2325 that extend outward from the first backing member 2309. The nubs 2325 comprise a same or different material compared to the first backing member 2309. The nubs 2325 improves a user's ability to interact with a touchscreen or button, for example, while wearing the touch protector 2300. In some embodiments, the structure formed by the second base portion 2303 and the second backing member 2313 is identical to the structure formed by the first base portion 2301 and the first backing member 2309. In some embodiments, the structure formed by the second base portion 2303 and the second backing member 2313 is different compared to the structure formed by the first base portion 2301 and the first backing member 2309.

Figure 24:
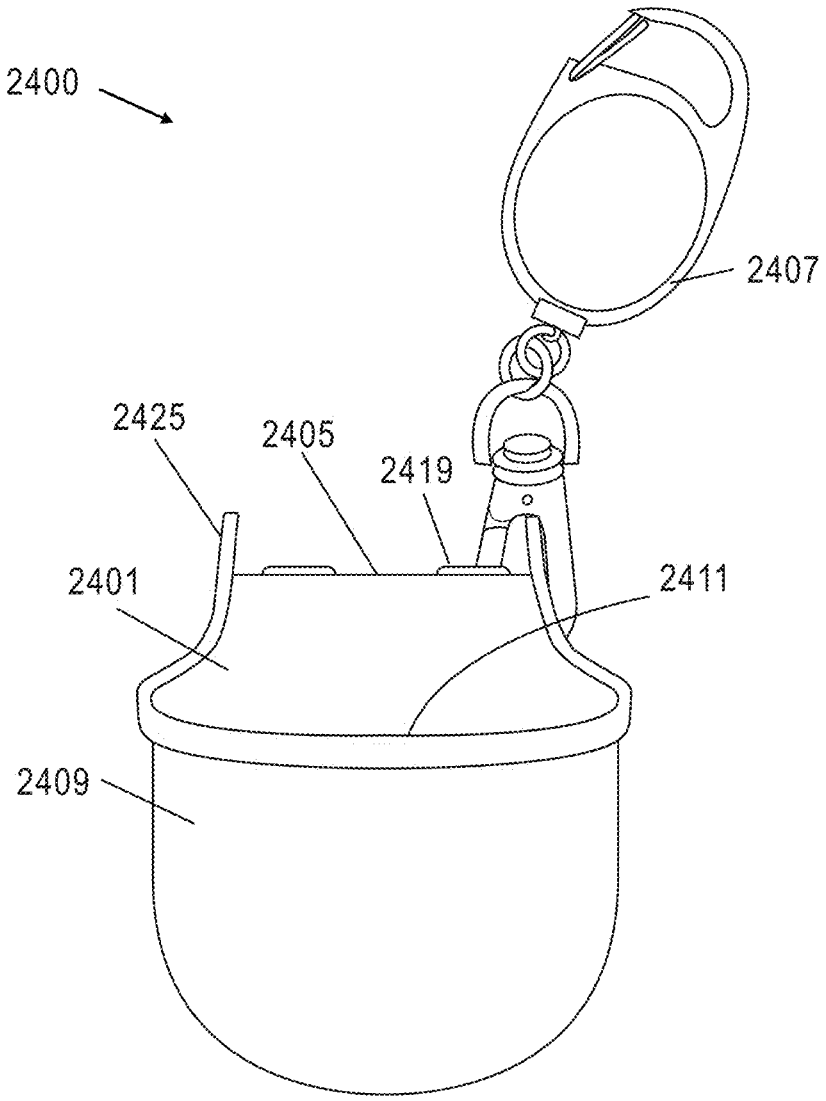
FIG. 24 is a side view of a touch protector in an at least partially closed position, in accordance with one or more embodiments.

FIG. 24 is a side view of a touch protector 2400, in accordance with one or more embodiments. Touch protector 2400 is similar to touch protector 100 (FIG. 1) with the reference numerals increased by 2300. Touch protector 2400 has one or more tabs 2425 that extend outward from the bridge portion 2405. The tabs 2425 comprise a same or different material compared to the bridge portion 2405. The tabs 2425 improve a user's ability to pull on and/or remove a user's hand from the touch protector 2400 while minimizing the opportunity for a user to contact a surface of the touch protector 2400 that has been used to contact a potentially contaminated or dirty surface.

Figure 25:
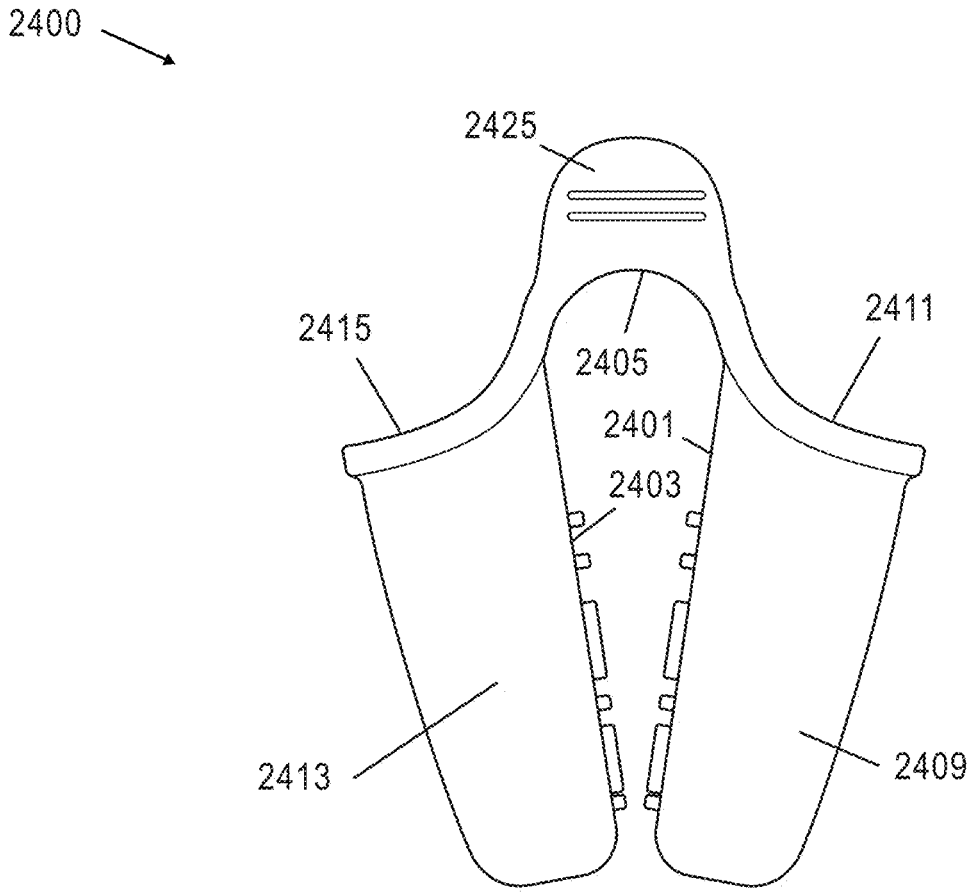
FIG. 25 is a side view of a touch protector in an at least partially closed position, in accordance with one or more embodiments.

FIG. 25 is a side view of touch protector 2400, in accordance with one or more embodiments. Tabs 2425 extend away from the bridge portion 2405. Tabs 2425 have a curved outer edge and texturing on an outer surface. In some embodiments, tabs 2425 have an edge having some other suitable shape. In some embodiments, tabs 2425 are free from having texturing on the outer surface.

Figure 26:
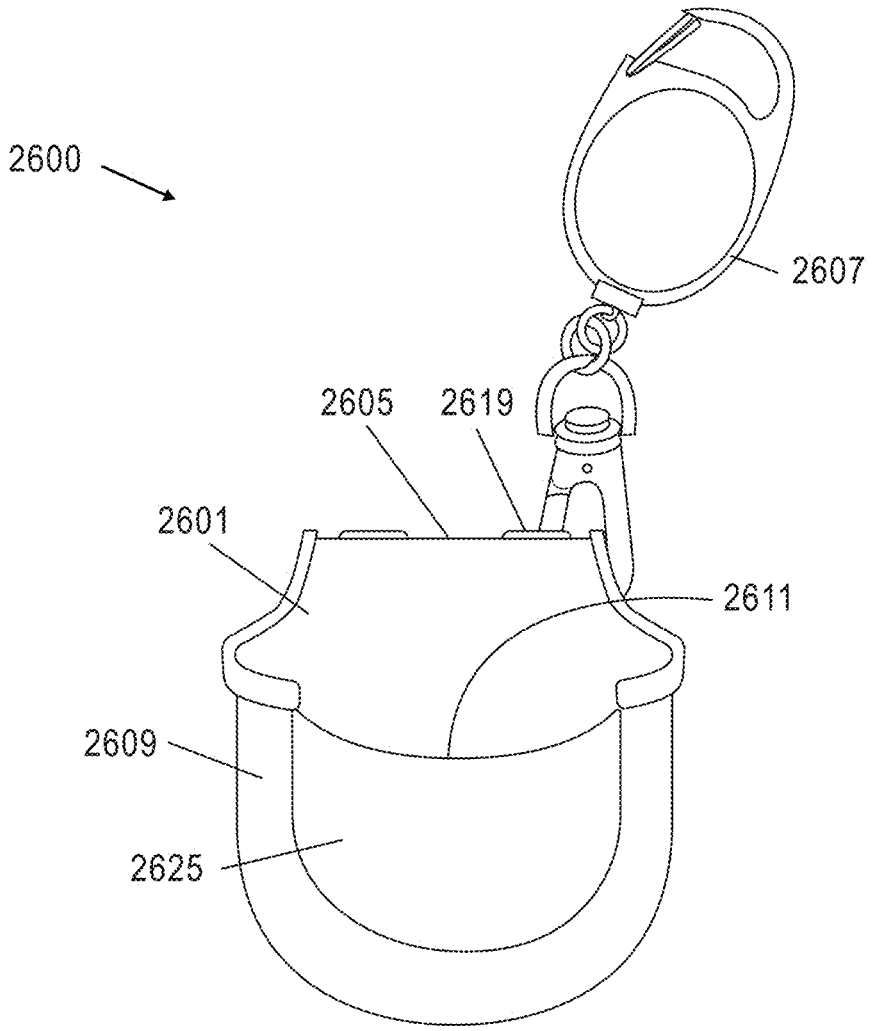
FIG. 26 is a side view of a touch protector in an at least partially closed position, in accordance with one or more embodiments.

FIG. 26 is a side view of a touch protector 2600, in accordance with one or more embodiments. Touch protector 2600 is similar to touch protector 100 (FIG. 1) with the reference numerals increased by 2500. Touch protector 2600 has a first backing member 2609 with more flexible center portion 2625 as compared to one or more other portions of the first backing member 2609. In some embodiments, the flexible center portion 2625 comprises a thickness that is less than that of more rigid portions of the first backing member 2609. In some embodiments, the flexible center portion 2625 comprises a same or different material compared to the more rigid portions of the first backing member 2609. In some embodiments, the flexible center portion 2625 improves a user's comfort while wearing the touch protector 2600. In some embodiments, the structure formed by the second base portion 2603 and the second backing member 2613 is identical to the structure formed by the first base portion 2601 and the first backing member 2609. In some embodiments, the structure formed by the second base portion 2603 and the second backing member 2613 is different compared to the structure formed by the first base portion 2601 and the first backing member 2609.

Figure 27:
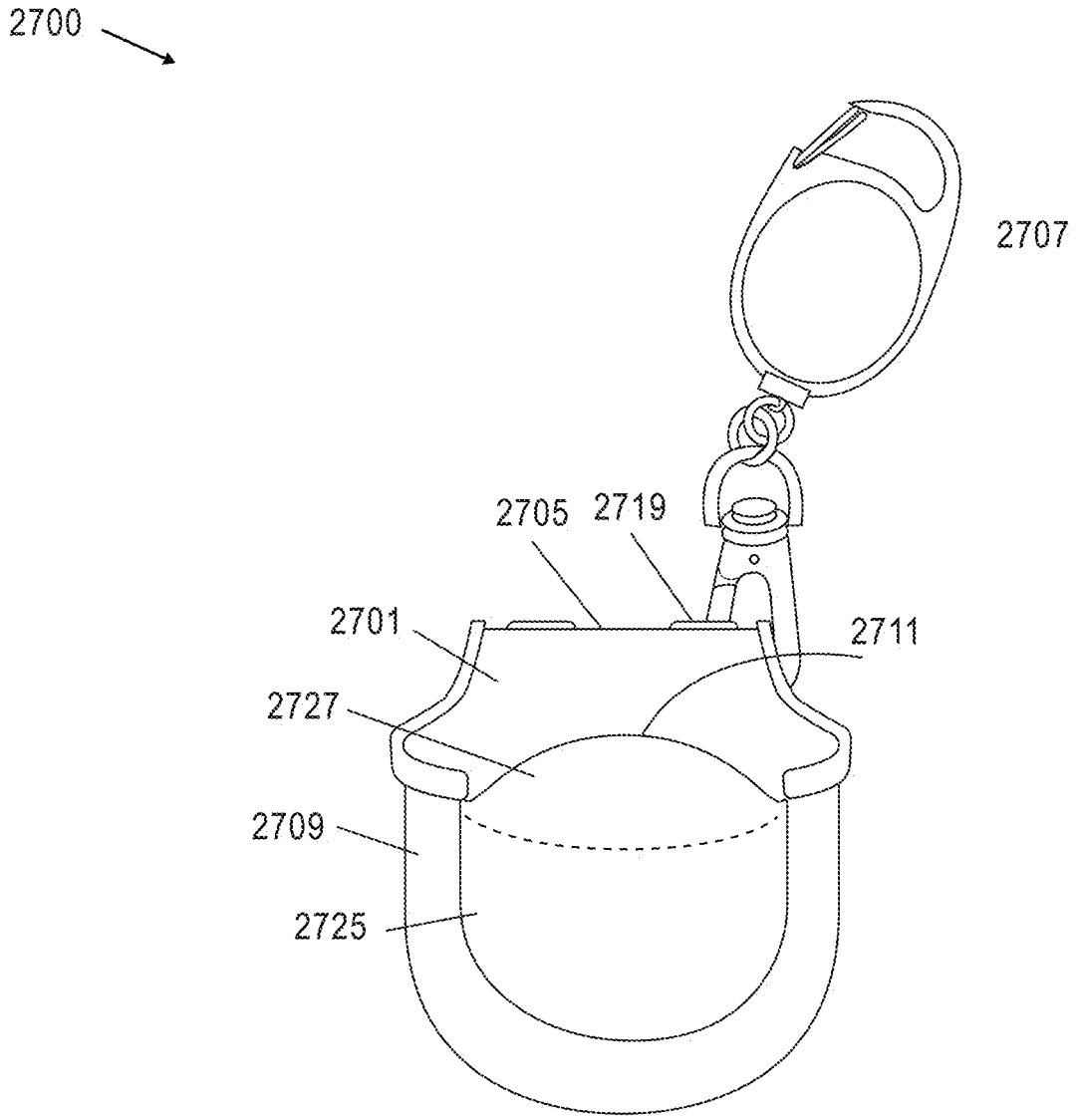
FIG. 27 is a side view of a touch protector in an at least partially closed position, in accordance with one or more embodiments.

FIG. 27 is a side view of a touch protector 2700, in accordance with one or more embodiments. Touch protector 2700 is similar to touch protector 2600 (FIG. 26) with the reference numerals increased by 100. The flexible center portion 2725 of touch protector 2700 comprises a flap 2727 as an extension of the flexible center portion 2725. In some embodiments, flap 2727 one or more of provides additional coverage of a user's fingers that are inserted into the first space 2711 or provides a tab to assist a user with pulling on or taking off the touch protector 2700 while minimizing contact with surfaces of the touch protector 2700 that have contact a potentially contaminated or dirty surface.

Figure 28:
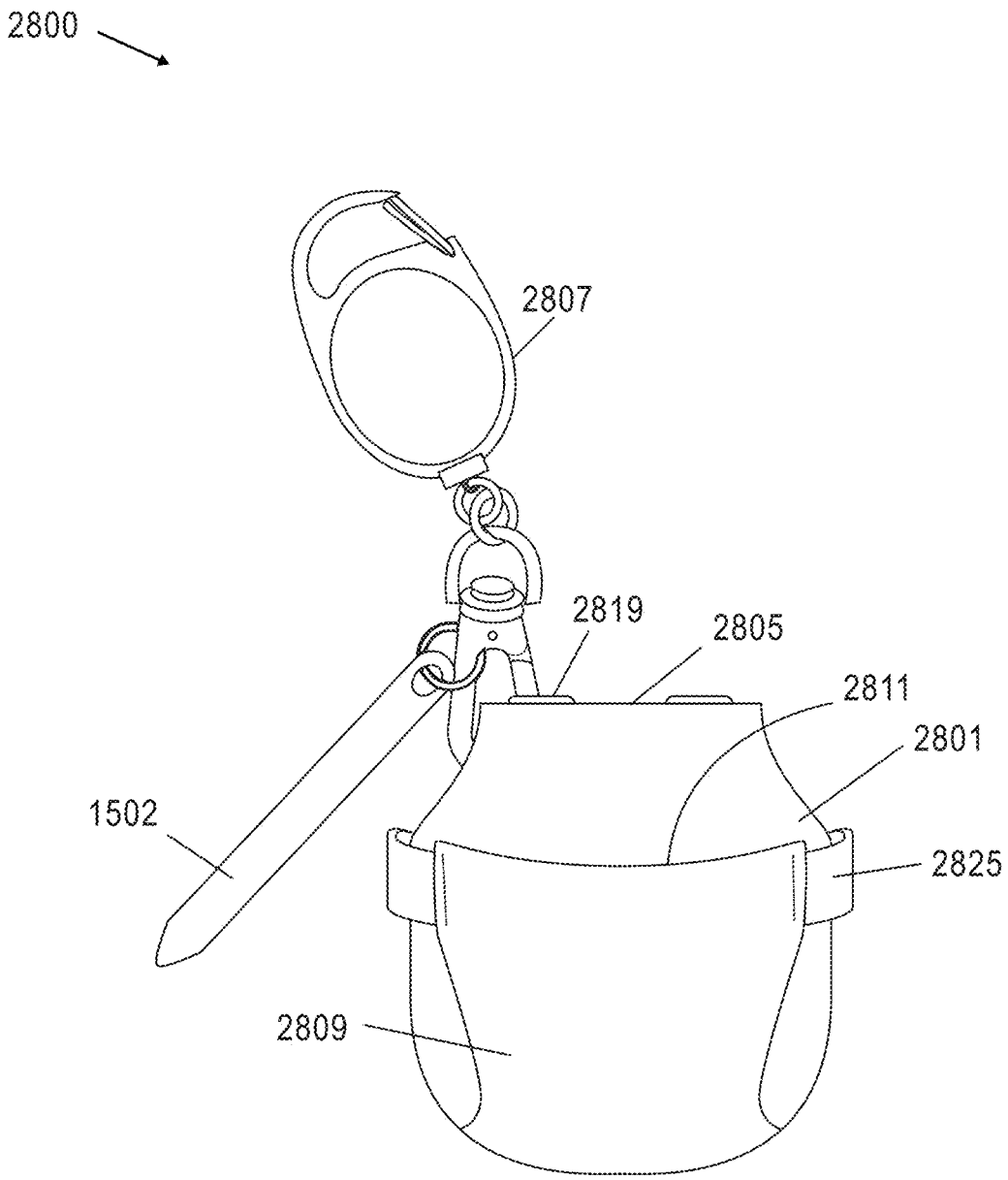
FIG. 28 is a side view of a touch protector in an at least partially closed position, in accordance with one or more embodiments.

FIG. 28 is a side view of a touch protector 2800, in accordance with one or more embodiments. Touch protector 2800 is similar to touch protector 100 (FIG. 1) with the reference numerals increased by 2700. Optional tether 2807 is coupled with bridge portion 2805 by way of hole 2819. An optional stylus 1502 is coupled with tether 2807.

Touch protector 2800 has a first backing member 2809 that is partially attached to the first base portion 2801 by way of a strap 2825. The strap 2825 facilitates an adjustable fit and optionally allows for the first backing member 2809 to be folded away from the first base portion 2809 to enable a user to easily clean the second surface 101*b* of the first base portion 2801 and the inner surface of the first backing member 2809.

In some embodiments, the strap 2825 comprises a same or different material compared to the first backing member 2809. In some embodiments, the structure formed by the second base portion 2803 and the second backing member 2813 is identical to the structure formed by the first base portion 2801 and the first backing member 2809 and includes a corresponding strap. In some embodiments, the structure formed by the second base portion 2803 and the second backing member 2813 is different compared to the structure formed by the first base portion 2801 and the first backing member 2809 and is free from included a corresponding strap.

Figure 29:
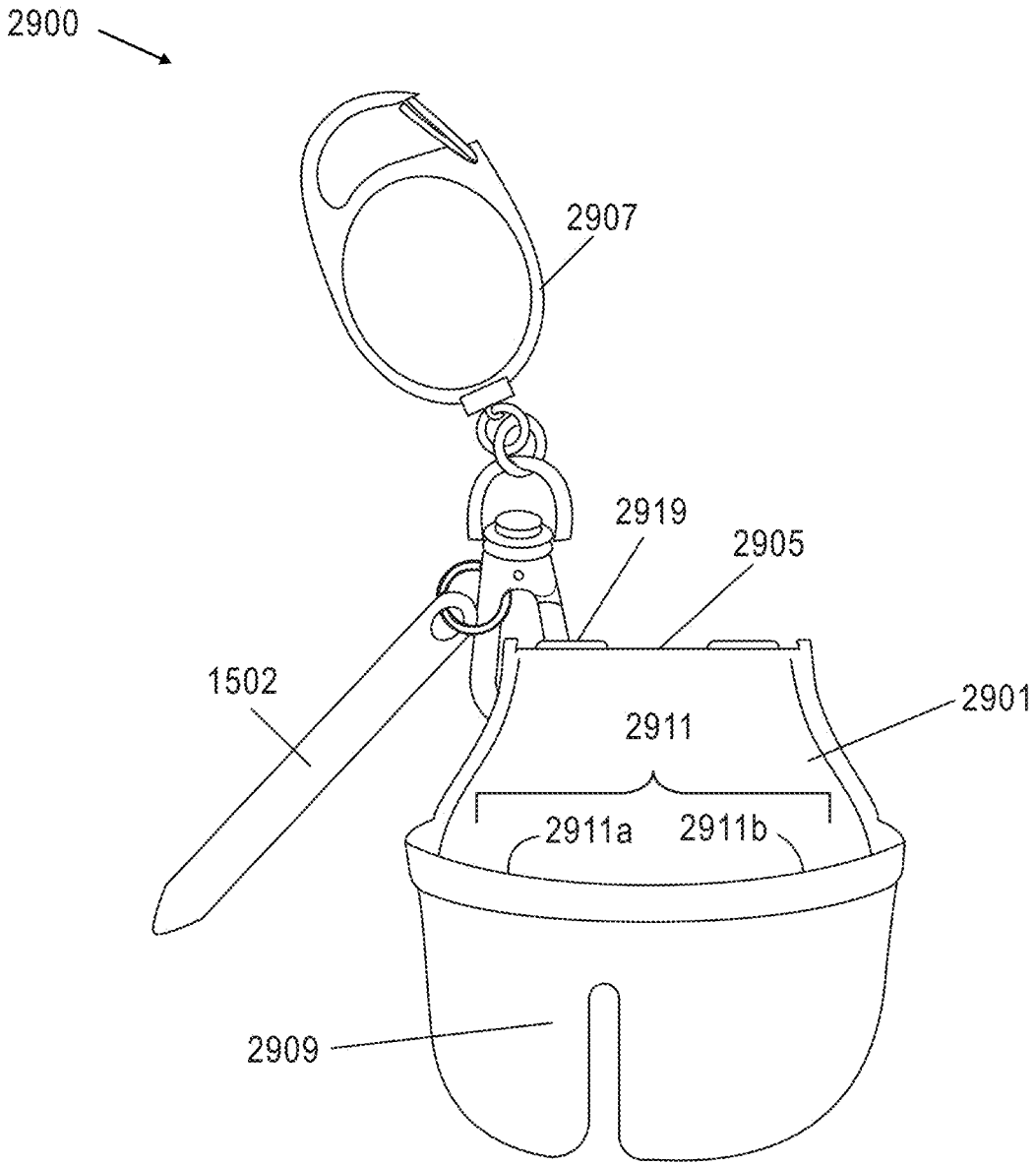
FIG. 29 is a side view of a touch protector in an at least partially closed position, in accordance with one or more embodiments.

FIG. 29 is a side view of a touch protector 2900, in accordance with one or more embodiments. Touch protector 2900 is similar to touch protector 100 (FIG. 1) with the reference numerals increased by 2800. Optional tether 2907 is coupled with bridge portion 2905 by way of hole 2919. An optional stylus 1502 is coupled with tether 2907.

Touch protector 2900 has a first base portion 2901 and a first backing member 2909 that are split-shaped such that the first space 2911 is divided into two portions, 2911*a* and 2911*b*. In some embodiments, the portions 2911*a* and 2911*b* of the first space 2911 are different in size to accommodate different fingers or a different quantity of fingers. In some embodiments, the portions 2911*a* and 2911*b* of the first space 2911 are equally sized. In some embodiments, the split-shape of the first base portion 2901 and the first backing member 2909 improves a user's ability to grasp an object while wearing touch protector 2900 by promoting independent flexure of section of the first base portion 2901 and the first backing member 2909 on either side of the split therebetween.

In some embodiments, the structure formed by the second base portion 2903 and the second backing member 2913 is identical to the structure formed by the first base portion 2901 and the first backing member 2909. In some embodiments, the structure formed by the second base portion 2903 and the second backing member 2913 is different compared to the structure formed by the first base portion 2901 and the first backing member 2909 and is free from having the split-shape or has a different proportional variation between portions of the second space 2915.

Figure 30:
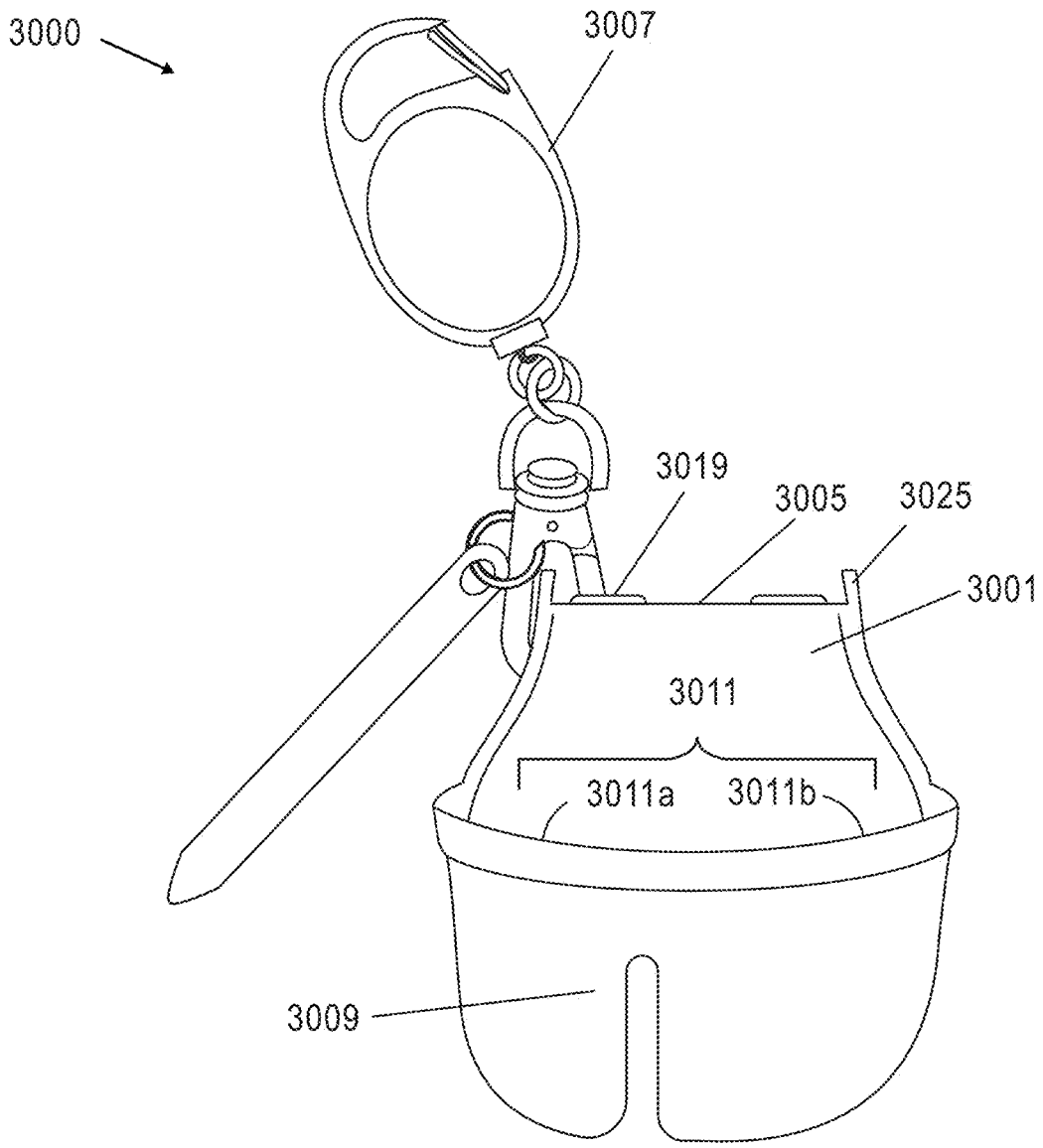
FIG. 30 is a side view of a touch protector in an at least partially closed position, in accordance with one or more embodiments.

FIG. 30 is a side view of a touch protector 3000, in accordance with one or more embodiments. Touch protector 3000 is similar to touch protector 2900 (FIG. 29) with the reference numerals increased by 100. In addition to the features included in touch protector 2900, touch protector 3000 includes one or more tabs 3025 extending from the bridge portions 3005. Tabs 3025 are similar to tabs 2425 (FIG. 24).

Figure 31:
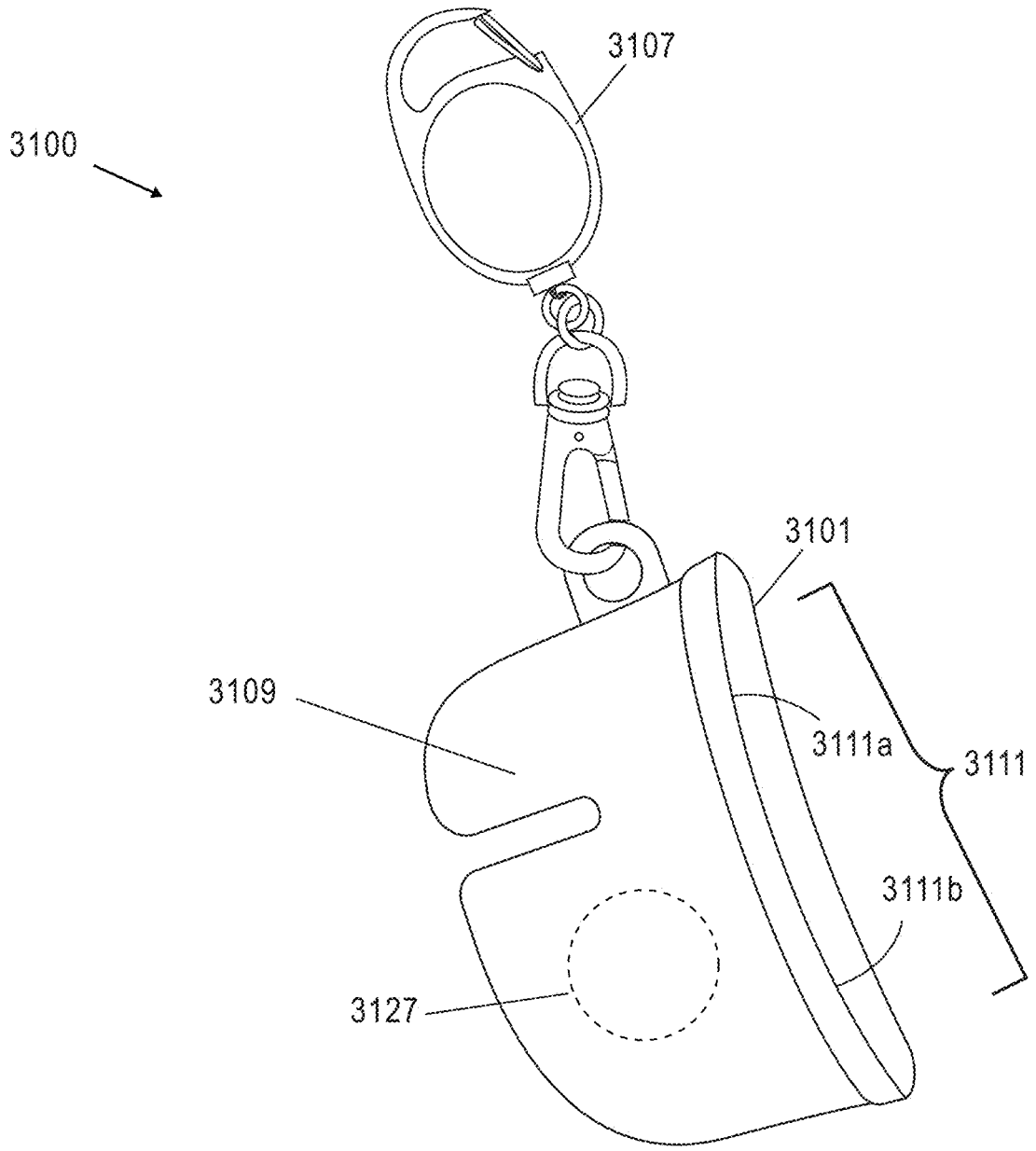
FIG. 31 is a side view of a touch protector in an at least partially closed position, in accordance with one or more embodiments.

FIG. 31 is a side view of a touch protector 3100, in accordance with one or more embodiments. Touch protector 3100 is similar to touch protector 2900 (FIG. 29) with the reference numerals increased by 200. Optional tether 3107 is coupled with bridge portion 3105 by way of hole 3119. An optional stylus 1502 is coupled with tether 3107.

Touch protector 3100 has a first base portion 3101 and a first backing member 3109 that are split-shaped such that the first space is divided into two portions, 3111*a* and 3111*b*. In some embodiments, the portions 3111*a* and 3111*b* of the first space are different in size to accommodate different fingers or a different quantity of fingers. In some embodiments, the portions 3111*a* and 3111*b* of the first space are equally sized. In some embodiments, the split-shape of the first base portion 3101 and the first backing member 3109 improves a user's ability to grasp an object while wearing touch protector 3100 by promoting independent flexure of section of the first base portion 3101 and the first backing member 3109 on either side of the split therebetween. Touch protector 3100 is free from having a second base portion, a bridge portion, and second backing member.

In some embodiments, touch protector 3100 comprises a hook and loop fastener or magnetic fastener 3127 that corresponds with a hook and loop receiver or magnetic receiver for coupling the touch protector 3100 with an armband, belt, clothing, etc. In some embodiments, fastener 3127 is on the first base portion 311 so that the curved first backing member 3109 is outward with respect to an attachment point to facilitate easy finger insertion.

Figure 32:
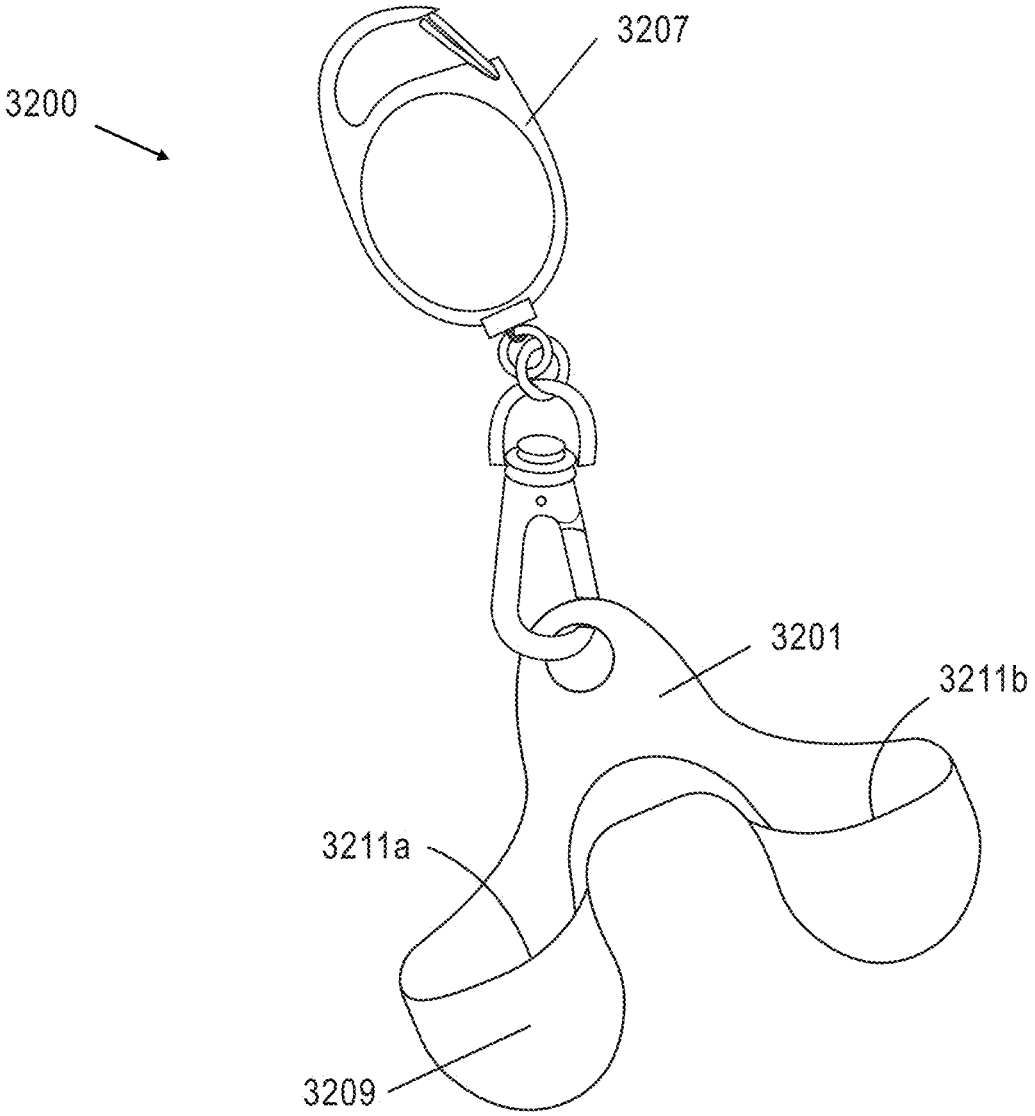
FIG. 32 is a side view of a touch protector in an at least partially closed position, in accordance with one or more embodiments.

FIG. 32 is a side view of a touch protector 3200, in accordance with one or more embodiments. Touch protector 3200 is similar to touch protector 3100 (FIG. 30) with the reference numerals increased by 100. Touch protector 3200 has a first base portion 3201 and a first backing member 3209 that are split-shaped such that the first space is divided into two portions, 3211*a* and 3211*b*. In some embodiments, the portions 3211*a* and 3211*b* of the first space are different in size to accommodate different fingertips or a different quantity of fingertips. In some embodiments, the portions 3211*a* and 3211*b* of the first space are equally sized. Touch protector 3200 is free from having a second base portion, a bridge portion, and second backing member and optional tether 3107 is coupled with first base portion 3201. The first backing member 3209 covers the first base portion 3201 to form the separate portions of the 3211*a* and 3211*b* and extends from the first base portion 3201 between the portions 3211*a* and 3211*b* of the first space without joining the portions 3211*a* and 3211*b* of the first space into one.

Figure 33:
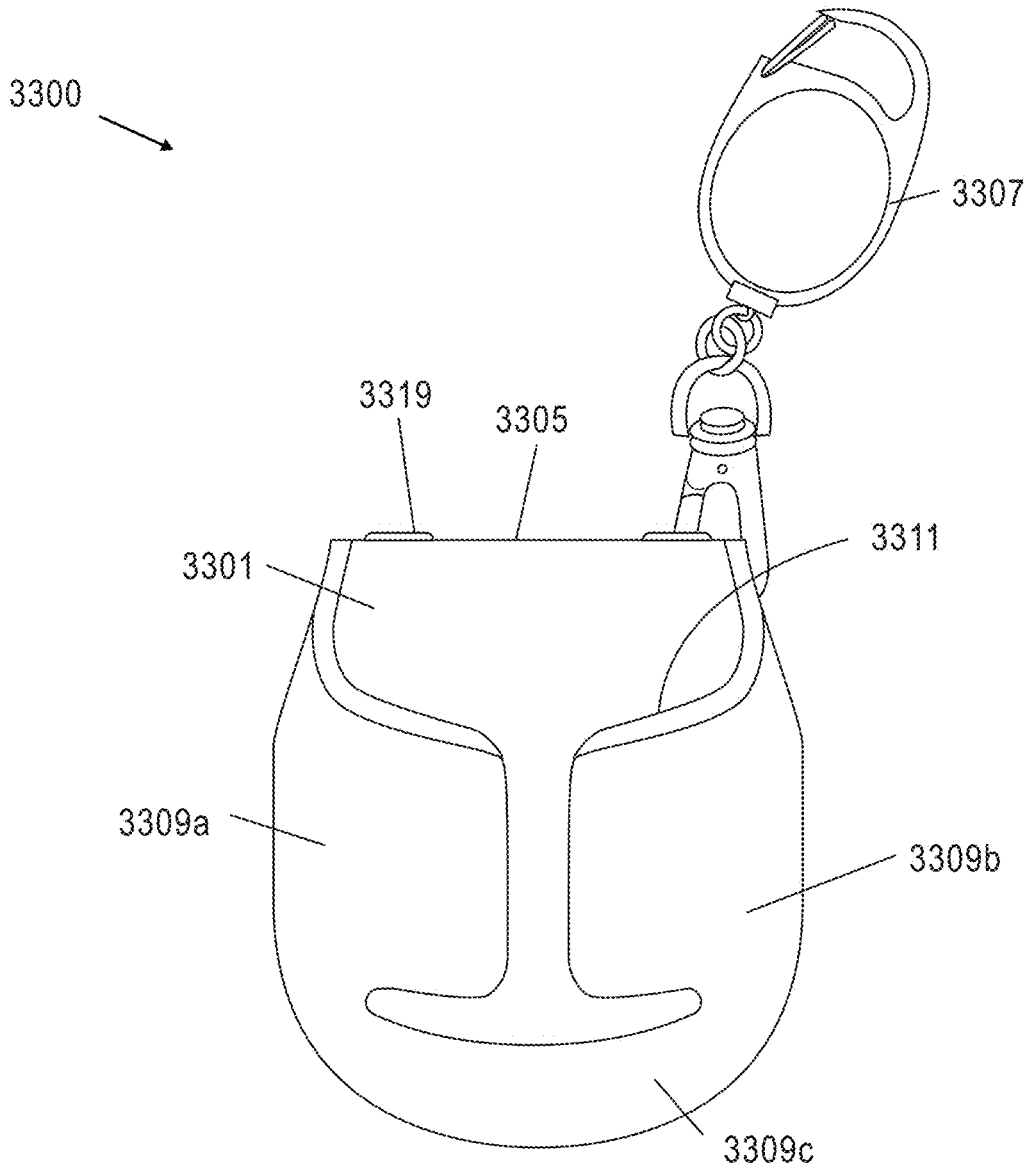
FIG. 33 is a side view of a touch protector in an at least partially closed position, in accordance with one or more embodiments.

FIG. 33 is a side view of a touch protector 3300, in accordance with one or more embodiments. Touch protector 3300 is similar to touch protector 100 (FIG. 1) with the reference numerals increased by 3200. Touch protector 3300 has a first backing member that is divided into two resilient portions 3309*a* and 3309*b* and an end portion 3309*c* (collectively referred to as first backing member 3309). The resilient portions 3309*a* and 3309*b* are configured to receive user's thumb or one or more fingers through a split between the resilient portions 3309*a* and 3309*b* in a direction toward the first backing member 3301, flex toward the first backing member 3301 while being pressed toward the first backing member 3301 by the user's thumb or finger(s), and then elastically return to a pre-flexed position with the user's thumb or finger(s) in the first space 3311. The end portion 3309*c* one or more of covers a user's fingertips while the user's fingers are within the first space 3311 or provides a thick end of material extending between the first space and an end of the structure formed by the first base portion 3301 and the first backing member 3309.

In some embodiments, the first backing member 3309 provides a pop-on capability to assist a user with inserting a thumb or finger(s) into the first space 3311.

In some embodiments, the structure formed by the second base portion 3303 and the second backing member 3313 is identical to the structure formed by the first base portion 3301 and the first backing member 3309. In some embodiments, the structure formed by the second base portion 3303 and the second backing member 3313 is different compared to the structure formed by the first base portion 3301 and the first backing member 3309.

Figure 34:
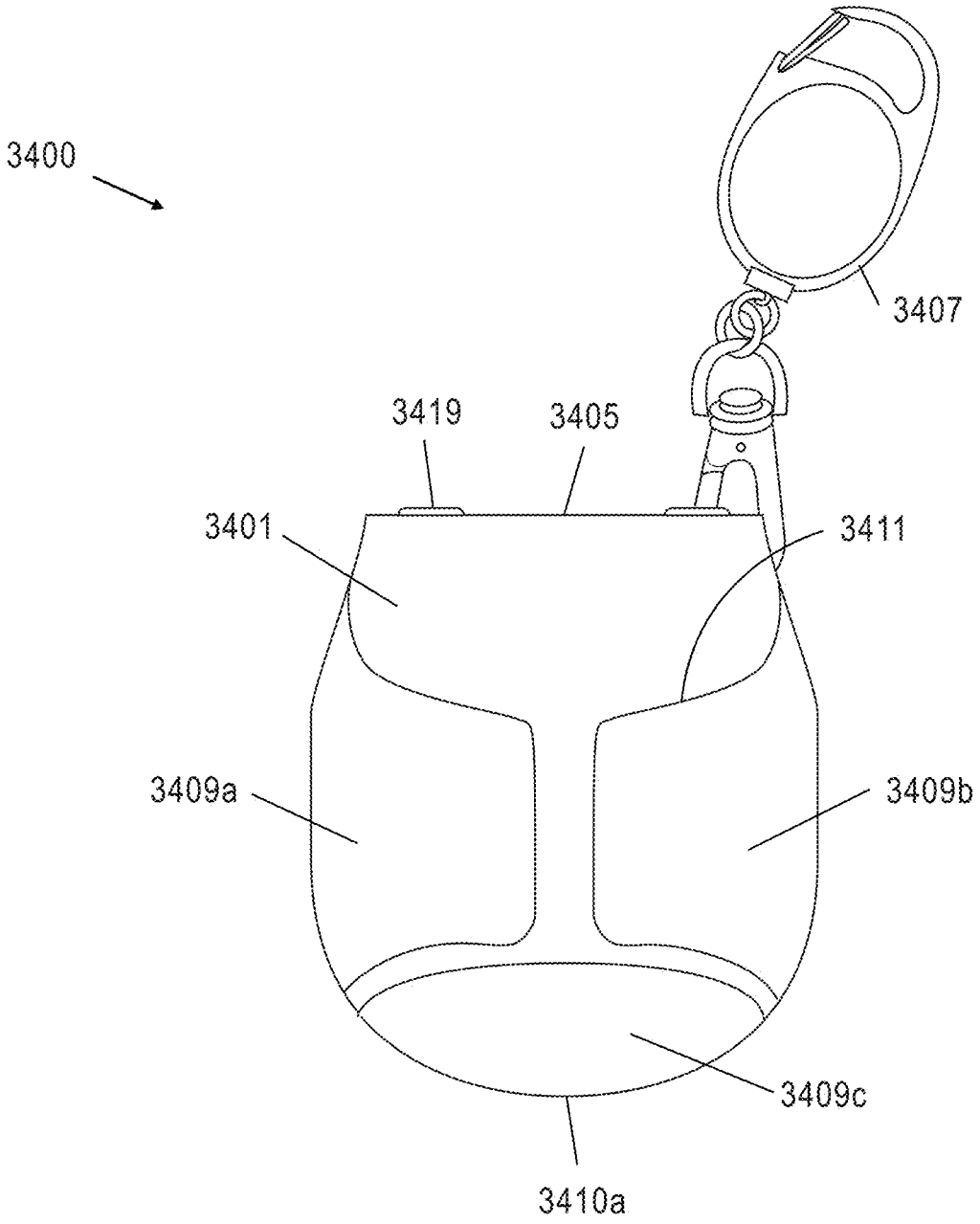
FIG. 34 is a side view of a touch protector in an at least partially closed position, in accordance with one or more embodiments.

FIG. 34 is a side view of a touch protector 3400, in accordance with one or more embodiments. Touch protector 3400 is similar to touch protector 100 (FIG. 1) with the reference numerals increased by 3300. Touch protector 3400 has a first backing member that is divided into two resilient portions 3409*a* and 3409*b* and an end portion 3409*c* (collectively referred to as first backing member 3409). The resilient portions 3409*a* and 3409*b* are configured to receive user's thumb or one or more fingers through a split between the resilient portions 3409*a* and 3409*b* in a direction toward the first backing member 3401, flex toward the first backing member 3401 while being pressed toward the first backing member 3401 by the user's thumb or finger(s), and then elastically return to a pre-flexed position with the user's thumb or finger(s) in the first space 3411. The end portions 3409*c* one or more of covers a user's fingertips while the user's fingers are within the first space 3411, provides a thick end of material extending between the first space and an end 3410*a* of the structure formed by the first base portion 3401 and the first backing member 3409, or is a foldable flap that opens to assist in cleaning the touch protector 3400. In some embodiments, the end portion 3409*c* is a resilient portion like resilient portions 3409*a* and 3409*b*.

In some embodiments, the first backing member 3409 provides a pop-on capability to assist a user with inserting a thumb or finger(s) into the first space 3411.

In some embodiments, the structure formed by the second base portion 3403 and the second backing member 3413 is identical to the structure formed by the first base portion 3401 and the first backing member 3409. In some embodiments, the structure formed by the second base portion 3403 and the second backing member 3413 is different compared to the structure formed by the first base portion 3401 and the first backing member 3409.

Figure 35:
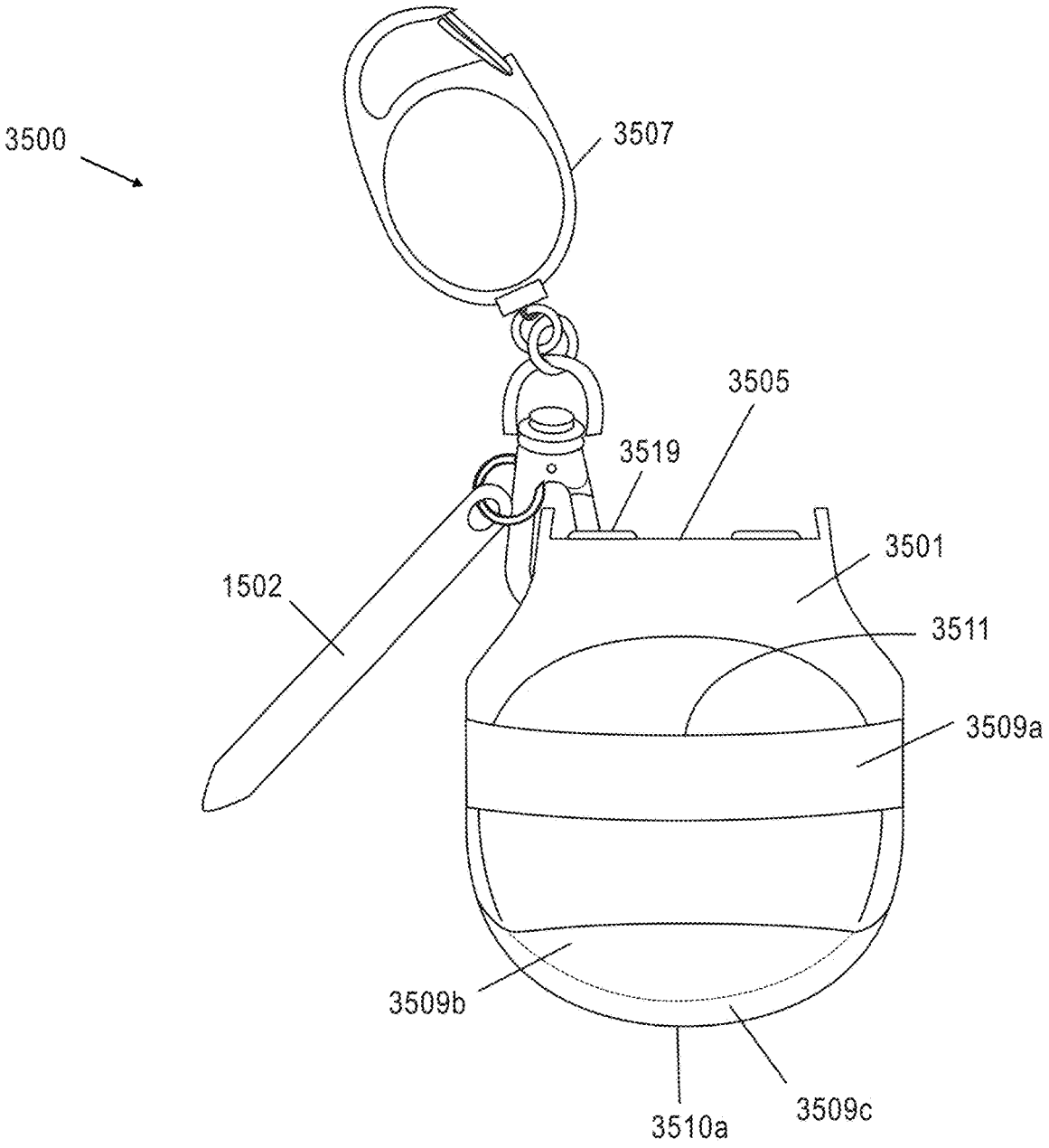
FIG. 35 is a side view of a touch protector in an at least partially closed position, in accordance with one or more embodiments.

FIG. 35 is a side view of a touch protector 3500, in accordance with one or more embodiments. Touch protector 3500 is similar to touch protector 100 (FIG. 1) with the reference numerals increased by 3400. Touch protector 3500 has a first backing member that is divided into a strip 3509*a*, a fingertip cover 3509*b* and an end portion 3509*c* (collectively referred to as first backing member 3509). The strip 3509*a* and fingertip cover 3509*b* are configured to receive user's thumb or one or more fingers with minimal coverage of the user's thumb or finger(s) while the user's fingers are within the first space 3511. End portion 3509*c* provides a thick end of material extending between the first space 3511 and an end 3510*a* of the structure formed by the first base portion 3501 and the first backing member 3509.

In some embodiments, the first backing member 3509 provides minimal coverage of the first base portion 3501 to assist a user's ability to clean first base portion 3501.

In some embodiments, the structure formed by the second base portion 3503 and the second backing member 3513 is identical to the structure formed by the first base portion 3501 and the first backing member 3509. In some embodiments, the structure formed by the second base portion 3503 and the second backing member 3513 is different compared to the structure formed by the first base portion 3501 and the first backing member 3509.

Figure 36:
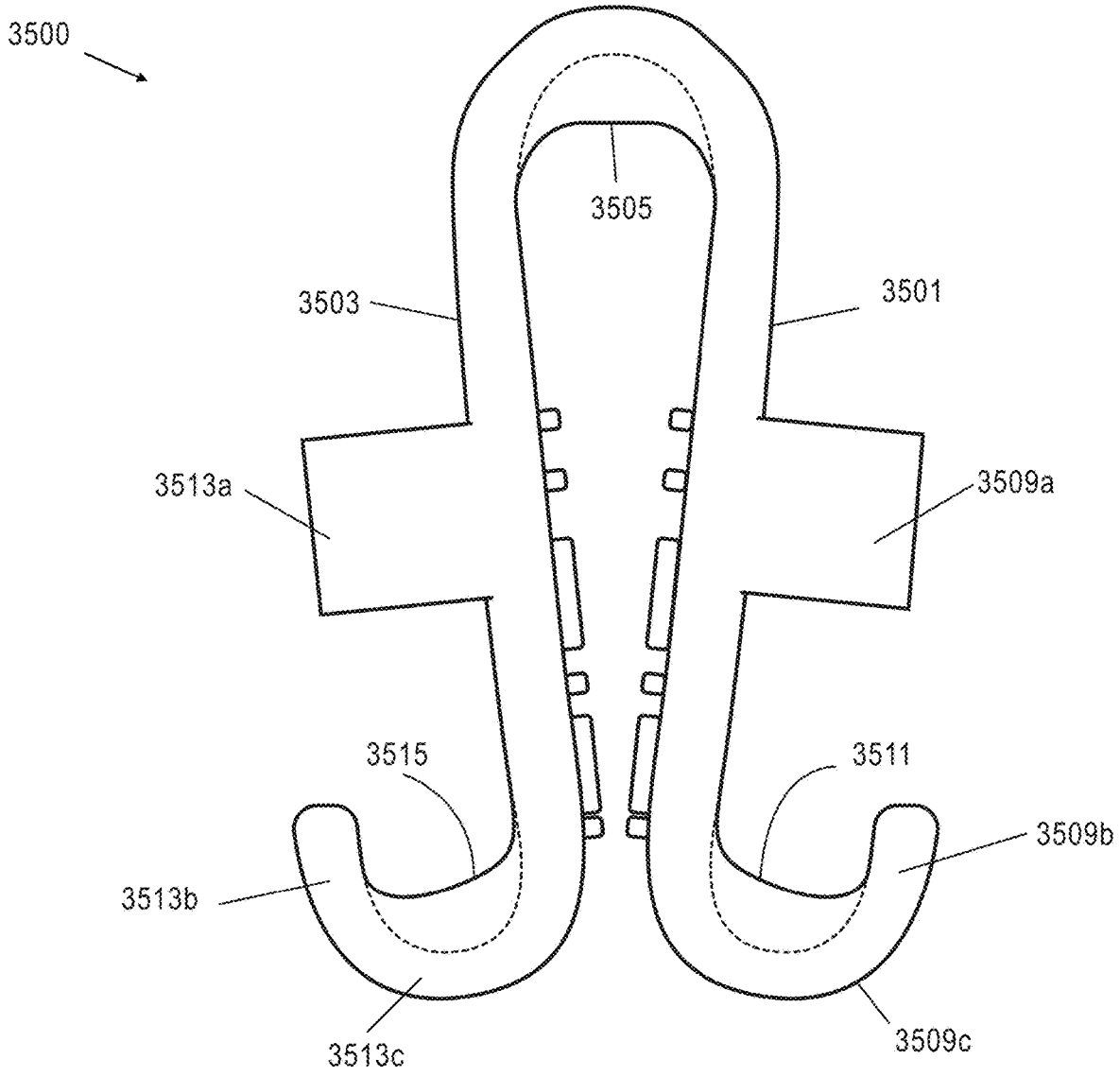
FIG. 36 is a side view of a touch protector in an at least partially closed position, in accordance with one or more embodiments.

FIG. 36 is a side view of the touch protector 3500, in accordance with one or more embodiments. The structure formed by the second base portion 3503 and the second backing member 3513 is identical to the structure formed by the first base portion 3501 and the first backing member 3509.

Figure 37:
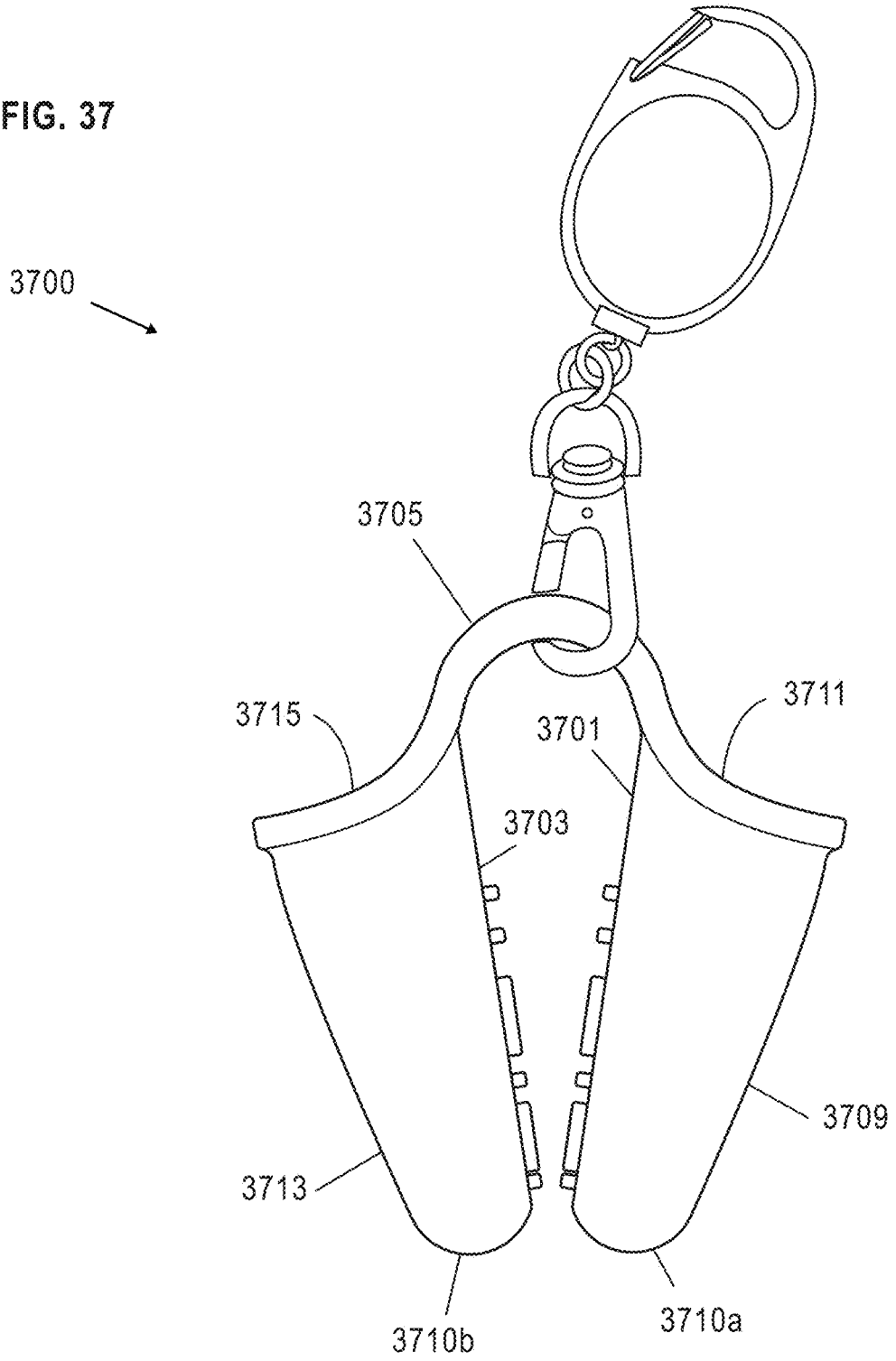
FIG. 37 is a side view of a touch protector in an at least partially closed position, in accordance with one or more embodiments.

FIG. 37 is a side view of a touch protector 3700, in accordance with one or more embodiments. Touch protector 3700 is similar to touch protector 100 (FIG. 1) with the reference numerals increased by 100. Touch protector 3700 includes a first backing member 3709 and a second backing member 3713 that have rounded ends 3710*a* and 3710*b*. In some embodiments, one of the first backing member 3709 or second backing member 3713 has a rounded end and the other of the first backing member 3709 and the second backing member 3713 has a squared-off end like touch protector 100 (FIG. 3). In some embodiments, a touch protector 3700 provides a different tactile experience for a user as compared to touch protector 100.

Figure 38:
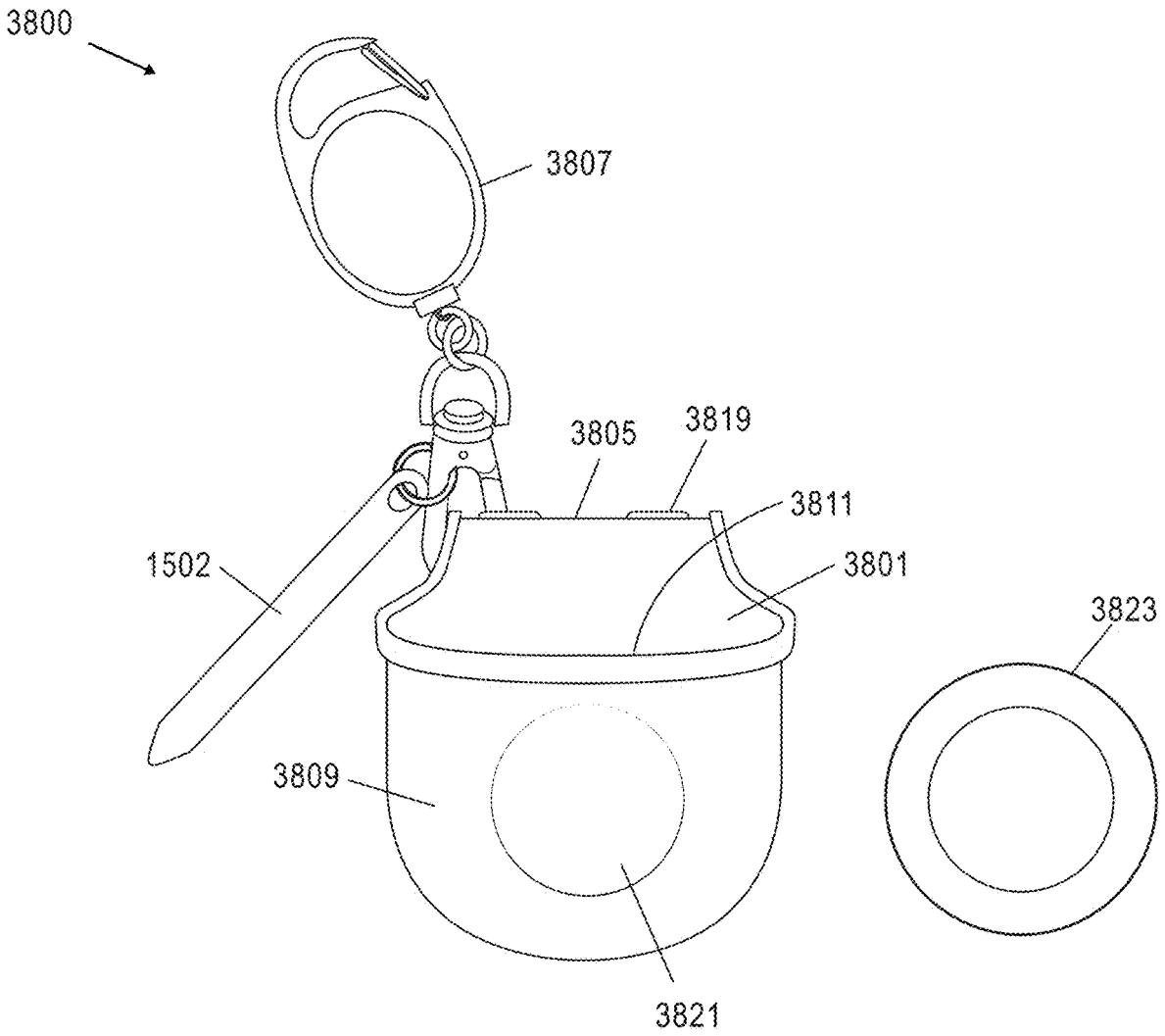
FIG. 38 is a side view of a touch protector in an at least partially closed position, in accordance with one or more embodiments.

FIG. 38 is a side view of a touch protector 3800, in accordance with one or more embodiments. Touch protector 3800 is similar to touch protector 100 (FIG. 1) with the reference numerals increased by 3700. Touch protector 3800 comprises a includes a magnet fastener region 3821 configured to mate with a corresponding magnet receiver 3823. In some embodiments, magnet receiver comprises a metal to which the magnet fastener region 3821 is attracted and is configured to be attached to an object external to the touch protector 3800 or inserted into a user's pocket, for example. Touch protector 3800 includes tether 3807 for coupling the touch protector 3800 with an object such as a belt loop. In some embodiments, touch protector 3800 is free from including tether 3807. Touch protector 3700 also includes a stylus 1502. In some touch protector 3800 is free from including stylus 1502.

Figure 39:
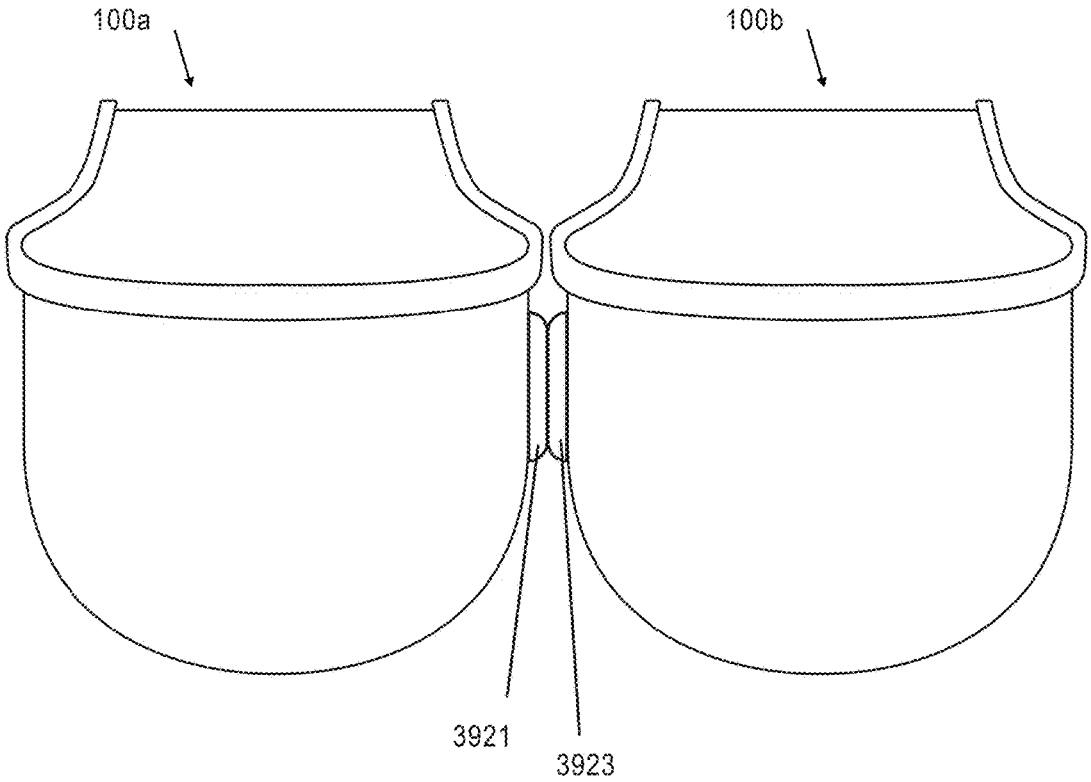
FIG. 39 is a side view of a pair of touch protectors, in accordance with one or more embodiments.

FIG. 39 is a side view of a pair of touch protectors 100*a* and 100*b*, in accordance with one or more embodiments. Touch protector 100*a* includes a magnet fastener 3921. Touch protector 100*b* includes a magnet receiver 3923 configured to be coupled with a magnet fastener 3921.

Figure 40:
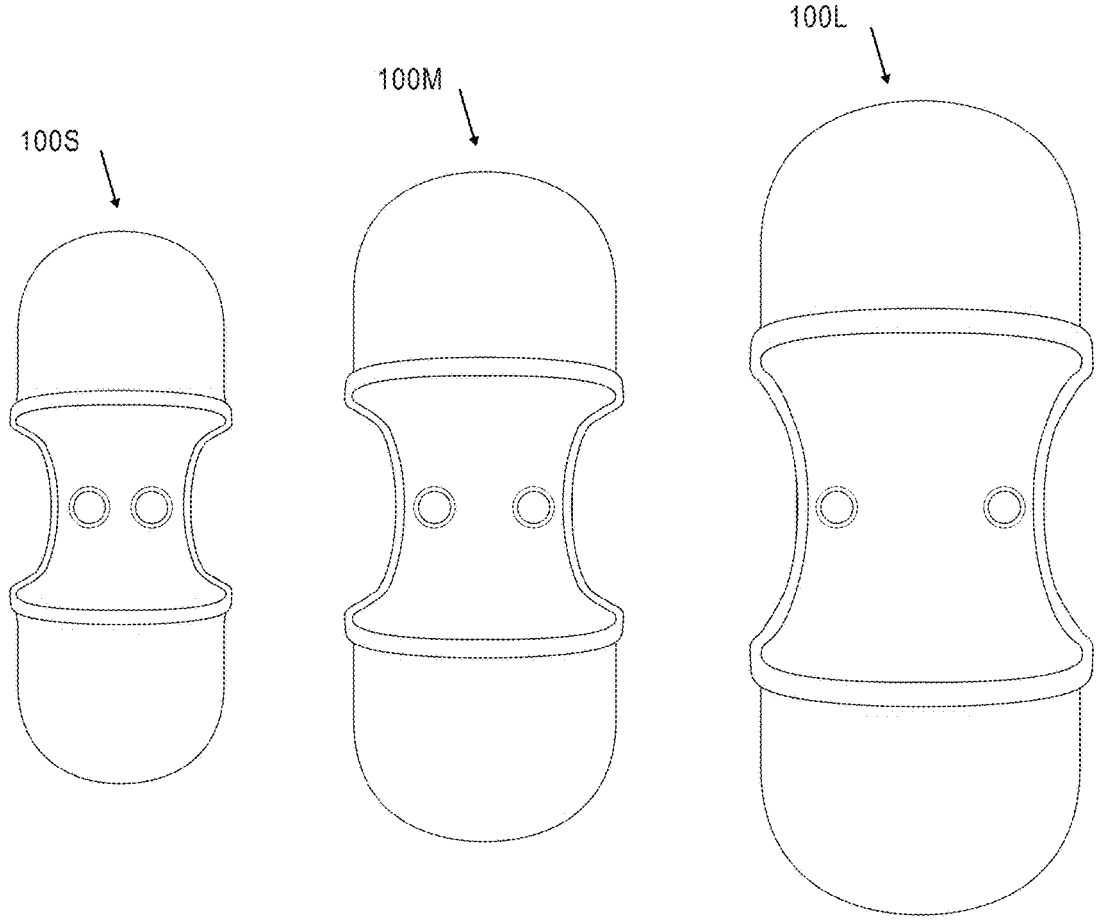
FIG. 40 is a top-side view of a comparison between differently sized touch protectors, in accordance with one or more embodiments.

FIG. 40 is a top-side view comparing differently sized touch protectors 100S, 100M and 100L, in accordance with one or more embodiments. The reference numerals discussed with respect to touch protectors 100S, 100M and 100L are the same as those discussed with respect to touch protector 100 (FIG. 1). Each of the touch first base portion 101, second base portion 103, bridge portion 105, first backing member 109 and second backing member 113 in each of the protectors 100S, 100M and 100L are sized such that the length and width of each component maximizes a user's capability to insert and remove the user's thumb and/or finger(s) into an out of an appropriately sized touch protector 100. Additionally, a width of the bridge portion 105 corresponds to the width of a user's hand that would be utilizing a particularly sized touch protector. For example, the width of touch protector 100S is reduced a greater amount with respect to the overall length of the touch protector 100S than the width of the bridge portion 105 of touch protector 100 with respect to the overall length of touch protector 100L. In some embodiments, the reduced width results in a greater concave curvature in the sides of the bridge portion 105 as an overall length of the touch protector 100 is reduced. In some embodiments, regardless of whether the length of the touch protector 100 is that of touch protector 100L, touch protector 100M or touch protector 100S, a distance between an edge of the hole 119 and the nearest side of the bridge portion 105 is maintained at a predetermined value.

In some embodiments, by modifying the width of the bridge portion for each overall length of the touch protector 100 in a disproportional way, while maintaining a distance between the edge of the hole 119 and the side of the bridge portion, helps to improve the fit of the touch protector 100 for users having different sized hands while maximizing palm coverage, comfort, functionality and durability. In some embodiments, the length and width of each portion of the touch protector 100 is optionally proportionally changed with respect to the overall length of the touch protector 100 to maintain a comparable shape. In some embodiments, a distance between holes 119 is maintained as opposed to a distance between the hole 119 and the side of the base portion 105. In some embodiments, one or more of touch protectors 100S, 100M or 100L has one hole 119 or multiple holes 119. In some embodiments, a single hole 119 is centered on bridge portion 105. In some embodiments, at least one hole 119 is positioned between the center of the bridge portion 105 and one of the sides of the bridge portion 105.

In some embodiments, the predetermined radius R of the fifth surface 105*a* is consistent across each of touch protectors 100S, 100M or 100L. For example, if the predetermined radius of fifth surface 105*a* of touch protector 100M is 13 mm, the predetermined radius of fifth surface 105*a* of touch protector 100S is 13 mm and the predetermined radius of fifth surface 105*a* of touch protector 100L is 13 mm.

In some embodiments, if the predetermined radius of fifth surface 105*a* of touch protector 100M is 13 mm, the predetermined radius of fifth surface 105*a* of touch protector 100S is less than 13 mm and the predetermined radius of fifth surface 105*a* of touch protector 100L is greater than 13 mm.

In some embodiments, the predetermined radius of fifth surface 105*a* of one or more of touch protectors 100S, 100M and 100L is in a range of 5 mm to 25 mm. In some embodiments, the predetermined radius of fifth surface 105*a* for each of the touch protectors 100S, 100M and 100L is set so that a curvature of the bridge portion 105 of each of the touch protectors 100S, 100M and 100L substantially corresponds with the curvature of a user's hand that for which the overall length and overall width of the touch protector are sized to correspond.

Figure 41:
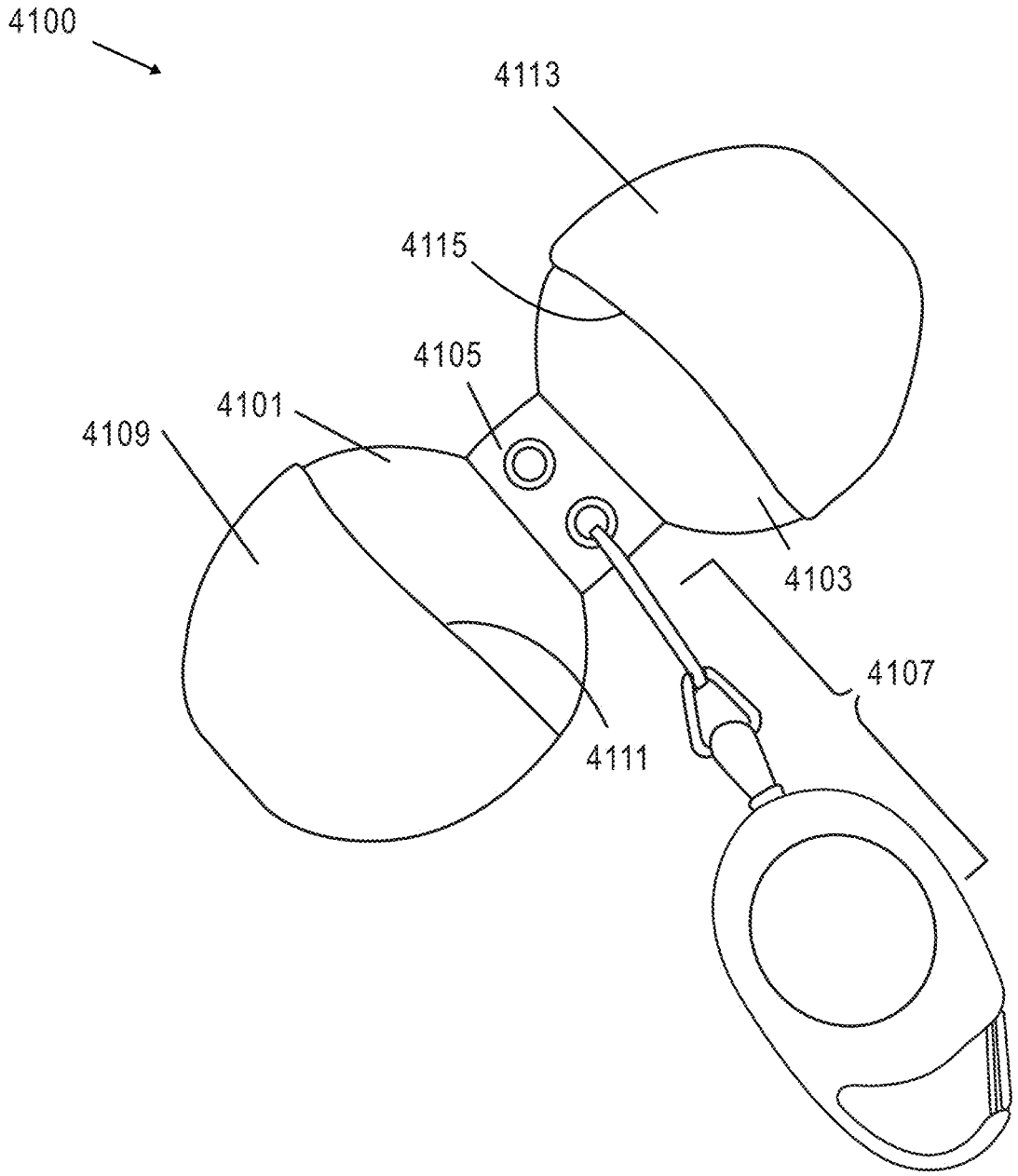
FIG. 41 is a top-side view of a touch protector in an open position, in accordance with one or more embodiments.

FIG. 41 is a top-side view of a touch protector 4100 in an open position, in accordance with one or more embodiments. Touch protector 4100 is similar to touch protector 100 (FIG. 1), with the reference numerals increased by 4000. Each of the first base portion 4101, the second base portion 4103, the bridge portion 4105, the rear backing member 4109, the second backing member 4113 and the tether 4107 are separate components attached to one another to form the touch protector 4100. In some embodiments, one or more of the first base portion 4101, the second base portion 4103, the bridge portion 4105, the rear backing member 4109, the second backing member 4113 or the tether 4107 is attached to another of the first base portion 4101, the second base portion 4103, the bridge portion 4105, the rear backing member 4109, the second backing member 4113 or the tether 4107 by way of an adhesive, stitching, a hook and loop fastener, a magnet, a weld, a fusion among components, or some other suitable manner by which the first base portion 4101, the second base portion 4103, the bridge portion 4105, the rear backing member 4109, the second backing member 4113 and the tether 4107 are capable of being joined.

In some embodiments, one or more of the first base portion 4101, the second base portion 4103, the bridge portion 4105, the rear backing member 4109, the second backing member 4113 or the tether 4107 is removably attached to another of the first base portion 4101, the second base portion 4103, the bridge portion 4105, the rear backing member 4109, the second backing member 4113 or the tether 4107 such that one or more components is capable of being separated from the other components to facilitate cleaning, replacement of one or more worn components, and/or customization of fit, colors, end options, or tether types.

The structures formed by first base portion 4101 and the first backing member 4109, and by the second base portion 4103 and the second backing member 4113 have squared-off ends. In some embodiments, the squared-off ends create slight corners in each structure to assist a user with contacting certain surfaces, such as a touch pad, elevator button, or doorbell, for example. In some embodiments, one or more of the first base portion 4101, the second base portion 4103, the bridge portion 4105, the rear backing member 4109, or the second backing member 4113 is integrally formed by a continuous material with another of the first base portion 4101, the second base portion 4103, the bridge portion 4105, the rear backing member 4109, or the second backing member 4113.

Figure 42:
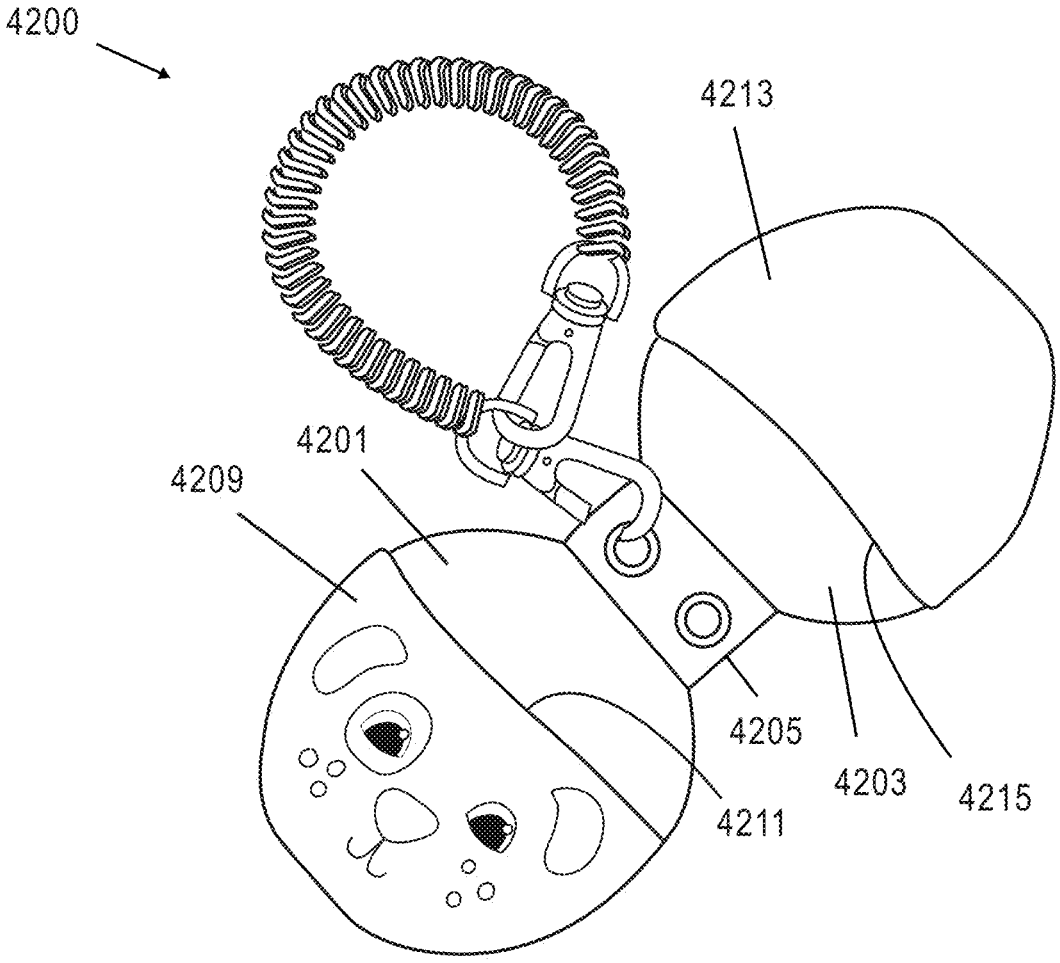
FIG. 42 is a top-side view of a touch protector in an open position, in accordance with one or more embodiments.

FIG. 42 is a top-side view of a touch protector 4200 in an open position, in accordance with one or more embodiments. Touch protector 4200 is similar to touch protector 100 (FIG. 1), with the reference numerals increased by 4100. Touch protector 4200 has a first base portion 4201 and a first backing member 4209 that, together, are shaped to resemble a dog. In some embodiments, the touch protector 4200 is shaped to resemble a different animal or cartoon character, for example. Touch protector 4200 includes an optional tether 4207 that is a coiled cord having a clip fastener on one end and is coupled with the bridge portion 4205.

In some embodiments, at least one of the first base portion 4201 and the first backing member 4209 is molded to be shaped to resemble a dog. In some embodiments, one or more of first base portion 4201 or first backing member 4209 is generically shaped to have protrusions representative of ears or a nose, for example, and the surface of the first backing member 4209 is printed to resemble a dog.

In some embodiments, one or more structures are removably attached to the first backing member 4209 that cause the first backing member 4209 to be shaped like a dog. In some embodiments, one or more structures are capable of being replaced to change an expression of the dog, or cause the first backing member 4209 to be shaped like a different animal such as a cat or a frog. In some embodiments, second backing member 4213 is similar to first backing member 4209 such that the second backing member 4213 is shaped like the same animal, a back end of an animal, a different animal, and/or has one or more structures removably attached to the second backing member 4213 to change an expression of the dog, or cause the second backing member 4209 to be shaped like a different animal such as a cat or a frog.

Figure 43:
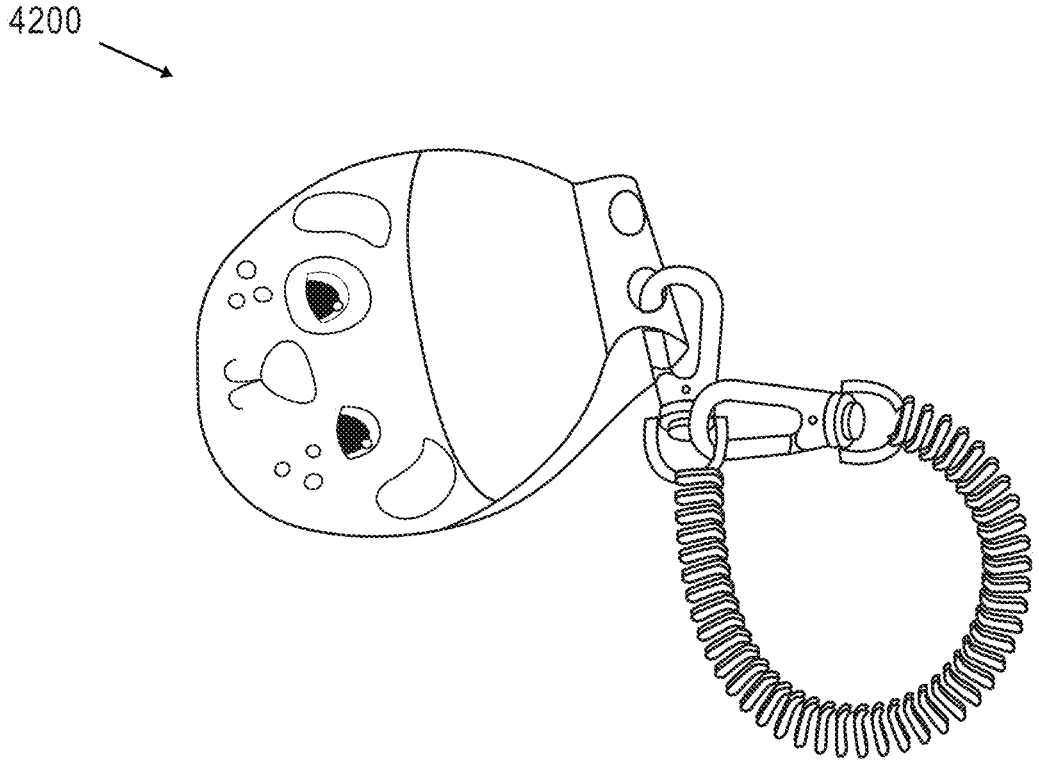
FIG. 43 is a side view of a touch protector in an at least partially closed position, in accordance with one or more embodiments.

FIG. 43 is a side view of the touch protector 4200 in an at least partially closed position, in accordance with one or more embodiments.

Figure 44:
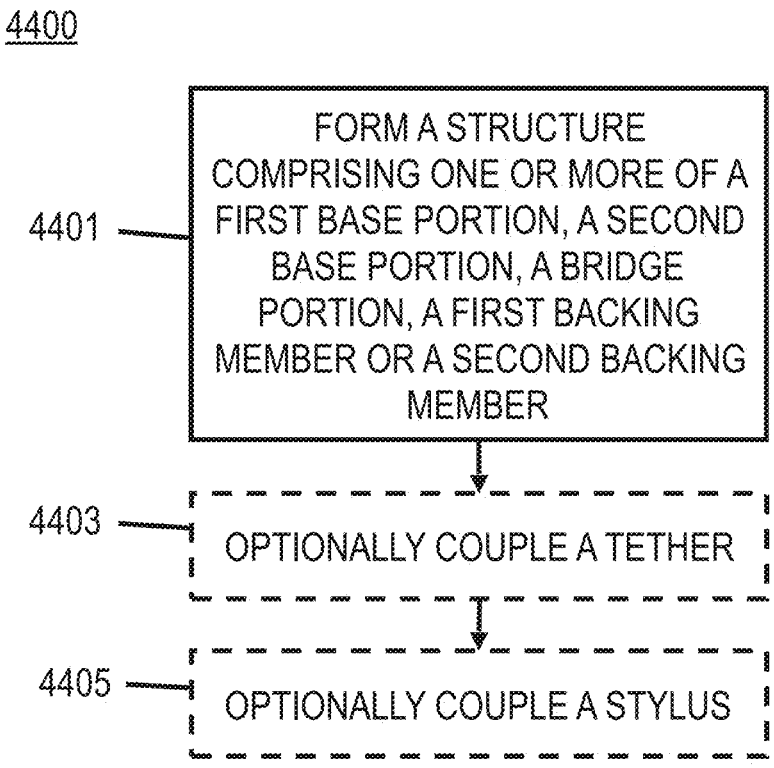
FIG. 44 is a method of making a touch protector, in accordance with one or more embodiments.

FIG. 44 is a flowchart of a method 4400 of making a touch protector, in accordance with one or more embodiments.

In step 4401, a structure comprising one or more of a first base portion such as first base portion 101 (FIG. 1), a second base portion such as second base portion 103 (FIG. 1), a bridge portion such as bridge portion 105 (FIG. 1), a first backing member such as first backing member 109 (FIG. 1) or a second backing member such as second backing member 113 (FIG. 1) is formed. In some embodiments, the structure is formed as a monolithic structure comprising a continuous material. In some embodiments, the structure is formed by joining at least two of the first base portion, the second base portion, the bridge portion, the first backing member or the second backing member together. In some embodiments, at least one of the first base portion, the second base portion, the bridge portion, the first backing member or the second backing member is formed by way of a molding process. In some embodiments, at least one of the first base portion, the second base portion, the bridge portion, the first backing member or the second backing member is formed by way of an injection molding process. In some embodiments, at least one of the first base portion, the second base portion, the bridge portion, the first backing member or the second backing member is formed by way of cast molding process. In some embodiments, at least one of the first base portion, the second base portion, the bridge portion, the first backing member or the second backing member is formed by way of a 3-D printer.

In optional step 4403, a tether such as tether 107 (FIG. 1) is coupled with at least one of the first base portion, the second base portion, the bridge portion, the first backing member or the second backing member.

In optional step 4405, a stylus such as style 1502 (FIG. 15) is coupled with at least one of the first base portion, the second base portion, the bridge portion, the first backing member, the second backing member, or the optional tether.

An aspect of this description is directed to an apparatus comprising a first base portion having a first surface and a second surface opposite the first surface. The apparatus also comprises a second base portion having a third surface and a fourth surface opposite the third surface. The apparatus further comprises a bridge portion coupling the first base portion and the second base portion. The apparatus additionally comprises a tether one or more of extending from or coupled with at least one of the first base portion, the second base portion, or the bridge portion.

Another aspect of this description is related to an apparatus comprising a first base portion having a first surface, a second surface opposite the first surface, a first length extending in a first direction from a first end of the first base portion to a second end of the first base portion opposite the first end of the first base portion, and a first width extending in a second direction different from the first direction. The first width extends from a first side of the first base portion to a second side of the first base portion opposite the first side of the first base portion. The apparatus also comprises a second base portion having a third surface and a fourth surface opposite the third surface, a second length extending in the first direction from a first end of the second base portion to a second end of the second base portion opposite the first end of the second base portion, and a second width extending in the second direction. The second width extends from a first side of the second base portion to a second side of the second base portion opposite the first side of the second base portion. The apparatus further comprises a first backing member on a second surface side of the first base portion. The first backing member and the first base portion are configured to have a first space between the first backing member and the first base portion. The apparatus additionally comprises a second backing member on a fourth surface side of the second base portion. The second backing member and the second base portion are configured to have a second space between the second backing member and the second base portion. The apparatus also comprises a bridge portion coupling the first base portion and the second base portion. The bridge portion has a fifth surface adjoining the first surface and the third surface, a sixth surface opposite the fifth surface adjoining the second surface and the fourth surface, a third length extending in the first direction from a first end of the bridge portion to a second end of the bridge portion opposite the first end of the bridge portion, and a third width extending in the second direction. The third width extends from a first side of the bridge portion to a second side of the bridge portion opposite the first side of the bridge portion. The first length and the second length are greater than the third length, the first width and the second width are greater than the third width, and the fifth surface has a radius about a center axis.

Another aspect of this description is related to an apparatus, comprises a first base portion having a first surface, a second surface opposite the first surface, a first length extending in a first direction from a first end of the first base portion to a second end of the first base portion opposite the first end of the first base portion, and a first width extending in a second direction different from the first direction. The first width extends from a first side of the first base portion to a second side of the first base portion opposite the first side of the first base portion. The apparatus also comprises a second base portion having a third surface and a fourth surface opposite the third surface, a second length extending in the first direction from a first end of the second base portion to a second end of the second base portion opposite the first end of the second base portion, and a second width extending in the second direction. The second width extends from a first side of the second base portion to a second side of the second base portion opposite the first side of the second base portion. The apparatus further comprises a bridge portion coupling the first base portion and the second base portion. The bridge portion has a third length extending in the first direction from a first end of the bridge portion to a second end of the bridge portion opposite the first end of the bridge portion, and a third width extending in the second direction, the third width extending from a first side of the bridge portion to a second side of the bridge portion opposite the first side of the bridge portion. The apparatus additionally comprises a first backing member on a second surface side of the first base portion. The first backing member and the first base portion are configured to have a first space between the first backing member and the first base portion. The apparatus also comprises a second backing member on a fourth surface side of the second base portion. The second backing member and the second base portion are configured to have a second space between the second backing member and the second base portion. The first length and the second length are greater than the third length, at least one of the first width or the second width is greater than the third width, the first side of the bridge portion is concave with respect to an interior of the bridge portion, and the second side of the bridge portion is concave with respect to the interior of the bridge portion.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus, comprising:

a first base portion having a first surface and a second surface opposite the first surface, a first length extending in a first direction from a first end of the first base portion to a second end of the first base portion opposite the first end of the first base portion, and a first width extending in a second direction different from the first direction, the first width extending from a first side of the first base portion to a second side of the first base portion opposite the first side of the first base portion;

a second base portion having a third surface and a fourth surface opposite the third surface, a second length extending in the first direction from a first end of the second base portion to a second end of the second base portion opposite the first end of the second base portion, and a second width extending in the second direction, the second width extending from a first side of the second base portion to a second side of the second base portion opposite the first side of the second base portion;

a first backing member on a side of the second surface of the first base portion, the first backing member and the first base portion being configured to have a first space between the first backing member and the first base portion;

a second backing member on a side of the fourth surface of the second base portion, the second backing member and the second base portion being configured to have a second space between the second backing member and the second base portion;

a bridge portion coupling the first base portion and the second base portion; and a tether coupled with the bridge portion, wherein the first length is equal to the second length, the first width is equal to the second width, and an interior sidewall of the first backing member is separated from an exterior of the first backing member by a distance greater than a first backing member thickness of a majority of the first backing member, and a second backing member thickness of the second backing member is less than the distance by which the interior sidewall of the first backing member is separated from the exterior of the first backing member such that the first space is smaller than the second space.

2. The apparatus of claim 1, wherein the first base portion has a first thickness in a first direction, the second base portion has a second thickness in the first direction, and the bridge portion has a third thickness in the first direction, and the third thickness is different from the first thickness and the second thickness.

3. The apparatus of claim 2, wherein the first backing member and the first base portion are configured to form a collapsible pocket such that the first space expands based on a size of an object within the collapsible pocket and retracts based the object being removed from the collapsible pocket.

4. The apparatus of claim 1, wherein the first base portion, the second base portion, the bridge portion, the first backing member and the second backing member comprise identical materials.

5. The apparatus of claim 4, wherein the first base portion, the second base portion, the bridge portion, the first backing member and the second backing member are a monolithic structure.

6. The apparatus of claim 1, wherein the first base portion has a first mass and the second base portion has a second mass, and the bridge portion is configured to flex based on at least one of the first mass or the second mass such that the first base portion, the second base portion and the bridge portion together form a substantially U-shaped structure in a side view if the first base portion is over the second base portion, if the second base portion is over the first base portion, and if the bridge portion is over the first base portion and the second base portion.

7. The apparatus of claim 1, further comprising:

a ridge extending along opposing sides of the bridge portion, along a first edge of the first backing member opposite the first base portion defining a first opening of the first space, and along a second edge of the second backing member opposite the second base portion defining a second opening of the second space, the ridge having a ridge thickness greater than the first backing member thickness.

8. The apparatus of claim 7, wherein the ridge thickness is greater than a thickness of the bridge portion.

9. The apparatus of claim 8, wherein the ridge thickness along the base portion causes the bridge portion to maintain a curvature having a predetermined radius with the first base member over the second base portion, the second base portion over the first base portion, and the bridge portion over the first base portion and the second base portion.

10. The apparatus of claim 1, wherein the distance between the interior sidewall of the first backing member and the exterior of the first backing member is filled with a solid material, increasing the first backing member thickness and causing the first space to be smaller than the second space.

11. The apparatus of claim 1, wherein the distance between the interior sidewall of the first backing member and the exterior of the first backing member is filled by one or more ribs increasing the first backing member thickness and causing the first space to be smaller than the second space.

12. An apparatus, comprising:

a first base portion having a first surface, a second surface opposite the first surface, a first length extending in a first direction from a first end of the first base portion to a second end of the first base portion opposite the first end of the first base portion, and a first width extending in a second direction different from the first direction, the first width extending from a first side of the first base portion to a second side of the first base portion opposite the first side of the first base portion;

a second base portion having a third surface and a fourth surface opposite the third surface, a second length extending in the first direction from a first end of the second base portion to a second end of the second base portion opposite the first end of the second base portion, and a second width extending in the second direction, the second width extending from a first side of the second base portion to a second side of the second base portion opposite the first side of the second base portion;

a first backing member on a side of the second surface of the first base portion, the first backing member and the first base portion being configured to have a first space between the first backing member and the first base portion;

a second backing member on a side of the fourth surface of the second base portion, the second backing member and the second base portion being configured to have a second space between the second backing member and the second base portion; and a bridge portion coupling the first base portion and the second base portion, the bridge portion having a fifth surface adjoining the first surface and the third surface, a sixth surface opposite the fifth surface adjoining the second surface and the fourth surface, a third length extending in the first direction from a first end of the bridge portion to a second end of the bridge portion opposite the first end of the bridge portion, and a third width extending in the second direction, the third width extending from a first side of the bridge portion to a second side of the bridge portion opposite the first side of the bridge portion;

wherein the first length is equal to the second length, the first width is equal to the second width, and an interior sidewall of the first backing member is separated from an exterior of the first backing member by a distance greater than a first backing member thickness of a majority of the first backing member, a second backing member thickness of the second backing member is less than the distance by which the interior sidewall of the first backing member is separated from the exterior of the first backing member such that the first space is smaller than the second space, the first length and the second length are greater than the third length, the first width and the second width are greater than the third width, and the fifth surface has a radius about a center axis.

13. The apparatus of claim 12, wherein the first side of the bridge portion is curved and the second side of the bridge portion is curved.

14. The apparatus of claim 13, wherein the third width is minimized in the second direction between a first midpoint of the first side of the bridge portion and a second midpoint of the second side of the bridge portion.

15. The apparatus of claim 12, wherein the first base portion, the second base portion, the bridge portion, the first backing member and the second backing member comprise an identical material, the first base portion has a first thickness between the first surface and the second surface in a third direction orthogonal to the first direction and the second direction, the second base portion has a second thickness between the third surface and the fourth surface in the third direction, the bridge portion has a third thickness between the fifth surface and the sixth surface in the third direction, and the third thickness is greater than the first thickness and the second thickness.

16. The apparatus of claim 15, wherein the first base portion, the second base portion, the bridge portion, the first backing member and the second backing member are a monolithic structure.

17. The apparatus of claim 15, wherein the first backing member and the first base portion are configured to form a collapsible pocket such that the first space expands based on a size of an object within the collapsible pocket and retracts based the object being removed from the collapsible pocket.

18. The apparatus of claim 12, further comprising:

a tether coupled with the bridge portion.

19. The apparatus of claim 18, further comprising:

a stylus coupled with the tether.

20. An apparatus, comprising:

a first base portion having a first surface, a second surface opposite the first surface, a first length extending in a first direction from a first end of the first base portion to a second end of the first base portion opposite the first end of the first base portion, and a first width extending in a second direction different from the first direction, the first width extending from a first side of the first base portion to a second side of the first base portion opposite the first side of the first base portion;

a second base portion having a third surface and a fourth surface opposite the third surface, a second length extending in the first direction from a first end of the second base portion to a second end of the second base portion opposite the first end of the second base portion, and a second width extending in the second direction, the second width extending from a first side of the second base portion to a second side of the second base portion opposite the first side of the second base portion;

a bridge portion coupling the first base portion and the second base portion, the bridge portion having a third length extending in the first direction from a first end of the bridge portion to a second end of the bridge portion opposite the first end of the bridge portion, and a third width extending in the second direction, the third width extending from a first side of the bridge portion to a second side of the bridge portion opposite the first side of the bridge portion;

a first backing member on a side of the second surface of the first base portion, the first backing member and the first base portion being configured to have a first space between the first backing member and the first base portion; and a second backing member on a side of the fourth surface of the second base portion, the second backing member and the second base portion being configured to have a second space between the second backing member and the second base portion;

wherein the first length and the second length are greater than the third length, the first width and the second width are greater than the third width, the first length is equal to the second length, the first width is equal to the second width, an interior sidewall of the first backing member is separated from an exterior of the first backing member by a distance greater than a first backing member thickness of a majority of the first backing member, a second backing member thickness of the second backing member is less than the distance by which the interior sidewall of the first backing member is separated from the exterior of the first backing member such that the first space is smaller than the second space, the first side of the bridge portion is concave with respect to an interior of the bridge portion, and the second side of the bridge portion is concave with respect to the interior of the bridge portion.

* * * * *